US010731453B2

(12) United States Patent
Groover et al.

(10) Patent No.: US 10,731,453 B2
(45) Date of Patent: Aug. 4, 2020

(54) SYSTEM AND METHOD OF AUTOMATING A SLIDE DRILLING OPERATION

(71) Applicant: Nabors Drilling Technologies USA, Inc., Houston, TX (US)

(72) Inventors: Austin Groover, Spring, TX (US); Christopher Wagner, Poland, OH (US); Jesse Johnson, Cleveland, TX (US); Colin Gillan, Houston, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 247 days.

(21) Appl. No.: 15/872,495

(22) Filed: Jan. 16, 2018

(65) Prior Publication Data

US 2019/0218901 A1 Jul. 18, 2019

(51) Int. Cl.
*E21B 44/00* (2006.01)
*E21B 3/02* (2006.01)
(Continued)

(52) U.S. Cl.
CPC ..... *E21B 44/00* (2013.01); *E21B 3/02* (2013.01); *E21B 7/04* (2013.01); *E21B 19/008* (2013.01);
(Continued)

(58) Field of Classification Search
CPC . E21B 44/00; E21B 7/04; E21B 47/12; E21B 44/02; E21B 44/04
See application file for complete search history.

(56) References Cited

U.S. PATENT DOCUMENTS 6,802,378 B2 * 10/2004 Haci ..... E21B 7/068 175/26
6,918,453 B2 7/2005 Haci et al.
(Continued)

FOREIGN PATENT DOCUMENTS

| | | |
|---|---|---|
| WO | 2004/061258 | 7/2004 |
| WO | 2004/101944 | 11/2004 |
| WO | 2004/104358 | 12/2004 |

OTHER PUBLICATIONS

U.S. Appl. No. 60/469,293, Maidla et al., filed May 10, 2003.
U.S. Appl. No. 15/603,784, Wagner et al., filed May 24, 2016.
U.S. Appl. No. 15/225,163, Maidla et al., filed Aug. 1, 2016.

*Primary Examiner* — Caroline N Butcher
(74) *Attorney, Agent, or Firm* — Haynes and Boone, LLP

(57) ABSTRACT

A system and method of automating a slide drilling operation comprising a plurality of tasks is described. The method includes presenting, on a GUI, selectable indicators, with each indicator being associated with one task from the plurality of tasks; wherein the GUI is coupled to a controller in communication with drilling equipment, wherein the controller is configured to: receive data from the drilling equipment; and control the drilling equipment using predetermined workflows and task parameters; receiving a selection command associated with: a selectable indicator, a first task, and a first predetermined workflow; presenting on the GUI, in response to the receipt of the selection command, a dialogue box for receiving task parameters associated with the first predetermined workflow; receiving, using the dialogue box, the task parameters; and executing, using the controller and the drilling equipment, the first task using the first predetermined workflow and the first plurality of task parameters.

20 Claims, 33 Drawing Sheets

(51) Int. Cl.

| | |
|---|---|
| ***E21B 19/00*** | (2006.01) |
| ***E21B 7/04*** | (2006.01) |
| *E21B 47/00* | (2012.01) |
| *E21B 47/024* | (2006.01) |
| *E21B 47/007* | (2012.01) |

(52) U.S. Cl.
CPC ..... *E21B 47/00* (2013.01); *E21B 47/007* (2020.05); *E21B 47/024* (2013.01)

(56) References Cited

U.S. PATENT DOCUMENTS

| | | | | |
|---|---|---|---|---|
| 7,096,979 | B2 | 8/2006 | Haci et al. | |
| RE45,898 | E | 2/2016 | Maidla et al. | |
| RE46,090 | E | 8/2016 | Maidla et al. | |
| 9,784,089 | B2 | 10/2017 | Boone et al. | |
| 2009/0090555 | A1* | 4/2009 | Boone | E21B 44/02 175/45 |
| 2016/0237802 | A1* | 8/2016 | Boone | E21B 7/06 |

* cited by examiner

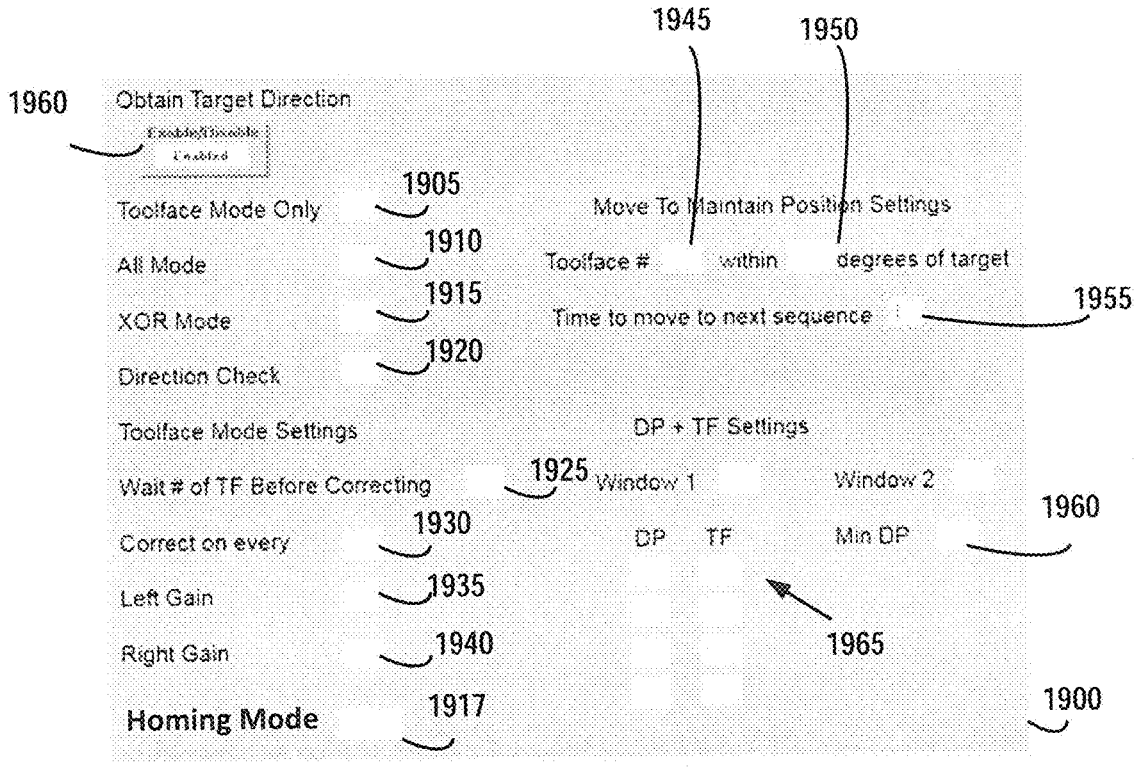
FIG. 19A
1965'
| A | |
|---|---|
| DF | TF |
| 25 | 30 |
| 90 | 70 |
| 120 | 180 |
| 200 | 300 |
FIG. 19B
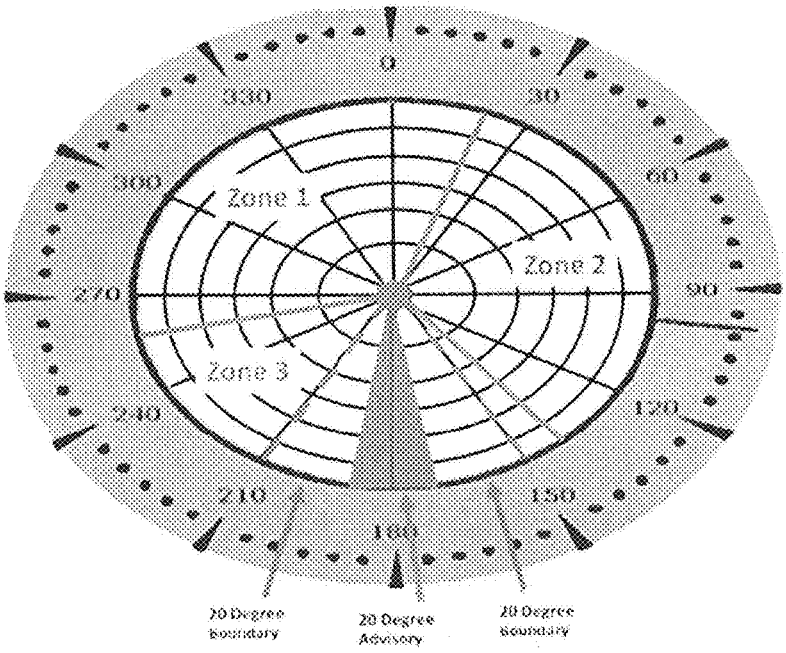
FIG. 21

SYSTEM AND METHOD OF AUTOMATING A SLIDE DRILLING OPERATION

BACKGROUND

At the outset of a drilling operation, drillers typically establish a drilling plan that includes a target location and a drilling path to the target location. Once drilling commences, the bottom hole assembly is directed or "steered" from a vertical drilling path in any number of directions, to follow the proposed drilling plan. For example, to recover an underground hydrocarbon deposit, a drilling plan might include a vertical well to a point above the reservoir, then a directional or horizontal well that penetrates the deposit. The operator may then steer the bit through both the vertical and horizontal aspects in accordance with the plan.

In some embodiments, such directional drilling requires accurate orientation of a bent segment of the downhole motor that drives the bit. In such embodiments, rotating the drill string changes the orientation of the bent segment and the toolface and can also cause torque to become trapped in the drill string. Thus, a transition from rotating drilling to slide drilling requires multiple steps to properly orient the bent segment and the toolface. This typically requires the operator to manipulate the drawworks brake, and rotate the rotary table or top drive quill to find the precise combinations of hook load, mud motor differential pressure, and drill string torque, to properly position the toolface. This can be difficult, time consuming, and complex. Each adjustment has different effects on the toolface orientation, and each must be considered in combination with other drilling requirements to drill the hole. Thus, transitioning from rotating drilling to slide drilling is very complex, labor intensive, and often inaccurate process. A more efficient, reliable method for executing sliding instructions is needed.

SUMMARY OF THE INVENTION

In one example aspect, the present disclosure is directed to a method of automating a slide drilling operation that includes a plurality of tasks, the method including presenting selectable indicators, on a graphical user interface, wherein each selectable indicator is associated with one task from the plurality of tasks related to the slide drilling operation; wherein the graphical user interface is operably coupled to a controller that is in communication with drilling equipment, wherein the controller is configured to: receive data from the drilling equipment; and control the operation of at least a portion of the drilling equipment using a predetermined workflow and task parameters; and wherein each task is associated with at least one predetermined workflow; receiving by the controller a first selection command associated with a first selectable indicator presented on the graphical user interface, a first task, and a first predetermined workflow; presenting on the graphical user interface, in response to the receipt of the first selection command, a first dialogue box for receiving a first plurality of task parameters associated with the first predetermined workflow; receiving, using the first dialogue box, the first plurality of task parameters; and executing, using the controller and at least a portion of the drilling equipment, the first task using the first predetermined workflow and the first plurality of task parameters. In some embodiments, the plurality of tasks includes one or more of: removing trapped torque from a drill string; auto-oscillating the drill string; tagging bottom using the drill string; obtaining a target toolface angle; maintaining the target toolface angle; and evaluating a slide drilling operation. In some embodiments, the method also includes: automatically presenting the selectable indicators on the graphical user interface during or after the execution of the first task; receiving by the controller a second selection command associated with: a second selectable indicator of the selectable indicators; a second task; and a second predetermined workflow; presenting on the graphical user interface, in response to the receipt of the second selection command, a second dialogue box configured to receive a second plurality of task parameters; receiving, using the second dialogue box, the second plurality of task parameters; and automatically executing, using the controller and at least a portion of the drilling equipment, the second task using the second predetermined workflow and the second plurality of task parameters. In some embodiments, the first task is removing trapped torque from a drill string that is coupled to a bottom hole assembly used in the slide drilling operation; the first task of removing trapped torque from the drill string is associated with a workflow to move the drill string vertically in first and second opposing directions, and with a workflow to rotate the drill string; wherein the method further includes: presenting, on the graphical user interface, a second dialogue box for receiving a second selection command selecting the workflow to move the drill string vertically as the first predetermined workflow or the workflow to rotate the drill string as the first predetermined workflow; and receiving, by the controller, the second selection command; wherein, when the workflow to move the drill string vertically in the first and second opposing directions is the first predetermined workflow, the first plurality of task parameters includes: a speed at which the drill string is to be moved vertically in the first and second opposing directions; a number of repetitions of moving the drill string vertically in the first and second opposing directions; or a vertical distance over which the drill string is to be moved vertically in the first and second opposing directions with each repetition; and wherein, when the workflow to rotate the drill string is the first predetermined workflow, the first plurality of task parameters includes a number of rotations of the drill string. In some embodiments, the second selection command selects the workflow to rotate the drill string as the first predetermined workflow; wherein the drilling equipment includes a top drive; and wherein executing the first task using the first predetermined workflow and the first plurality of task parameters includes automatically rotating, in response to the receipt of the second selection command and first plurality of task parameters, the drill string the number of rotations using the top drive. In some embodiments, the second selection command selects the workflow to move the drill string vertically as the first predetermined workflow; wherein the drilling equipment includes a drawworks; and wherein executing the first task using the first predetermined workflow and the first plurality of task parameters includes automatically lifting the drill string, in response to the receipt of the second selection command and the first plurality of task parameters, the vertical distance at the speed for the number of repetitions using the drawworks. In some embodiments, the drilling equipment further includes a top drive brake, wherein the workflow to move the drill string vertically as the first predetermined workflow also includes releasing the top drive brake; and wherein executing the first task using the first predetermined workflow and the first plurality of task parameters further includes automatically releasing the top drive brake. In some embodiments, the first task is auto-oscillating the drill string, wherein the drilling equipment includes: a top drive, and a weight on bit sensor;

wherein the first plurality of task parameters includes measuring a minimum weight on bit threshold measurement; wherein the method further includes: receiving, by the controller, data from the weight on bit sensor; determining, using the data from the weight on bit sensor and the controller, an estimated weight on bit; and wherein executing the first task using the first predetermined workflow and the first plurality of task parameters includes automatically oscillating the drill string, using the top drive, upon the controller determining that the estimated weight on bit exceeds the minimum weight on bit threshold measurement. In some embodiments, the drilling equipment includes: a bottom hole assembly ("BHA") coupled to a drill string that extends within a wellbore; a toolface sensor coupled to the BHA; and a top drive configured to rotate the drill string at the surface of the wellbore, wherein the first task is tagging bottom using the BHA; wherein the first plurality of task parameters includes a drill string rotation parameter; wherein executing the first task using the first predetermined workflow and the first plurality of task parameters includes: receiving, by the controller and from the toolface sensor, data associated with a first estimated toolface angle of the BHA while the BHA is off-bottom of the wellbore; determining, by the controller and based on the data associated with the first estimated toolface angle of the BHA, the first estimated toolface angle while the BHA is off-bottom; determining while the BHA is off-bottom, by the controller, a target toolface angle of the BHA; calculating, by the controller, a first difference measured in a clockwise direction between the target toolface angle and the first estimated toolface angle; when the first difference is greater than 180 degrees, calculating, by the controller, an adjusted drill string rotation parameter using a first rule and the drill string rotation parameter; when the first difference is equal to or less than 180 degrees, calculating, by the controller, the adjusted drill string rotation parameter using a second rule and the drill string rotation parameter; rotating, by the controller and using the top drive, the drill string by the adjusted drill string rotation parameter while the BHA is off-bottom; and tagging bottom, using the BHA, after rotating the drill string by the adjusted drill string rotation parameter. In some embodiments, the first rule includes adding the drill string rotation parameter to a second difference between 360 degrees and the first difference; and wherein the second rule includes subtracting the first difference from the drill string rotation parameter. In some embodiments, the drill string rotation parameter is defined by a number of rotations of the drill string in a first direction. In some embodiments, the drilling equipment further includes: a bottom hole assembly ("BHA") coupled to a drill string that extends within a wellbore; a toolface sensor coupled to the BHA; and a top drive configured to rotate the drill string at the surface of the wellbore; wherein the first task is either obtaining a target toolface angle or maintaining toolface the target toolface angle during the slide drilling operation; wherein the first plurality of task parameters includes a selected period of time; wherein, executing, using the controller and the drilling equipment, the first task using the first predetermined workflow and the first plurality of task parameters includes: receiving, by the controller and from the toolface sensor, first drilling data from the BHA; determining, by the controller and using the first drilling data, a first estimated toolface angle of the BHA; determining, by the controller, if the first estimated toolface angle of the BHA is within a threshold deviation from the target toolface angle; when the first estimated toolface angle is not within the threshold deviation, then incrementing a count of a toolface counter from zero to one; receiving, by the controller and from the toolface sensor, second drilling data from the BHA; determining, by the controller and using the second drilling data, a second estimated toolface angle of the BHA; determining, by the controller, if the second estimated toolface angle of the BHA is within the threshold deviation from the target toolface angle; and when the second estimated toolface angle is not within the threshold deviation and the toolface counter is at one, then determining whether a difference between the first estimated toolface angle and the second estimated toolface angle, measured in a clockwise direction from the first estimated toolface angle is between 20 degrees and 180 degrees; when the difference is not between 20 degrees and 180 degrees, then pausing, using the controller and the top drive, rotation of the drill string for the selected period of time; and when the difference is between 20 degrees and 180 degrees, then resetting the count of the toolface counter to zero. In some embodiments, the threshold deviation includes: up to 60 degrees measured in the counterclockwise direction from the target toolface angle; and up to 120 degrees measured in a clockwise direction from the target toolface angle. In some embodiments, the selected period of time is about 10 seconds. In some embodiments, the drilling equipment further includes a mud pump; and wherein pausing drilling activities further includes ceasing operation of the mud pump. In some embodiments, pausing drilling activities reduces a downhole pressure differential In some embodiments, the plurality of tasks includes: a first task of removing trapped torque from a drill string; a second task of auto-oscillating the drill string; a third task of tagging bottom using the drill string; a fourth task of obtaining a target toolface angle; a fifth task of maintaining a toolface angle during the slide drilling operation; and a sixth task of evaluating a slide drilling operation; and wherein the method further includes automatically executing, using the controller and at least a portion of the drilling equipment: the fifth task after completion of the fourth task; the fourth task after completion of the third task; the third task after completion of the second task; or the second task after completion of the first task.

In one example aspect, the present disclosure is directed to a method of reducing stored torque within a drill string that extends within a wellbore of a well, the method including: storing, using a computing system, a first predetermined workflow to reduce stored torque within the drill string, and a second predetermined workflow to reduce stored torque within the drill string; wherein the first predetermined workflow includes instructions to vertically move the drill string in first and opposing second directions; and wherein the second predetermined workflow includes instructions to rotate the drill string in a first direction; presenting, using a graphical user interface operably coupled to the computing system, a first dialogue box configured to receive a selection command selecting the first predetermined workflow or the second predetermined workflow, and task parameters; receiving, by the controller, the selection command selecting the first predetermined workflow or the second predetermined workflow; further receiving, using the graphical user interface and when the selection command selects the first predetermined workflow, a first plurality of task parameters, the first plurality of task parameters including: a speed at which the drill string is to be moved vertically in the first and second opposing directions; a number of repetitions for moving the drill string vertically in the first and second opposing directions; and a vertical distance in which the drill string is to be moved vertically in the first and second opposing directions with each repetition; further receiving, using the graphical user interface and when the selection command selects the second predetermined workflow, a second plurality of task parameters, wherein the second plurality of task parameters includes a drill string rotation parameter; and automatically executing either the first predetermined workflow or the second predetermined workflow using drilling equipment operably coupled to a controller of the computing system, in response to the receipt of the selection command and either the first plurality of task parameters or the second plurality of task parameters. In some embodiments, the drilling equipment includes a top drive; and wherein the method further includes: receiving, using the graphical user interface, the selection command selecting the second predetermined workflow; and automatically executing the second predetermined workflow, wherein automatically executing the second predetermined workflow includes rotating, using the controller and the top drive, the drill string in accordance with the drill string rotation parameter. In some embodiments, the drill string rotation parameter is a number of rotations of the drill string at the surface of the well. In some embodiments, the drilling equipment includes a drawworks; and wherein the method further includes: receiving, using the graphical user interface, the selection command selecting the first predetermined workflow; and automatically executing the first predetermined workflow, wherein automatically executing the first predetermined workflow includes automatically lifting, using the controller and the drawworks, the drill string the vertical distance at the speed for the number of repetitions. In some embodiments, the drilling equipment further includes a top drive brake, wherein automatically executing the first predetermined workflow further includes releasing the top drive brake. In some embodiments, the drilling equipment further includes a travelling block coupled to the drill string and a crown block that is coupled to a mast that forms a portion of a drilling rig, wherein automatically executing the first predetermined workflow further includes controlling the drawworks to lift the drill string by the vertical distance while simultaneously monitoring a position of the travelling block relative to the crown block. In some embodiments, the drilling equipment further includes a bottom hole assembly; and wherein automatically executing the first predetermined workflow includes controlling the drawworks to lower the drill string by the vertical distance while simultaneously monitoring a position of the bottom hole assembly relative to a toe of the wellbore. In some embodiments, the drilling equipment includes a torque sensor configured to detect stored torque in the drill string; wherein the method further includes: receiving, by the controller and from the torque sensor, data relating to an amount of torque stored in the drill string; determining, by the controller and based on the data relating to the amount of torque stored in the drill string, an estimated amount of torque stored in the drill string; and determining, by the controller and based on the estimated amount of torque stored in the drill string, if the torque stored in the drill string should be reduced; wherein presenting the first dialogue box is in response to a determination by the controller that the torque stored in the drill string should be reduced. In some embodiments, automatically executing the selected predetermined workflow further includes controlling, by the controller, the drawworks to move the drill string at a speed that does not exceed a maximum speed limit.

In one example aspect, the present disclosure is directed to a method of tagging bottom using a bottom hole assembly ("BHA") that extends within a wellbore during a slide drilling operation, the method including: storing, using a computing system including a graphical user interface and a controller, a first predetermined workflow to tag bottom using the BHA, and a second predetermined workflow to tag bottom using the BHA, wherein the first predetermined workflow is different from the second predetermined workflow; presenting, using the graphical user interface, a first dialogue box configured to receive a first selection command selecting the first predetermined workflow or the second predetermined workflow; wherein the graphical user interface is operably coupled to the controller that is in communication with drilling equipment, wherein the controller is configured to: receive data from the drilling equipment; and control the operation of at least a portion of the drilling equipment using the first and second predetermined workflows and task parameters; and receiving, by the controller, the first selection command selecting the first predetermined workflow or the second predetermined workflow; presenting, using the graphical user interface, a second dialogue box configured to receive task parameters; further receiving, using the graphical user interface and when the first selection command selects the first predetermined workflow, a first plurality of task parameters including a drill string rotation parameter; further receiving, using the graphical user interface and when the first selection command selects the second predetermined workflow, a second plurality of task parameters including a second selection command selecting a first rule or a second rule; and automatically executing either the first predetermined workflow or the second predetermined workflow using at least a portion of the drilling equipment, in response to the receipt of the first selection command and either the first plurality of task parameters or the second plurality of task parameters. In some embodiments, the drilling equipment includes: the BHA; a toolface sensor coupled to the BHA; and a top drive; wherein the method further includes: receiving, by the controller, the first selection command selecting the first predetermined workflow; and automatically executing the first predetermined workflow using at least a portion of the drilling in response to the receipt of the first selection command and the first plurality of task parameters, including: receiving, by the controller and from the toolface sensor, data associated with a first estimated toolface angle of the BHA while the BHA is off-bottom of the wellbore; determining while the BHA is off-bottom, by the controller and based on the data associated with the first estimated toolface angle of the BHA, the first estimated toolface angle; determining, by the controller, a first recommended toolface angle of the BHA while the BHA is on bottom; calculating, by the controller, a difference in a clockwise direction between the first recommended toolface angle and the first estimated toolface angle; causing, by the controller, when the difference is greater than 180 degrees, to calculate an adjusted drill string rotation parameter using a first rule; wherein the adjusted drill string rotation parameter is based on the drill string rotation parameter; causing, by the controller, when the difference is equal to or less than 180 degrees, to calculate the adjusted drill string rotation parameter using a second rule; rotating, by the controller and using the top drive, the drill string by the adjusted drill string rotation parameter while the BHA is off-bottom; and tagging bottom, using the BHA, after rotating the drill string by the drill string rotation parameter. In some embodiments, the first rule includes adding the drill string rotation parameter to the difference between 360 degrees and the difference; and wherein the second rule includes subtracting the difference from the drill string rotation parameter. In some embodiments, the first drill string rotation parameter is defined by a number of rotations of the drill string in a first direction. In some embodiments, the first plurality of task parameters further includes a predetermined speed; and wherein automatically executing the first predetermined workflow using at least a portion of the drilling equipment in response to the receipt of the first selection command and the first plurality of task parameters further includes lifting and then lowering the drill string at the surface of a well that includes the wellbore by at the predetermined speed. In some embodiments, the drilling equipment includes: the BHA; a toolface sensor coupled to the BHA; and a top drive; wherein the method further includes: receiving, by the controller, the first selection command selecting the second predetermined workflow; wherein the second selection command selects the first rule, wherein the first rule defines a threshold deviation between 30 degrees from a target toolface angle in a clockwise direction and 30 degrees from the target toolface angle in a counterclockwise direction; and automatically executing the second predetermined workflow using at least a portion of the drilling equipment in response to the receipt of the first selection command and the second plurality of task parameters, including: receiving, by the controller and from the toolface sensor, data associated with an estimated toolface angle of the BHA while the BHA is off-bottom of the wellbore; determining while the BHA is off-bottom of the wellbore, by the controller, and using the data associated with the estimated toolface angle of the BHA and the predetermined workflow, the estimated toolface angle of the BHA; determining, by the controller, if the estimated toolface angle of the BHA is within the threshold deviation from an target toolface angle; when the first estimated toolface angle is within the threshold deviation, then automatically lowering, using the controller, the BHA to tag the bottom of the wellbore; and when the first estimated toolface angle is not within the threshold deviation, then: rotating the drill string, using the controller and the top drive to adjust the BHA and repeating the steps a)-e). In some embodiments, the drilling equipment includes: the BHA; a toolface sensor coupled to the BHA; and a top drive; and wherein the method further includes: receiving, by the controller, the first selection command selecting the second predetermined workflow; wherein the second selection command selects the second rule, wherein the second rule defines a threshold deviation between 75 degrees in the clockwise direction from the target toolface angle to 105 degrees in a clockwise direction from the target toolface angle; and automatically executing the second predetermined workflow using at least a portion of the drilling equipment in response to the receipt of the first selection command and the second plurality of task parameters, including: receiving, by the controller and from the toolface sensor, data associated with an estimated toolface angle of the BHA while the BHA is off-bottom of the wellbore; determining while the BHA is off-bottom of the wellbore, by the controller, and using the data associated with the estimated toolface angle of the BHA and the predetermined workflow, the estimated toolface angle of the BHA; determining, by the controller, if the estimated toolface angle of the BHA is within the threshold deviation from an target toolface angle; when the estimated toolface angle is within the threshold deviation, then automatically lowering, using the controller, the BHA to tag the bottom of the wellbore; and when the estimated toolface angle is not within the threshold deviation, then: rotating the drill string, using the controller and the top drive to adjust the BHA and repeating the steps a)-e).

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 19A is an illustration of a dialogue box of the GUI of FIG. 2A during the method of FIGS. 18A and 18B, according to one or more aspects of the present disclosure.

FIG. 19B is an example table entry, according to one or more aspects of the present disclosure.

FIG. 21 is an illustration of the GUI of FIG. 2A during the method of FIGS. 18A and 18B, according to one or more aspects of the present disclosure.

DETAILED DESCRIPTION

Figure 1:
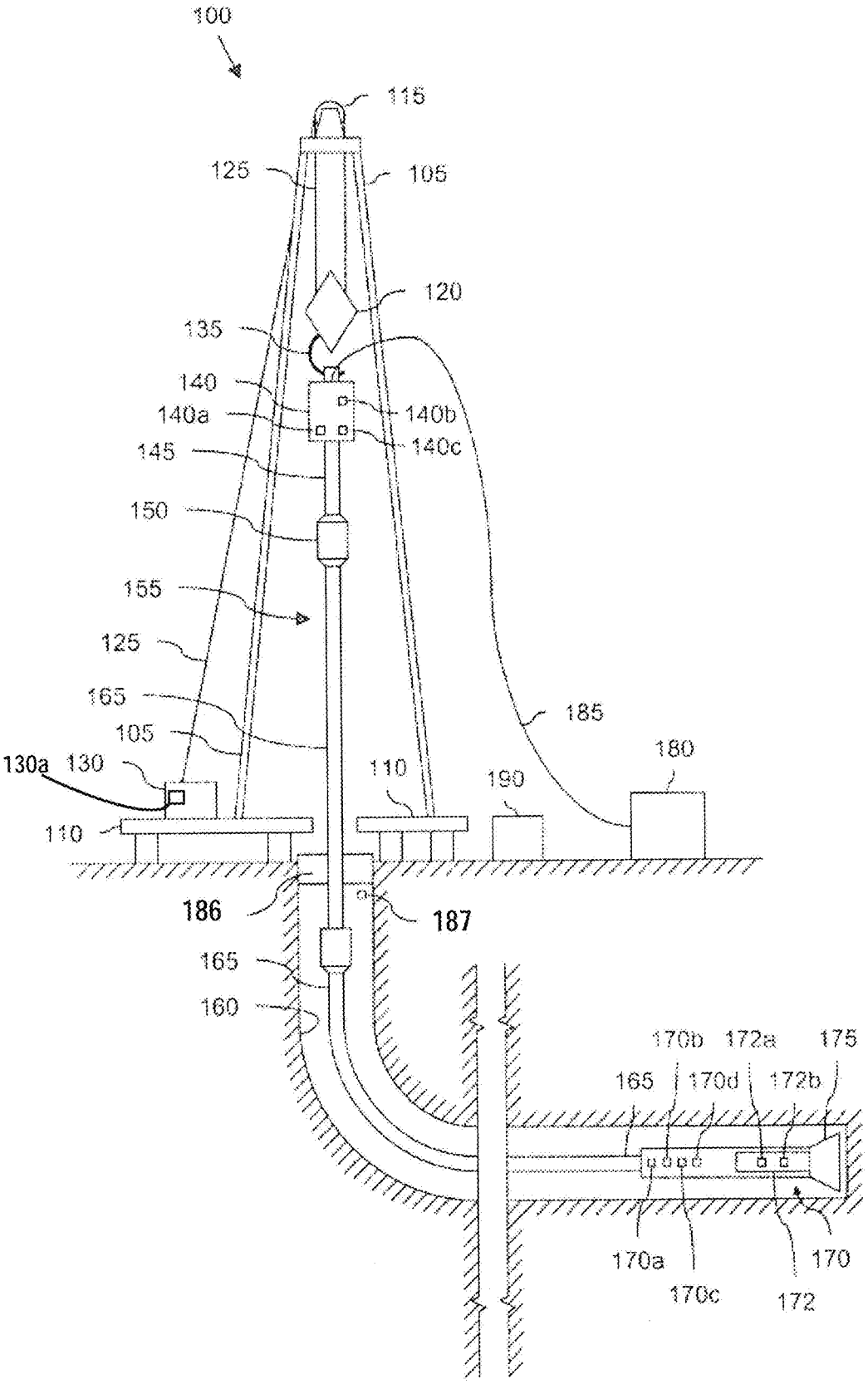
FIG. 1 is a schematic diagram of a drilling rig apparatus according to one or more aspects of the present disclosure.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The systems and methods disclosed herein automate the execution of sliding instructions, resulting in increased efficiently and speed during slide drilling compared to conventional systems that require significantly more manual input or pauses to provide for input. The invention can advantageously achieve this through the use of data feedback and location detection, processing received data, creating a stand-by-stand drilling plan, and executing automatically the stand-by-stand drilling plan. Prior to drilling, a target location is typically identified and an optimal wellbore profile or planned path is established. Such proposed drilling paths are generally based upon the most efficient or effective path to the target location or locations. As drilling proceeds, the systems and methods disclosed herein determine the position of the BHA, record and analyze results of surveys, create a plan for a next stand, and execute the plan for the next stand. Executing the plan for the next stand includes automatically executing, using the system, an automated slide sequence. Thus, the system and methods disclosed herein automate the execution of sliding instructions.

Referring to FIG. 1, illustrated is a schematic view of apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. One end of the drilling line 125 extends from the lifting gear to drawworks 130, which is configured to reel out and reel in the drilling line 125 to cause the traveling block 120 to be lowered and raised relative to the rig floor 110. The drawworks 130 may include a ROP sensor 130*a*, which is configured for detecting an ROP value or range, and a controller to feed-out and/or feed-in of a drilling line 125. The other end of the drilling line 125, known as a dead line anchor, is anchored to a fixed position, possibly near the drawworks 130 or elsewhere on the rig.

A hook 135 is attached to the bottom of the traveling block 120. A top drive 140 is suspended from the hook 135. A quill 145, extending from the top drive 140, is attached to a saver sub 150, which is attached to a drill string 155 suspended within a wellbore 160. Alternatively, the quill 145 may be attached to the drill string 155 directly.

The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165, a bottom hole assembly ("BHA") 170, and a drill bit 175. The bottom hole assembly 170 may include one or more motors 172, stabilizers, drill collars, and/or measurement-while-drilling ("MWD") or wireline conveyed instruments, among other components. The drill bit 175, which may also be referred to herein as a tool, is connected to the bottom of the BHA 170, forms a portion of the BHA 170, or is otherwise attached to the drill string 155. One or more pumps 180 may deliver drilling fluid to the drill string 155 through a hose or other conduit 185, which may be connected to the top drive 140.

The downhole MWD or wireline conveyed instruments may be configured for the evaluation of physical properties such as pressure, temperature, torque, weight-on-bit ("WOB"), vibration, inclination, azimuth, toolface orientation in three-dimensional space, and/or other downhole parameters. These measurements may be made downhole, stored in solid-state memory for some time, and downloaded from the instrument(s) at the surface and/or transmitted real-time to the surface. Data transmission methods may include, for example, digitally encoding data and transmitting the encoded data to the surface, possibly as pressure pulses in the drilling fluid or mud system, acoustic transmission through the drill string 155, electronic transmission through a wireline or wired pipe, and/or transmission as electromagnetic pulses. The MWD tools and/or other portions of the BHA 170 may have the ability to store measurements for later retrieval via wireline and/or when the BHA 170 is tripped out of the wellbore 160.

In an example embodiment, the apparatus 100 may also include a rotating blow-out preventer ("BOP") 186, such as if the wellbore 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 186. The apparatus 100 may also include a surface casing annular pressure sensor 187 configured to detect the pressure in the annulus defined between, for example, the wellbore 160 (or casing therein) and the drill string 155. It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

In the example embodiment depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 may include a downhole annular pressure sensor 170*a* coupled to or otherwise associated with the BHA 170. The downhole annular pressure sensor 170*a* may be configured to detect a pressure value or range in the annulus-shaped region defined between the external surface of the BHA 170 and the internal diameter of the wellbore 160, which may also be referred to as the casing pressure, downhole casing pressure, MWD casing pressure, or downhole annular pressure. These measurements may include both static annular pressure (pumps off) and active annular pressure (pumps on).

The apparatus 100 may additionally or alternatively include a shock/vibration sensor 170*b* that is configured for detecting shock and/or vibration in the BHA 170. The apparatus 100 may additionally or alternatively include a mud motor delta pressure (ΔP) sensor 172*a* that is configured to detect a pressure differential value or range across the one or more motors 172 of the BHA 170. In some embodiments, the mud motor ΔP may be alternatively or additionally calculated, detected, or otherwise determined at the surface, such as by calculating the difference between the surface standpipe pressure just off-bottom and pressure once the bit touches bottom and starts drilling and experiencing torque. The one or more motors 172 may each be or include a positive displacement drilling motor that uses hydraulic power of the drilling fluid to drive the bit 175, also known as a mud motor. One or more torque sensors, such as a bit torque sensor 172*b*, may also be included in the BHA 170 for sending data to a controller 190 that is indicative of the torque applied to the bit 175 by the one or more motors 172.

The apparatus 100 may additionally or alternatively include a toolface sensor 170*c* configured to estimate or detect the current toolface orientation or toolface angle. For the purpose of slide drilling, bent housing drilling systems may include the motor 172 with a bent housing or other bend component operable to create an off-center departure of the bit 175 from the center line of the wellbore 160. The direction of this departure from the centerline in a plane normal to the centerline is referred to as the "toolface angle." The toolface sensor 170*c* may be or include a conventional or future-developed gravity toolface sensor which detects toolface orientation relative to the Earth's gravitational field. Alternatively, or additionally, the toolface sensor 170*c* may be or include a conventional or future-developed magnetic toolface sensor which detects toolface orientation relative to magnetic north or true north. In an example embodiment, a magnetic toolface sensor may detect the current toolface when the end of the wellbore is less than about 7° from vertical, and a gravity toolface sensor may detect the current toolface when the end of the wellbore is greater than about 7° from vertical. However, other toolface sensors may also be utilized within the scope of the present disclosure, including non-magnetic toolface sensors and non-gravitational inclination sensors. The toolface sensor 170*c* may also, or alternatively, be or include a conventional or future-developed gyro sensor. The apparatus 100 may additionally or alternatively include a WOB sensor 170*d* integral to the BHA 170 and configured to detect WOB at or near the BHA 170. The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145.

The top drive 140, the drawworks 130, the crown block 115, the traveling block 120, drilling line or dead line anchor may additionally or alternatively include or otherwise be associated with a WOB or hook load sensor 140*c* (WOB calculated from the hook load sensor that can be based on active and static hook load) (e.g., one or more sensors installed somewhere in the load path mechanisms to detect and calculate WOB, which can vary from rig-to-rig) different from the WOB sensor 170*d*. The WOB sensor 140*c* may be configured to detect a WOB value or range, where such detection may be performed at the top drive 140, the drawworks 130, or other component of the apparatus 100. Generally, the hook load sensor 140*c* detects the load on the hook 135 as it suspends the top drive 140 and the drill string 155.

The detection performed by the sensors described herein may be performed once, continuously, periodically, and/or at random intervals. The detection may be manually triggered by an operator or other person accessing a human-machine interface ("HMI") or GUI, or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the system.

The apparatus 100 also includes the controller 190 configured to control or assist in the control of one or more components of the apparatus 100. For example, the controller 190 may be configured to transmit operational control signals to the drawworks 130, the top drive 140, the BHA 170 and/or the pump 180. The controller 190 may be a stand-alone component installed near the mast 105 and/or other components of the apparatus 100. In an example embodiment, the controller 190 includes one or more systems located in a control room proximate the mast 105, such as the general purpose shelter often referred to as the "doghouse" serving as a combination tool shed, office, communications center, and general meeting place. The controller 190 may be configured to transmit the operational control signals to the drawworks 130, the top drive 140, the BHA 170, and/or the pump 180 via wired or wireless transmission means which, for the sake of clarity, are not depicted in FIG. 1.

Figure 2A:
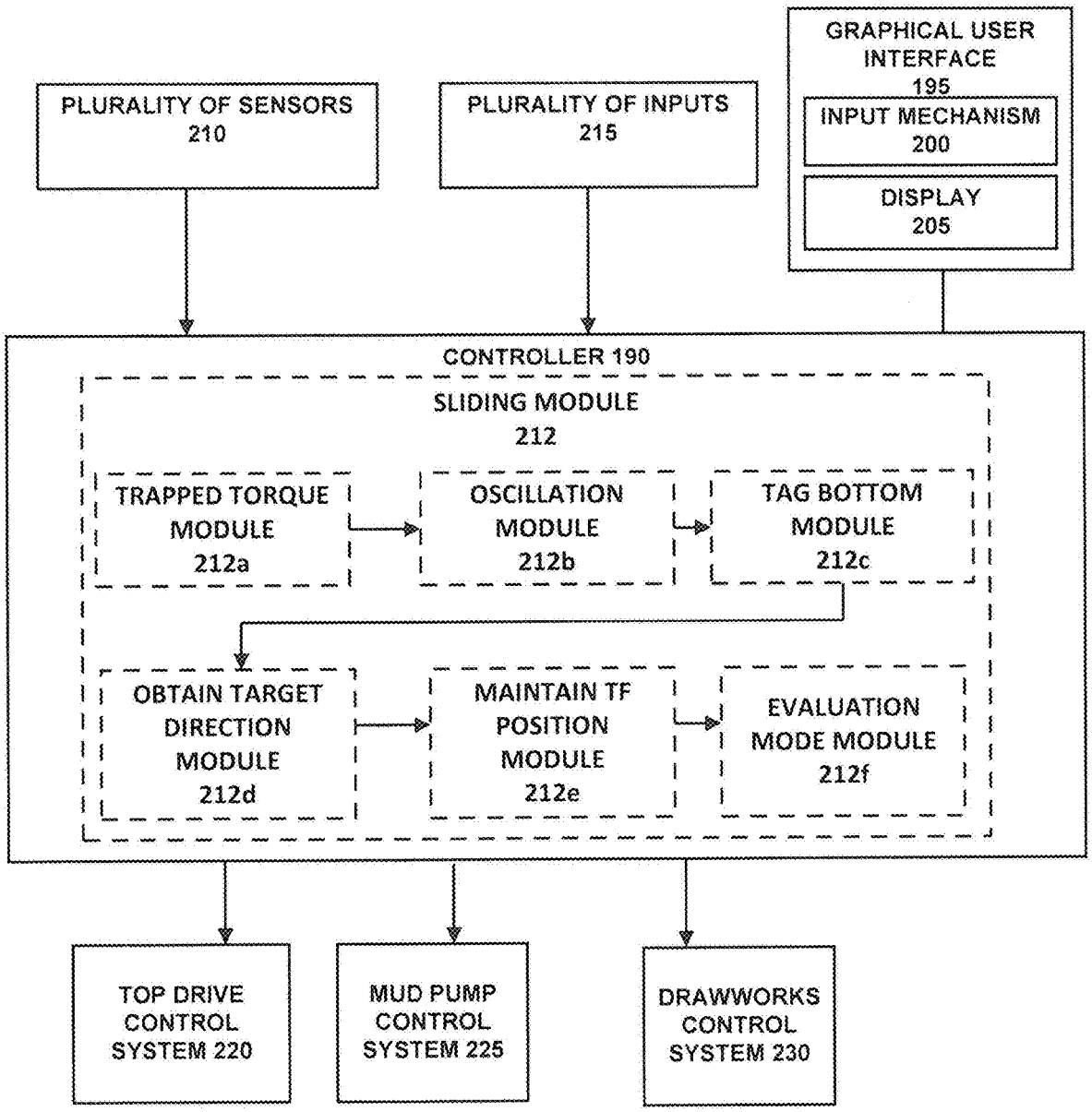
FIG. 2A is another schematic diagram of a portion of the drilling rig apparatus of FIG. 1, according to one or more aspects of the present disclosure, the portion of the drilling rig apparatus including a graphical user interface ("GUI").

FIG. 2A is a diagrammatic illustration of a data flow involving at least a portion of the apparatus 100 according to one embodiment. Generally, the controller 190 is operably coupled to or includes a GUI 195. The GUI 195 includes an input mechanism 200 for user-inputs or task parameters. The input mechanism 200 may include a touch-screen, keypad, voice-recognition apparatus, dial, button, switch, slide selector, toggle, joystick, mouse, data base and/or other conventional or future-developed data input device. Such input mechanism 200 may support data input from local and/or remote locations. Alternatively, or additionally, the input mechanism 200 may include means for user-selection of input parameters, such as predetermined toolface set point values or ranges, such as via one or more drop-down menus, input windows, etc. The task parameters may also or alternatively be selected by the controller 190 via the execution of one or more database look-up procedures. In general, the input mechanism 200 and/or other components within the scope of the present disclosure support operation and/or monitoring from stations on the rig site as well as one or more remote locations with a communications link to the system, network, local area network ("LAN"), wide area network ("WAN"), Internet, satellite-link, and/or radio, among other means. The GUI 195 may also include a display 205 for visually presenting information to the user in textual, graphic, or video form. The display 205 may also be utilized by the user to input the input parameters in conjunction with the input mechanism 200. For example, the input mechanism 200 may be integral to or otherwise communicably coupled with the display 205. The GUI 195 and the controller 190 may be discrete components that are interconnected via wired or wireless means. Alternatively, the GUI 195 and the controller 190 may be integral components of a single system or controller. The controller 190 is configured to receive electronic signals via wired or wireless transmission means (also not shown in FIG. 1) from a plurality of sensors 210 included in the apparatus 100, where each sensor is configured to detect an operational characteristic or parameter. The controller 190 also includes a sliding module 212 to control a drilling operation, such as a sliding operation. The sliding module 212 may include a variety of sub modules, such as a trapped torque module 212*a*, an oscillation module 212*b*, a tag bottom module 212*c*, a obtain target toolface angle module 212*d*, a maintain toolface angle module 212*e*, and an evaluation mode module 212*f*. Generally, each of the modules 212*a*-212*f* is associated with a predetermined workflow or recipe that executes a task from beginning to end. Often, the predetermined workflow includes a set of computer-implemented instructions for executing the task from beginning to end, with the task being one that includes a repeatable sequence of steps that take place to implement the task. The sliding module 212 generally implements the task of completing a sliding operation, which steers the BHA along the planned drilling path. The controller 190 is also configured to: receive a plurality of inputs 215 from a user via the input mechanism 200; and/or look up a plurality of inputs from a database. As shown, the controller 190 is also operably coupled to a top drive control system 220, a mud pump control system 225, and a drawworks control system 230, and is configured to send signals to each of the control systems 220, 225, and 230 to control the operation of the top drive 140, the mud pump 180, and the drawworks 130. However, in other embodiments, the controller 190 includes each of the control systems 220, 225, and 230 and thus sends signals to each of the top drive 140, the mud pump 180, and the drawworks 130.

In some embodiments, the top drive control system 220 includes the top drive 140, the speed sensor 140*b*, the torque sensor 140*a*, and the hook load sensor 140*c*. The top drive control system 220 is not required to include the top drive 140, but instead may include other drive systems, such as a power swivel, a rotary table, a coiled tubing unit, a downhole motor, and/or a conventional rotary rig, among others.

In some embodiments, the mud pump control system 225 includes a mud pump controller and/or other means for controlling the flow rate and/or pressure of the output of the mud pump 180.

In some embodiments, the drawworks control system 230 includes the drawworks controller and/or other means for controlling the feed-out and/or feed-in of the drilling line 125. Such control may include rotational control of the drawworks (in v. out) to control the height or position of the hook 135, and may also include control of the rate the hook 135 ascends or descends. However, example embodiments within the scope of the present disclosure include those in which the drawworks-drill-string-feed-off system may alternatively be a hydraulic ram or rack and pinion type hoisting system rig, where the movement of the drill string 155 up and down is via something other than the drawworks 130. The drill string 155 may also take the form of coiled tubing, in which case the movement of the drill string 155 in and out of the hole is controlled by an injector head which grips and pushes/pulls the tubing in/out of the hole. Nonetheless, such embodiments may still include a version of the drawworks controller, which may still be configured to control feed-out and/or feed-in of the drill string.

Figure 2B:
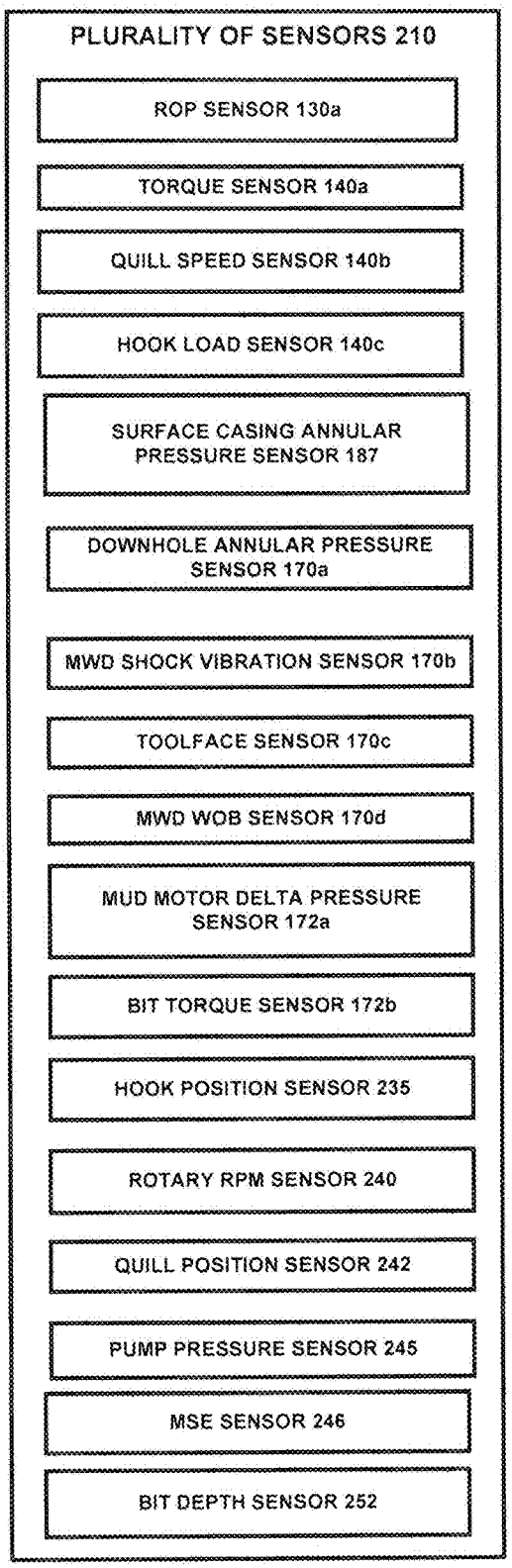
FIG. 2B is a diagrammatic illustration of a plurality of sensors, according to one or more aspects of the present disclosure.

As illustrated in FIG. 2B, the plurality of sensors 210 may include the ROP sensor 130*a*; the torque sensor 140*a*; the quill speed sensor 140*b*; the hook load sensor 140*c*; the surface casing annular pressure sensor 187; the downhole annular pressure sensor 170*a*; the shock/vibration sensor 170*b*; the toolface sensor 170*c*; the MWD WOB sensor 170*d*; the mud motor delta pressure sensor 172*a*; the bit torque sensor 172*b*; the hook position sensor 235; a rotary RPM sensor 240; a quill position sensor 242; a pump pressure sensor 245; a MSE sensor 246; a bit depth sensor 252; and any variation thereof. The data detected by any of the sensors in the plurality of sensors 210 may be sent via electronic signal to the controller 190 via wired or wireless transmission. The functions of the sensors 130*a*, 140*a*, 140*b*, 140*c*, 187, 170*a*, 170*b*, 170*c*, 170*d*, 172*a*, and 172*b* are discussed above and will not be repeated here.

Generally, the hook position sensor 235 is configured to detect the vertical position of the hook 135, the top drive 140, and/or the travelling block 120. The hook position sensor 235 may be coupled to, or be included in, the top drive 140, the drawworks 130, the crown block 115, and/or the traveling block 120 (e.g., one or more sensors installed somewhere in the load path mechanisms to detect and calculate the vertical position of the top drive 140, the travelling block 120, and the hook 135, which can vary from rig-to-rig). The hook position sensor 235 is configured to detect the vertical distance the drill string 155 is raised and lowered, relative to the crown block 115. In some embodiments, the hook position sensor 235 is a drawworks encoder, which may be the ROP sensor 130*a*.

Generally, the rotary RPM sensor 240 is configured to detect the rotary RPM of the drill string 155. This may be measured at the top drive 140 or elsewhere, such as at surface portion of the drill string 155.

Generally, the quill position sensor 242 is configured to detect a value or range of the rotational position of the quill 145, such as relative to true north or another stationary reference.

Generally, the pump pressure sensor 245 is configured to detect the pressure of mud or fluid that powers the BHA 170 at the surface or near the surface.

Generally, the MSE sensor 246 is configured to detect the MSE representing the amount of energy required per unit volume of drilled rock. In some embodiments, the MSE is not directly sensed, but is calculated based on sensed data at the controller 190 or other controller.

Generally, the bit depth sensor 252 detects the depth of the bit 175.

In some embodiments the top drive control system 220 includes the torque sensor 140*a*, the quill position sensor 242, the hook load sensor 140*c*, the pump pressure sensor 245, the MSE sensor 246, and the rotary RPM sensor 240, and a controller and/or other means for controlling the rotational position, speed and direction of the quill or other drill string component coupled to the drive system (such as the quill 145 shown in FIG. 1). The top drive control system 220 is configured to receive a top drive control signal from the sliding module 212, if not also from other components of the apparatus 100. The top drive control signal directs the position (e.g., azimuth), spin direction, spin rate, and/or oscillation of the quill 145.

In some embodiments, the drawworks control system 230 comprises the hook position sensor 235, the ROP sensor 130*a*, and the drawworks controller and/or other means for controlling the length of drilling line 125 to be fed-out and/or fed-in and the speed at which the drilling line 125 is to be fed-out and/or fed-in.

In some embodiments, the mud pump control system 225 comprises the pump pressure sensor 245 and the motor delta pressure sensor 172*a*.

Figure 2C:
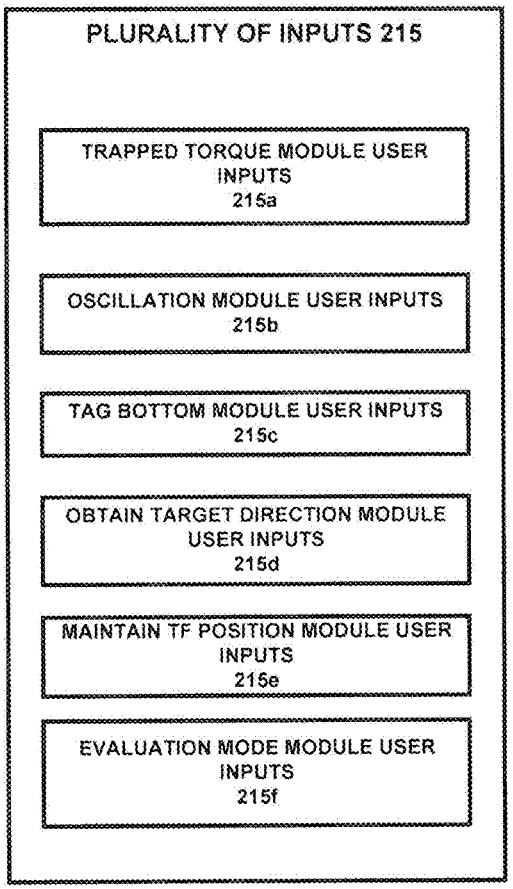
FIG. 2C is a diagrammatic illustration of a plurality of inputs, according to one or more aspects of the present disclosure.

As illustrated in FIG. 2C, the plurality of inputs 215 may include trapped torque module user inputs 215*a* that are user inputs used during the execution of the trapped torque module 212*a*; oscillation module user inputs 215*b* that are user inputs used during the execution of the oscillation module 212*b*; tag bottom module user inputs 215*c* that are user inputs used during the execution of the tag bottom module 212*c*; obtain target direction module user inputs 215*d* that are user inputs used during the execution of the obtain target direction module 212*d*; maintain toolface position module user inputs 215*e* that are user inputs used during the execution of the maintain toolface position module 212*e*; and evaluation mode module user inputs 215*f* that are user inputs used during the execution of the evaluation mode module 212*f*. The plurality of inputs 215 may further include a quill torque positive limit, a quill torque negative limit, a quill speed negative limit, a quill speed positive limit, a quill oscillation positive limit, a quill oscillation negative limit, a quill oscillation neutral point input, a toolface orientation input, a WOB tare, a delta pressure tare, a ROP input, WOB input, a delta pressure input, a pull limit, survey data, planned path, and inputs from any of the plurality of sensors 210.

Figure 3:
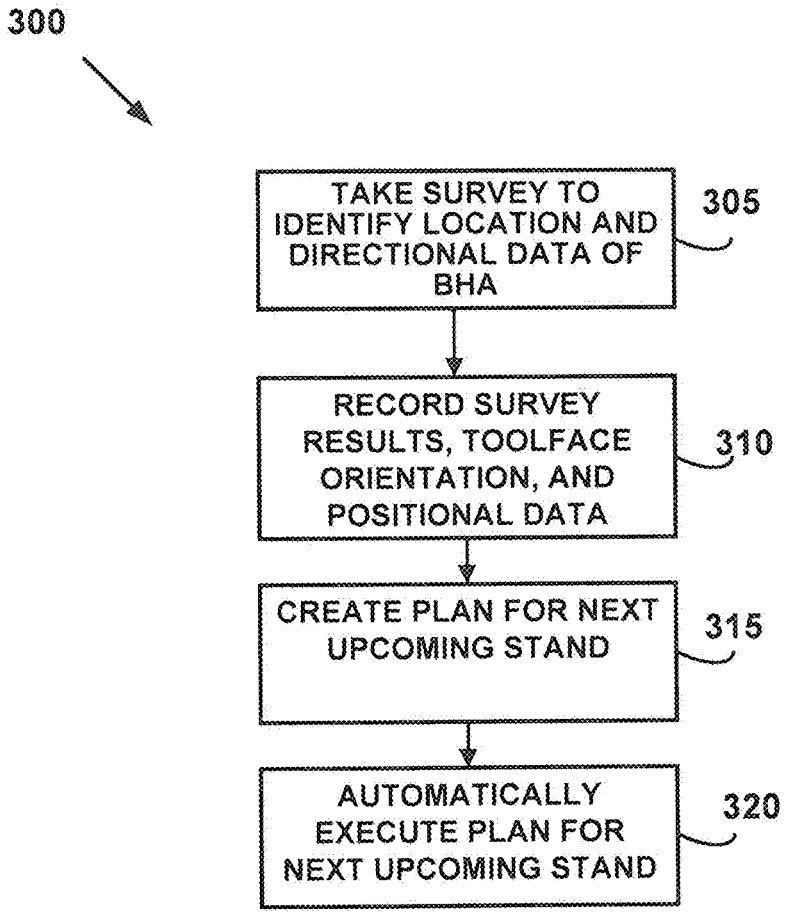
FIG. 3 is a flow-chart diagram of a method according to one or more aspects of the present disclosure.

Referring to FIG. 3, illustrated is a flow-chart diagram of a method 300 of automating the drilling of the wellbore 160, according to one or more aspects of the present disclosure. The method 300 may be performed during operation of the apparatus 100. The method 300 includes a step 305 during which the survey is taken, which identifies locational and directional data of the BHA 170 in the wellbore 160. The survey may be taken at various intervals or other times. Generally, the step 205 involves determining the position of the BHA 170 using the plurality of sensors 210. In a subsequent step 310, the survey results and/or the current toolface orientation and/or positional data is recorded and analyzed. The positional data and/or the current toolface orientation is compared to a desired position and desired, or target toolface orientation. In some instances, the step 310 also includes analyzing the effectiveness of a previous slide. In a subsequent step 315, a plan is created for the next upcoming stand, which is generally two, three, or four sections of pipe coupled together. Creating the plan may include automating the calculation of a target toolface and a slide to distance. In a subsequent step 320, the plan for the stand is executed via automation of the apparatus 100. After the step 320 is performed, the method 300 is iterated and the step 305 is repeated. Such iteration may be substantially immediate, or there may be a delay period before the method 300 is iterated and the step 305 is repeated. The step 310 may also include recording the operating parameters measured in the step 305. The operating parameters recorded during the step 310 may be employed in future calculations to determine a recommended amount of quill rotation to be performed during the step 320, such as may be determined by one or more intelligent adaptive controllers, programmable logic controllers, artificial neural networks, and/or other adaptive and/or "learning" controllers or processing apparatus.

Figure 4:
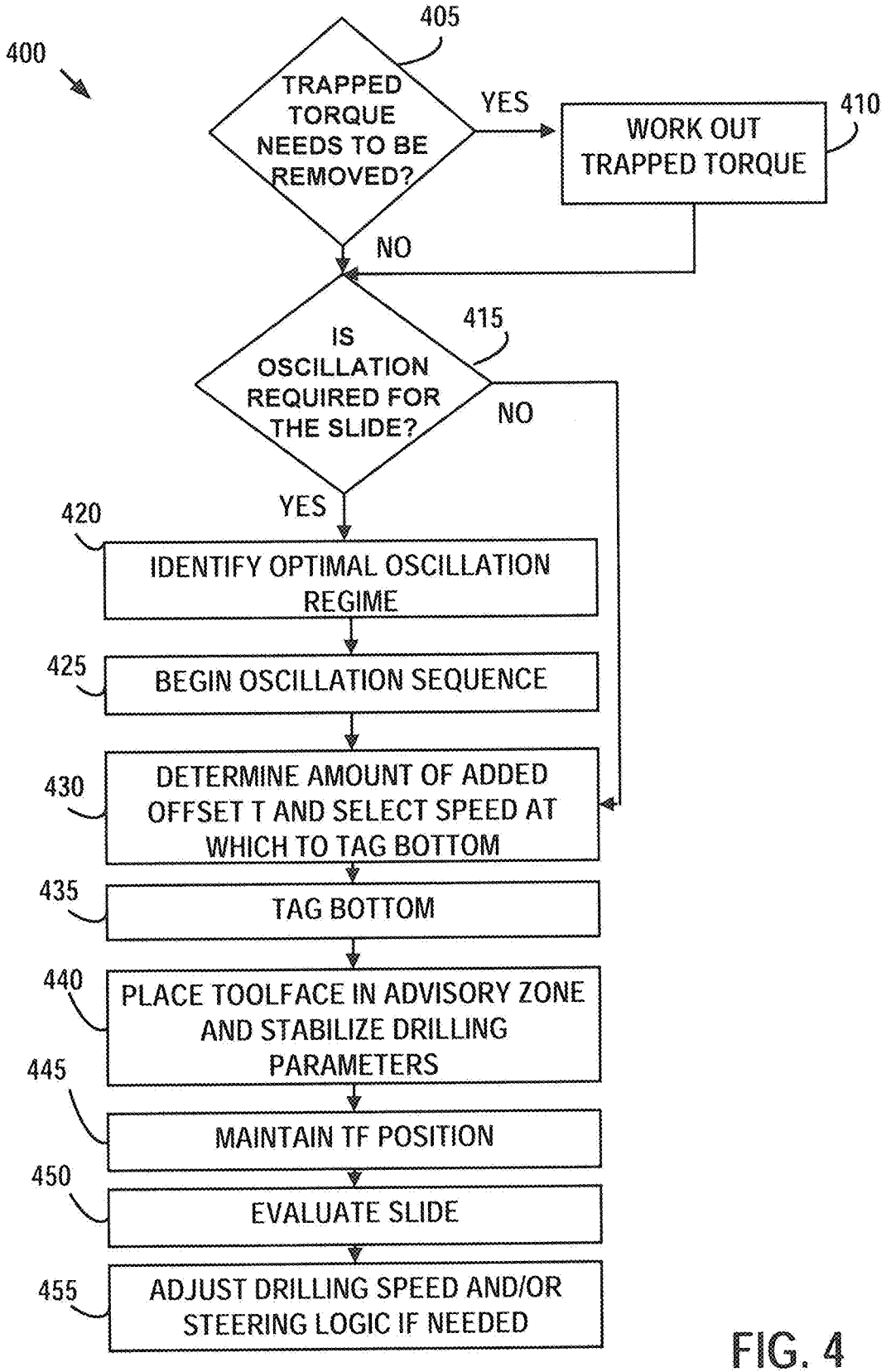
FIG. 4 is another flow-chart diagram of a method according to one or more aspects of the present disclosure.

FIG. 4 is a flow chart diagram of a method, which is generally referred to by the numeral 400, of automatically executing a slide drilling operation using the apparatus 100. The method 400 includes determining whether trapped torque needs to be removed from the drill string 155 at step 405. In some embodiments, the step 405 includes receiving, by the controller 190 and from the torque sensor 140*a* and/or the bit torque sensor 172, data relating to an amount of torque stored in the drill string 155; determining, by the controller 190 and based on the data relating to the amount of torque stored in the drill string 155, an estimated amount of torque stored in the drill string 155; and determining, by the controller 190 and based on the estimated amount of torque stored in the drill string 155, if the torque stored in the drill string should be reduced. Determining if the torque stored in the drill string should be reduced may include comparing the estimated amount of torque to a maximum torque limit, comparing the estimated amount of torque to a user defined maximum torque limit, and/or may be based on whether the drilling operation is in the vertical, curve, or lateral. If it is determined that the trapped torque needs to be removed at the step 405, then the method 400 further includes working out the trapped torque at step 410. If it is determined that the trapped torque does not need to be removed at the step 405, then the method 400 includes determining if oscillation is required for the slide at step 415. Generally, proper oscillation in a curve is required for lateral steering to become and/or remain effective, but some slides, for example in the vertical, will not require oscillation at all. If it is determined that oscillation is required at the step 415, then the method includes identifying an optimal oscillation regime at step 420, and then beginning the oscillation sequence at step 425. The method further includes, after the step 425 or if it is determined that oscillation is not required at the step 415, determining the amount of added offset and select speed at which to tag bottom at step 430. After the step 430, the method further includes tagging bottom at step 435; placing the toolface in an advisory zone and stabilizing drilling parameters at step 440; maintaining toolface position at step 445; evaluating a portion of the slide at step 450; and adjusting the drilling speed and/or steering logic if needed at step 455. In some instances, the apparatus 100 automatically executes the method 400 with little or no driller input. That is, the system 400 automatically executes and completes each, or at least more than one, of the steps 405-455. Thus, when the method 400 is fully automated by the apparatus 100 and when executing a slide performed in the vertical, the apparatus 100 determines that the trapped torque does not need to be removed at the step 405, determines that oscillation is not required for the slide at step 415, and then proceeds to the step 430 and so on. In some embodiments, the apparatus 100 executes the method 400 using predictions based on historical data in place of the inputs 215*a*-215*f* and/or using historical inputs 215*a*-215*f*. Regardless, the apparatus 100 customizes the automatic execution of a slide operation based on the inputs 215*a*-215*f*.

Figure 5:
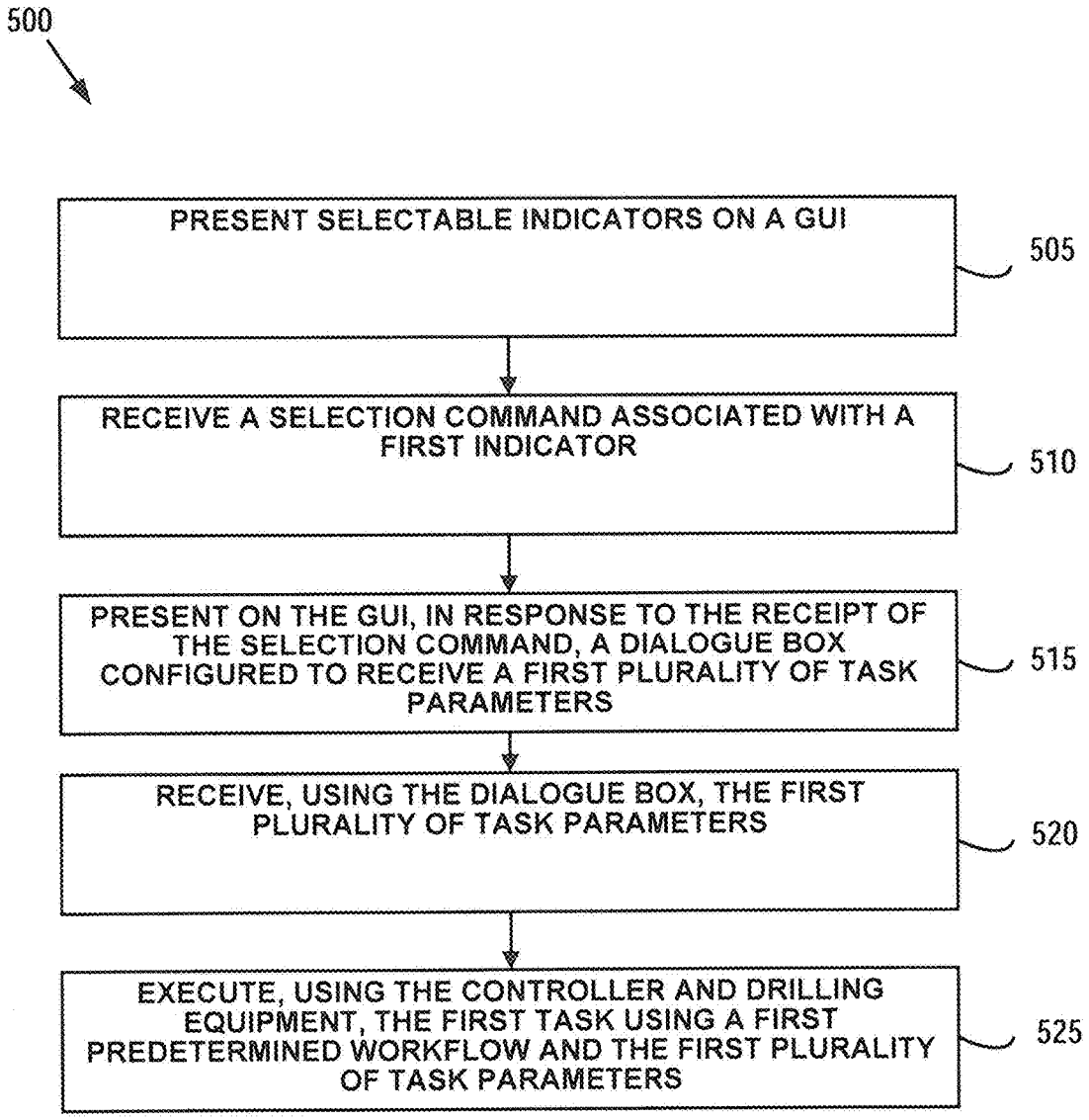
FIG. 5 is yet another flow-chart diagram of a method according to one or more aspects of the present disclosure.

FIG. 5 is a flow chart depicting a method, which is generally referred to by the numeral 500, of automating a sliding operation using any one of the input parameters 215*a*-215*f* provided by a user. Generally, the method 500 includes presenting selectable indicators on the GUI 195 at step 505; receiving a selection command associated with a first indicator at step 510; presenting on the GUI 195, in response to the receipt of the selection command, a dialogue box configured to receive a first plurality of task parameters at step 515; receiving using the dialogue box, the first plurality of task parameters at step 520; and executing, using the controller 190 and drilling equipment, the first task using a predetermined workflow and the first plurality of task parameters at step 525.

Figure 6:
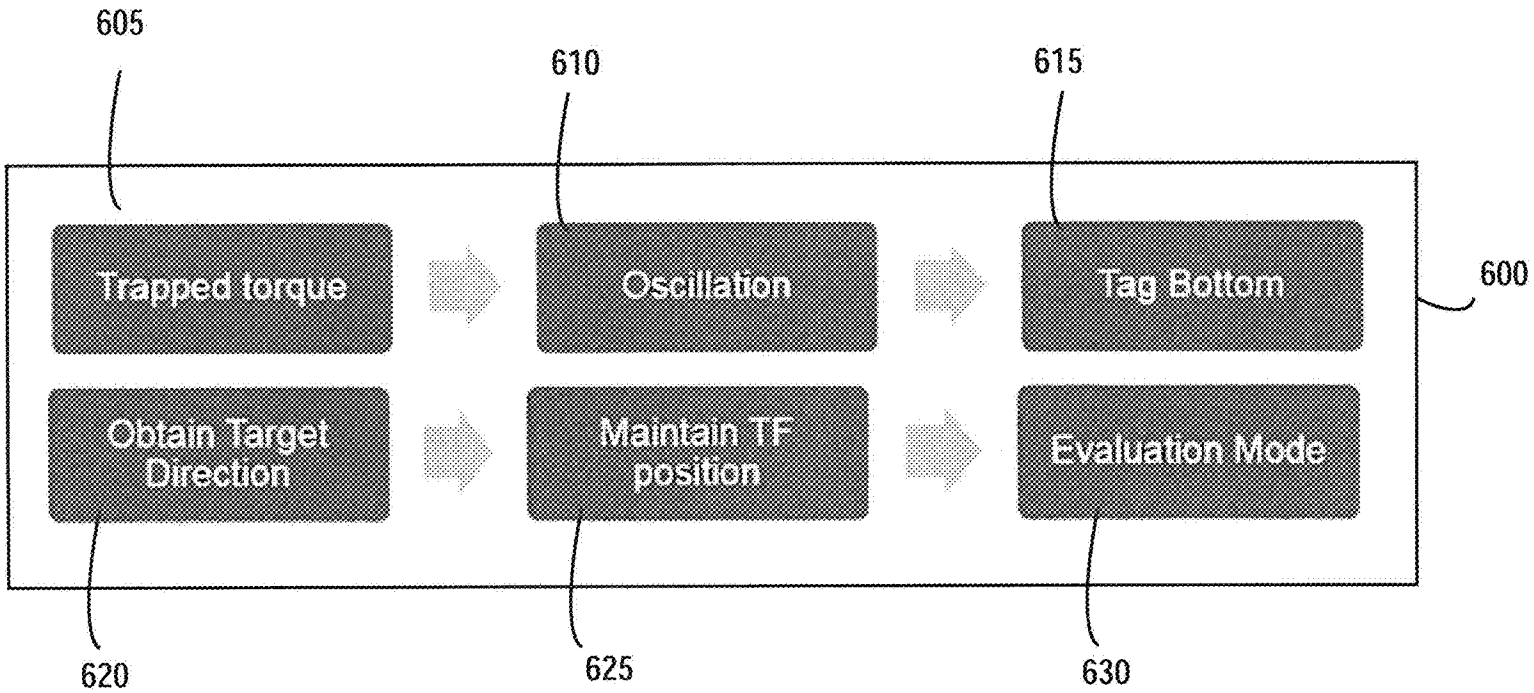
FIG. 6 is an illustration of a dialogue box of the GUI of FIG. 2A, according to one or more aspects of the present disclosure.

At the step 505, selectable indicators are presented on the GUI 195. For example and as illustrated in FIG. 6, the apparatus 100 presents a dialogue box 600 to the driller, via the GUI 195, to allow the driller to provide inputs to the apparatus 100 for use during the method 500. The term "dialogue box" as used in the present disclosure includes a window, a menu, and the like, that appears on the GUI 195 or forms a portion of the GUI 195. The dialogue box 600 includes a "Trapped Torque" button 605, an "Oscillation" button 610, a "Tag Bottom" button 615, a "Obtain Target Direction" button 620, a "Maintain TF Position" button 625, and an "Evaluation Mode" button 630. Each of the buttons 605-630 is a selectable indicator and is associated with a task. For example, the Trapped Torque button 605 corresponds with the Trapped Torque module 212*a*, the step 410, and/or the task of removing trapped torque from the drill string 155; the Oscillation button 610 corresponds with the Oscillation module 212*b*, the steps 420 and 425, and/or the task of oscillating the drill string 155; the Tag Bottom button 615 corresponds with the Tag Bottom module 212*c*, the steps 430 and 435, and/or the task of tagging bottom; the Obtain Target Direction button 620 corresponds with the Obtain Target Direction module 212*d*, the step 440, and/or the task of obtaining a target direction; the Maintain TF Position button 425 corresponds with the Maintain TF Position module 212*e*, the step 445, and/or the task of maintaining toolface position; and the Evaluation Mode button 630 corresponds with the Evaluation Mode module 212*f*, the steps 450 and 455, and/or the task of evaluating a sliding operation.

Referring back to FIG. 5 and at the step 510, a selection command associated with one of the buttons 605-630 is received. Receiving the selection command is in response to the user selecting one of the buttons 605-630.

At the step 515, in response to the receipt of the selection command, a dialogue box configured to receive a first plurality of task parameters is presented on the GUI 195.

At the step 520, the first plurality of task parameters is received using the dialogue box.

At the step 525, the first task associated with the selected button is executed using the first plurality of task parameters, the controller, and the drilling equipment.

In some instances, there are different methods of implementing the task associated with one of the buttons 605-630. For example, the trapped torque module 212*a* includes two sub modules. Often, when trapped torque is not worked out of the drill string 155, it can cause the toolface to move in unexpected and unpredictable ways, which increases the difficulty of applying a standard procedure or workflow for executing a slide. Generally, the majority of the trapped torque can be reliably reduced or removed by "working" the drill string up and down with the top drive brake off, or by removing wraps (turning the pipe left) a user defined number of turns before sliding. Thus, there are generally two methods of removing trapped torque in the drill string 155 from which a user can choose during the methods 400 and/or 500. The first is removing trapped torque using a "work pipe" module and the second is removing trapped torque using a "remove wraps" module.

Figure 7A:
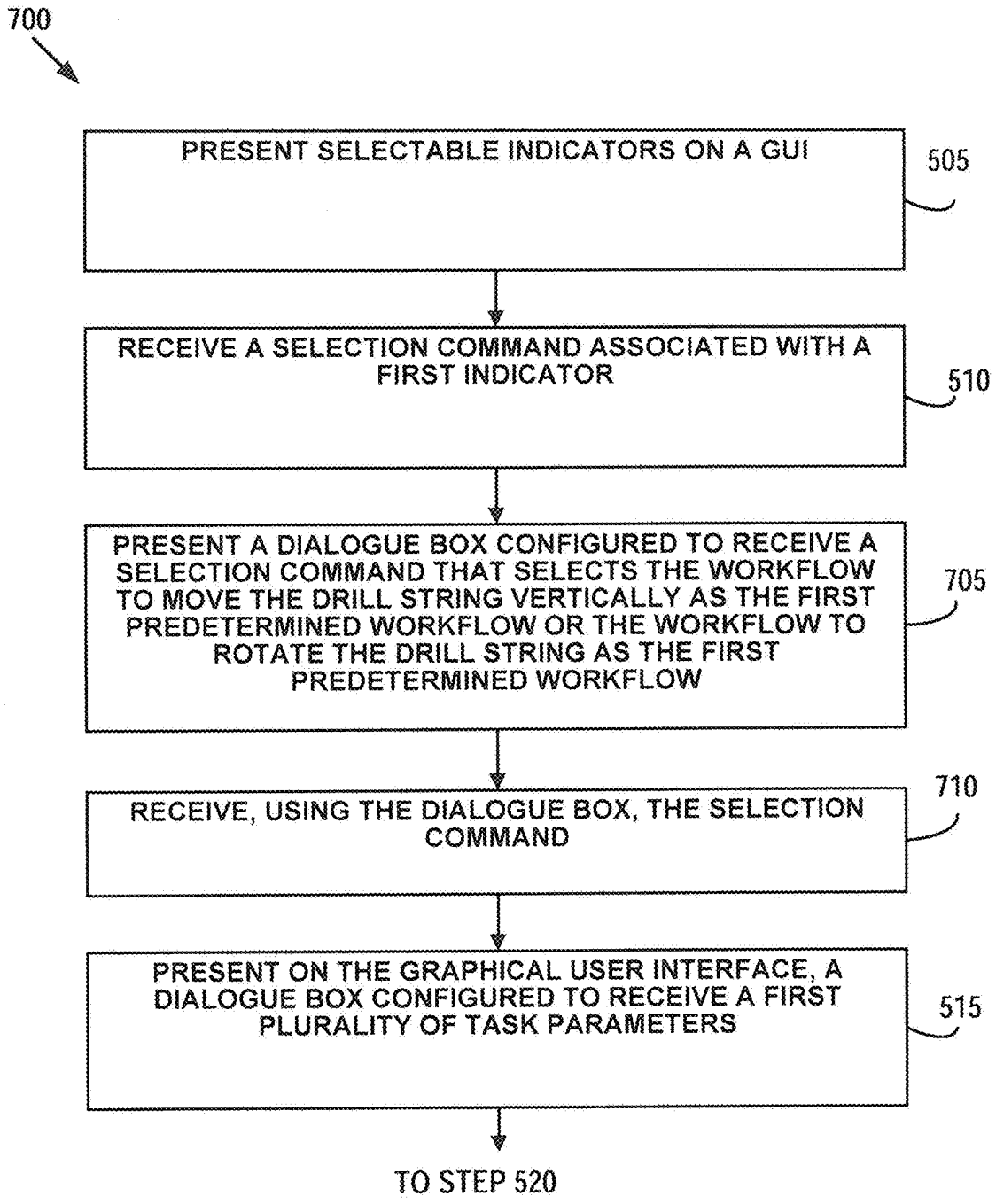
FIGS. 7A and 7B together form flow-chart diagram of a method according to one or more aspects of the present disclosure.
Figure 7B:
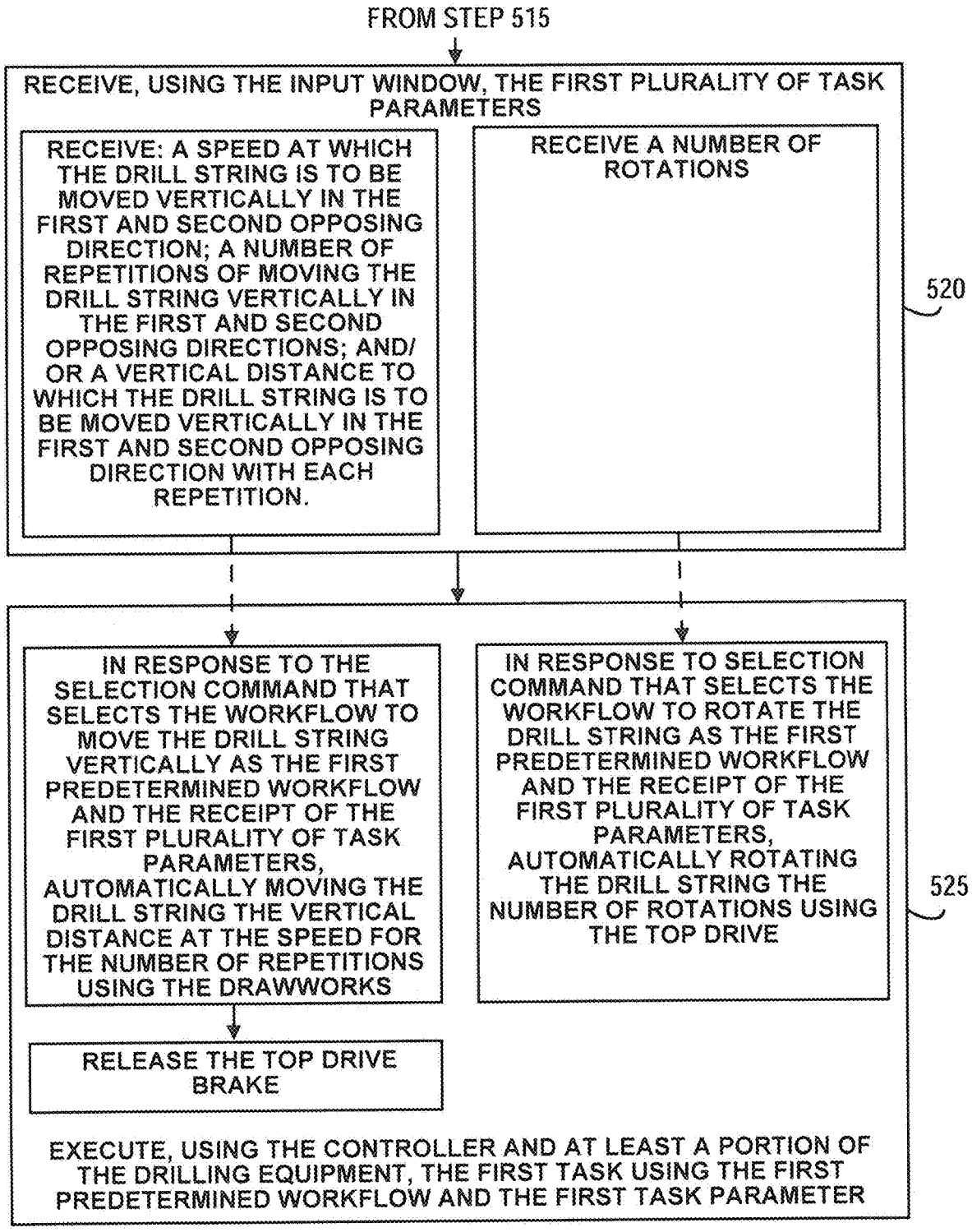

FIGS. 7A and 7B together form a flow chart depicting a method, which is generally referred to by the numeral 700, of automating the task of removing or reducing trapped torque from the drill string 155 using input parameters such as the input parameters 215*a*. Generally, the method 700 is an embodiment of the method 500, and includes: the step 505; the step 510; presenting a dialogue box configured to receive a selection command that selects a workflow to move the drill string vertically as the first predetermined workflow or the workflow to rotate the drill string 15 as the first predetermined workflow at step 705; receiving, using the dialogue box, the selection command at step 710; the step 515; the step 520; and the step 525. Details relating to steps in the method 700 that are identical to steps in the method 500, such as the step 505, will not be repeated here.

At the step 510, the selection command received is associated with the selectable button 605, which is associated with the trapped torque task and the trapped torque module 212*a*.

Figure 8:
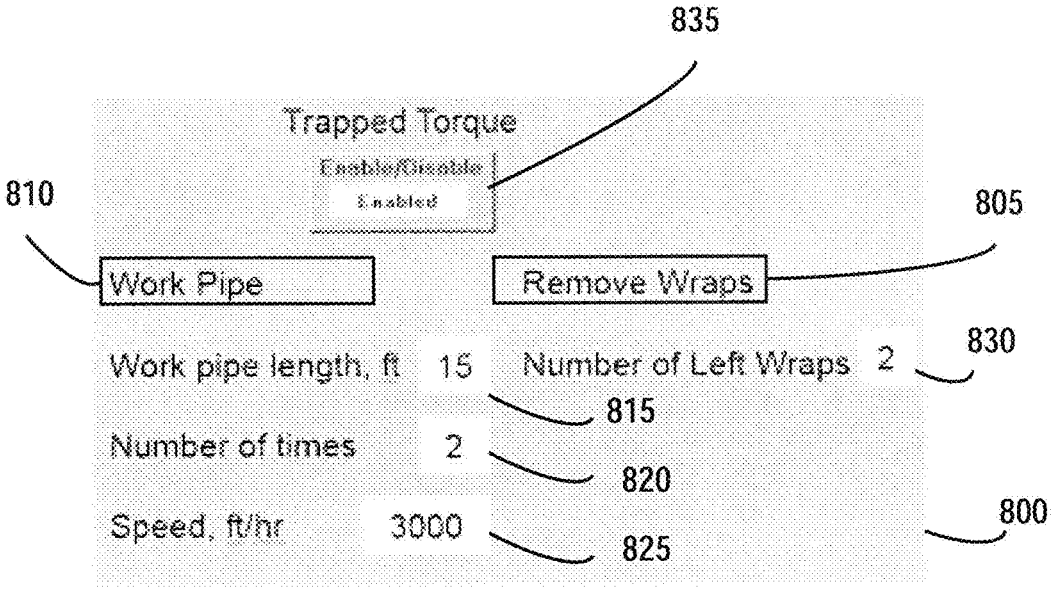
FIG. 8 is an illustration of a dialogue box of the GUI of FIG. 2A during the method of FIGS. 7A and 7B, according to one or more aspects of the present disclosure.

At the step 705, another dialogue box is presented in the GUI 195. The dialogue box presented during the step 705 is configured to receive a selection command that selects a specific method of implementing the task of removing trapped torque from the drill string 155. For example, and as illustrated in FIG. 8, a dialogue box 800 is presented on the GUI 195 in response to the button 605 being selected by the user. The dialogue box 800 includes a button 805 associated with a workflow of "remove wraps" and a button 810 associated with a workflow of "work pipe." Each of the workflows "remove wraps" and "work pipe" is a method of implementing the task of removing trapped torque. Additionally, the dialogue box 800 includes input windows 815, 820, 825, and 830. The input window 815 receives an input parameter that is a vertical distance in which the drill string 155 is to be moved vertically in the first and second opposing direction with each repetition, the window 820 receives an input parameter that is a number of repetitions of moving the drill string 155 vertically in the first and second opposing direction; the window 825 receives an input parameter that is a speed at which the drill string 155 is to be moved vertically in the first and second opposing directions; and the input window 830 receives an input parameter that is a number of rotations of the drill string 155 that is performed at the surface of the well and that are in the left or counterclockwise direction. In some instances, the dialogue box 800 includes an enable/disable indicator 835 that is selectable by the user to enable or disable the automation of the task of removing trapped torque using the apparatus 100. When the enable indicator 825 is selected, the apparatus 100 executes the trapped torque module 212*a* using the user inputs 215*a*. When the disable indicator 825 is selected, the apparatus 100 does not implement the trapped torque module 212*a* and it is determined whether the next module, such as the oscillation module 212*b*, is to be executed. In some embodiments, and when the module 212 determines whether the trapped torque needs to be reduced, the presentation of the window 800 is in response to the determination that the trapped torque needs to be reduced.

At the step 710, the selection command is received. For example, the selection command is received when the user selects one of the buttons 805 and 810. Selecting one of the buttons 805 and 810 selects one of the "remove wraps" workflow and the "work pipe" workflow to be implemented by the apparatus 100.

At the step 515, the input windows 805-835 are presented on the GUI 195. While the step 515 is illustrated as a separate step from the step 705, the steps 705 and 715 may occur simultaneously and involve one dialogue box, as illustrated by the dialogue box 800 of FIG. 8. That is, one dialogue box may be presented on the GUI 195, with the one dialogue box being configured to both receive the selection command that selects the either the "remove wraps" workflow or the "work pipe" workflow and the one of more of the trapped torque module user inputs 215*a*, which are the inputs received via the windows 815-830.

Figure 9:
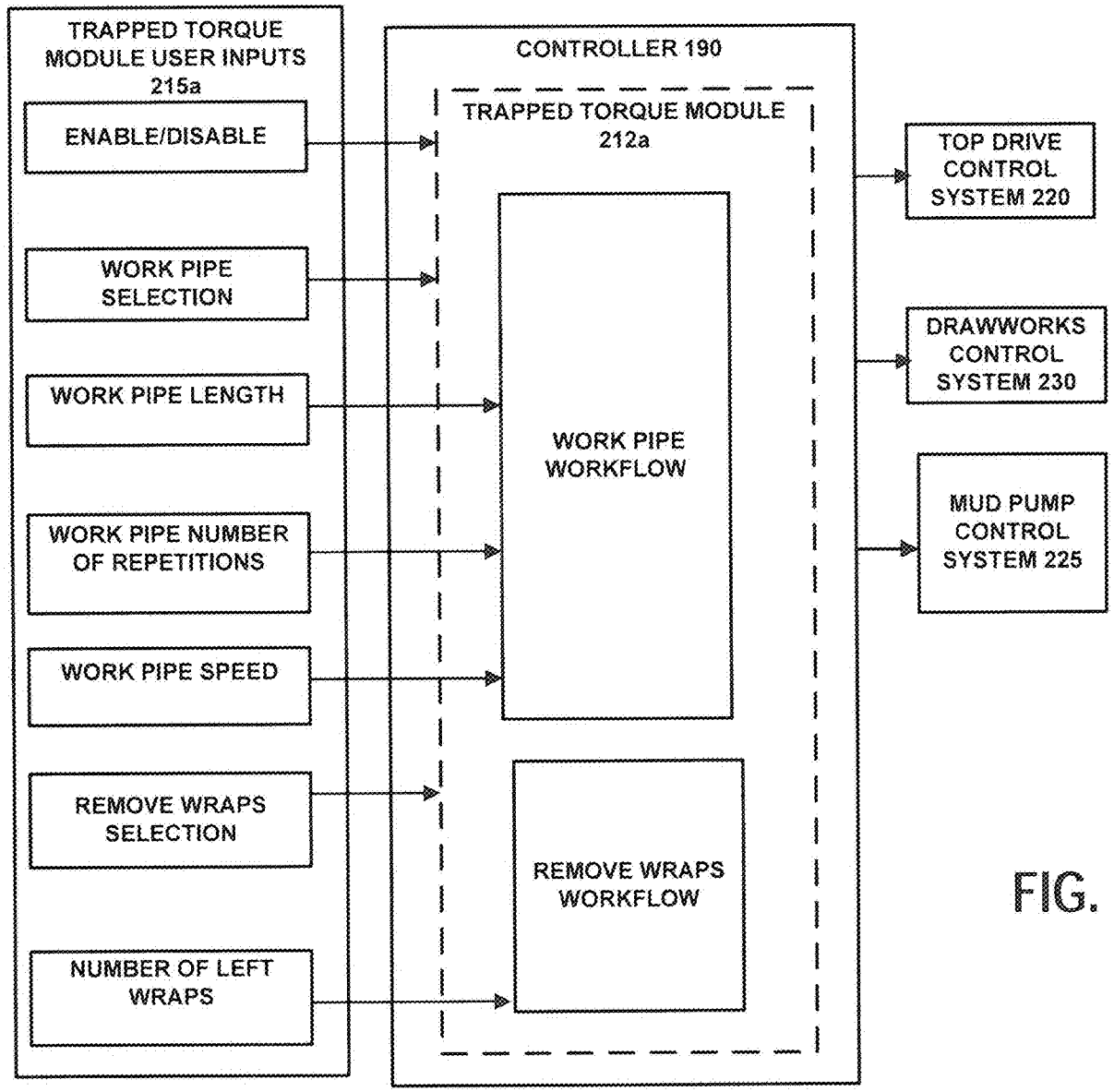
FIG. 9 is a data flow and diagrammatic illustration of the apparatus of FIG. 1 during the method of FIGS. 7A and 7B, according to one or more aspects of the present disclosure FIGS. 10A and 10B together form flow-chart diagram of a method according to one or more aspects of the present disclosure.

At the step 520 and referring back to FIGS. 7A and 7B, the apparatus 100 receives, via one or more of the input windows 815-830, one of more of the trapped torque module user inputs 215*a*. FIG. 9 illustrates data flow and a portion of the apparatus 100 during the method 700. As illustrated, the trapped torque module user inputs 215*a* may include an enable/disable selection parameter received via the window 835 that enables or disables the trapped torque module 212*a*; a work pipe selection input parameter that selects the work pipe sub-module as the desired module via the window 810; a work pipe length input parameter that is received via the window 815 that is a vertical distance to move the drill string 155; a work pipe number of repetitions input parameter that is received via the window 820; a work pipe speed that is received via the window 825; a remove wraps selection input parameter that selects the remove wraps sub-module as the desired module via the window 805; and a number of left wraps that is received via the window 830.

At the step 525 during the method 700—and in response to the receipt of the selection command that selects the work pipe workflow and the inputs via the windows 815-825—the apparatus 100 automatically moves the drill string 155 by the vertical distance at the work pipe speed for the number of repetitions using the drawworks. Moreover, the trapped torque workflow 212*a* and thus the step 525 of the method 700 may also include releasing the top drive brake when the "work pipe" selectable indicator has been selected. Specifically, the trapped torque workflow 212*a* automatically sets the top drive brake to off or lowers the top drive torque in stages to allow torque to be released and works the drill pipe at the user defined speed up and down for the user defined number of times and length. In some embodiments, and during the step 525, the trapped torque workflow 212*a* stops the drilling operation if overpull/bridge protection limits set by the user are reached. The trapped torque workflow 212*a* also ensures that the work pipe length input parameter is not a distance that exceeds the crown saver, or controls the drawworks control system 230 such that the top drive 140 and/or the travelling block 120 is not lifted within a predetermined distance from the crown block 115. For example, the module 212*a* receives data from the hook position sensor 235 and determines the height of the travelling block 120 relative to the crown block 115 to ensure that the travelling block 120 is adequately spaced from the crown block 115 during the "work pipe" workflow. Thus, the trapped torque workflow 212*a* monitors the position of the travelling block relative to the crown block 120. In some embodiments, the trapped torque workflow 212*a* also monitors the position of the BHA 170 relative to a toe, or bottom, of the wellbore 160 to prevent the BHA 170 from to tagging bottom of the wellbore 160 during the "work pipe" workflow. In some embodiments, the trapped torque workflow 212*a* ensures that the BHA does not extend within 3 feet or 0.9 meters of the bottom of the wellbore 160. Generally, the maximum work pipe length input parameter has a maximum input value of 50 ft. or 15.2 meters. The trapped torque workflow 212*a* ensures that the work pipe speed does not exceed 5,000 ft./hr. or 1,524 m./hr., or controls the drawworks control system 230 such that the speed does not exceed 5,000 ft./hr. or 1,524 m./hr. or other predetermined safety limits. At the step 525 during the method 700—and in response to the receipt of the selection command that selects the remove wraps workflow and the input via the window 830—the apparatus 100 automatically rotates the drill string 155 the number of rotations using the top drive 140. The number of rotations is a drill string rotation parameter, which is not limited to a number of rotations of the drill string, but may also include a predetermined torque measurement within the drill string 155. Generally, the controller 190 controls or otherwise directs the top drive control system 220 and the drawworks control system 230 to implement the instructions stored within the trapped torque workflow during the step 525.

After the step 525 of the method 700, the apparatus 100 automatically begins to execute the oscillation module 212*b* or automatically presents the dialogue box 600 to the user.

Figure 10A:
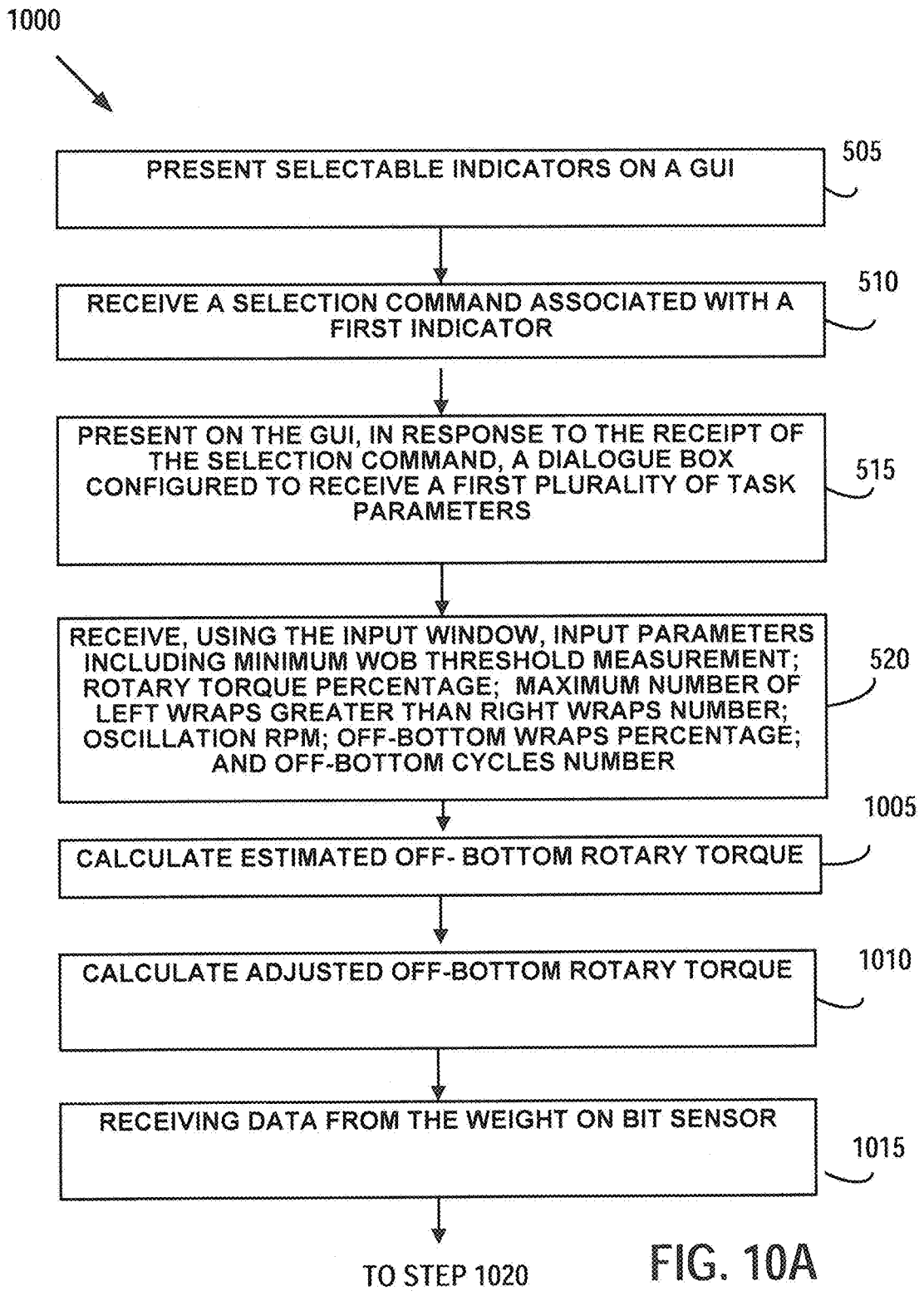
Figure 10B:
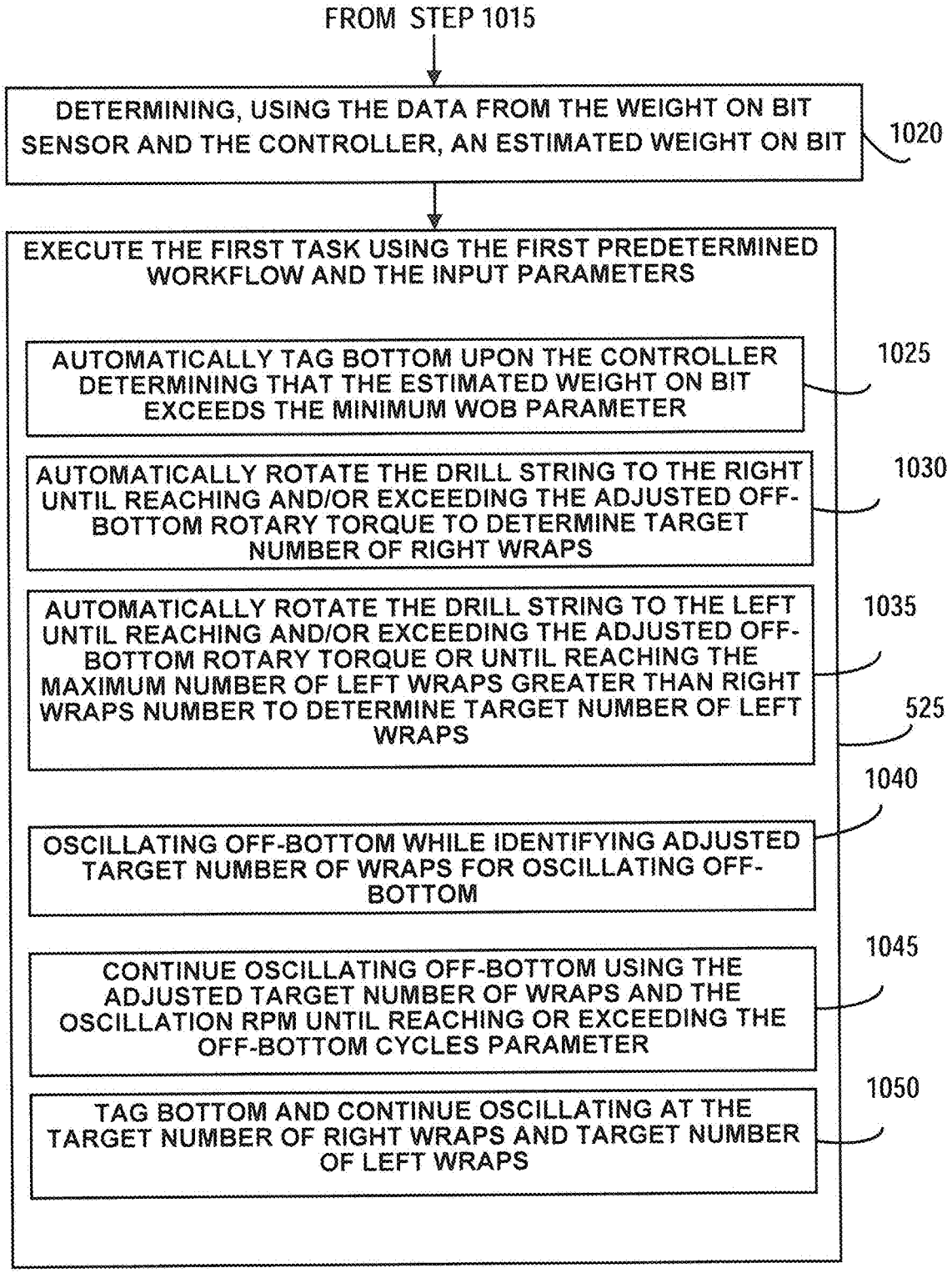

FIGS. 10A and 10B illustrate a method, generally referred to by the numeral 1000, of automatically executing instructions relating to the task of oscillating the drill string 155 during the slide drilling operation. Generally, the method 1000 is an embodiment of the method 500, and includes: the steps 505-520; determining an actual off-bottom rotary torque at step 1005; calculating an adjusted off-bottom rotary torque at step 1010; receiving data from the WOB sensor 170*d* at step 1015; determining, using the data from the WOB sensor 170*d* and the controller 190, an actual WOB at step 1020; and the step 525. Details relating to steps in the method 1000 that are identical to steps in the method 500, such as the step 505, will not be repeated here.

At the step 510, the selection command is associated with the button 610.

Figure 11:
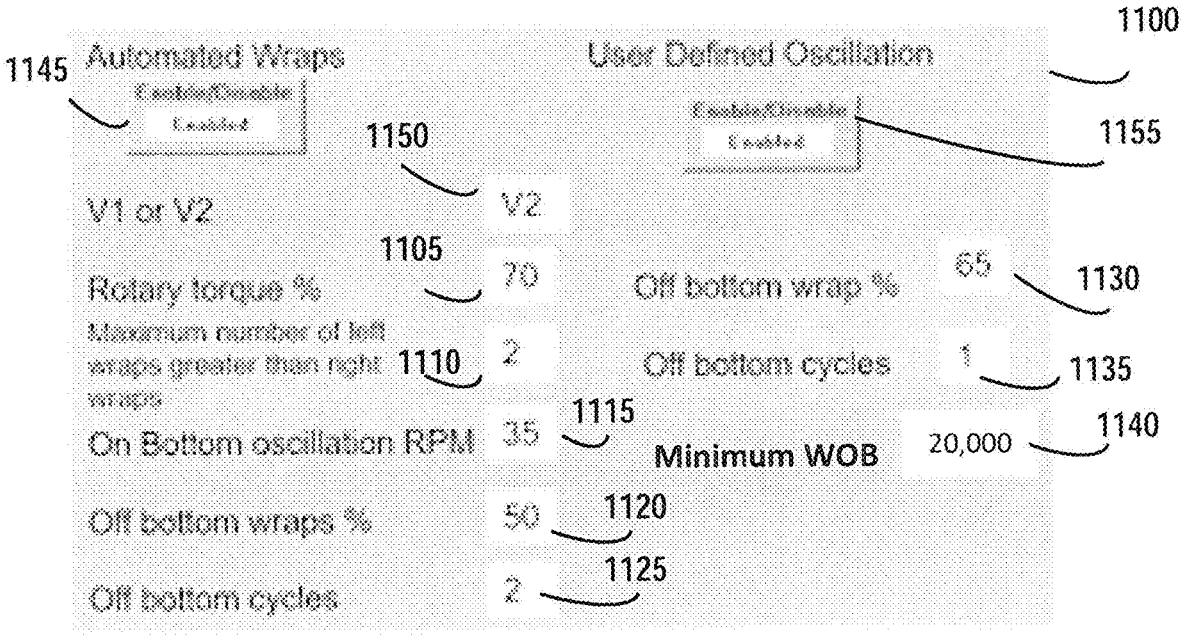
FIG. 11 is an illustration of a dialogue box of the GUI of FIG. 2A during the method of FIGS. 10A and 10B, according to one or more aspects of the present disclosure.

At the step 515 of the method 1000, a dialogue box generally referred to by the numeral 1100 in FIG. 11 is presented. As seen in FIG. 11, the dialogue box 1100 includes the following input windows: a rotary torque % input window 1105, a maximum number of left wraps greater than right wraps input window 1110, an on-bottom oscillation RPM input window 1115, an off-bottom wraps % input window 1120, an off-bottom cycles input window 1125, an off-bottom wrap % input window 1130, an off-bottom cycle input window 1135, a minimum WOB input window 1140; an "automated wraps" workflow enable/disable button 1145; a V1 or V2 selector input window 1150; and an "user defined oscillation" workflow enable/disable button 1155. Each of the "automated wraps" workflow and "user defined oscillation" workflow is a method of implementing the task of oscillating the drill string 155.

Figure 12:
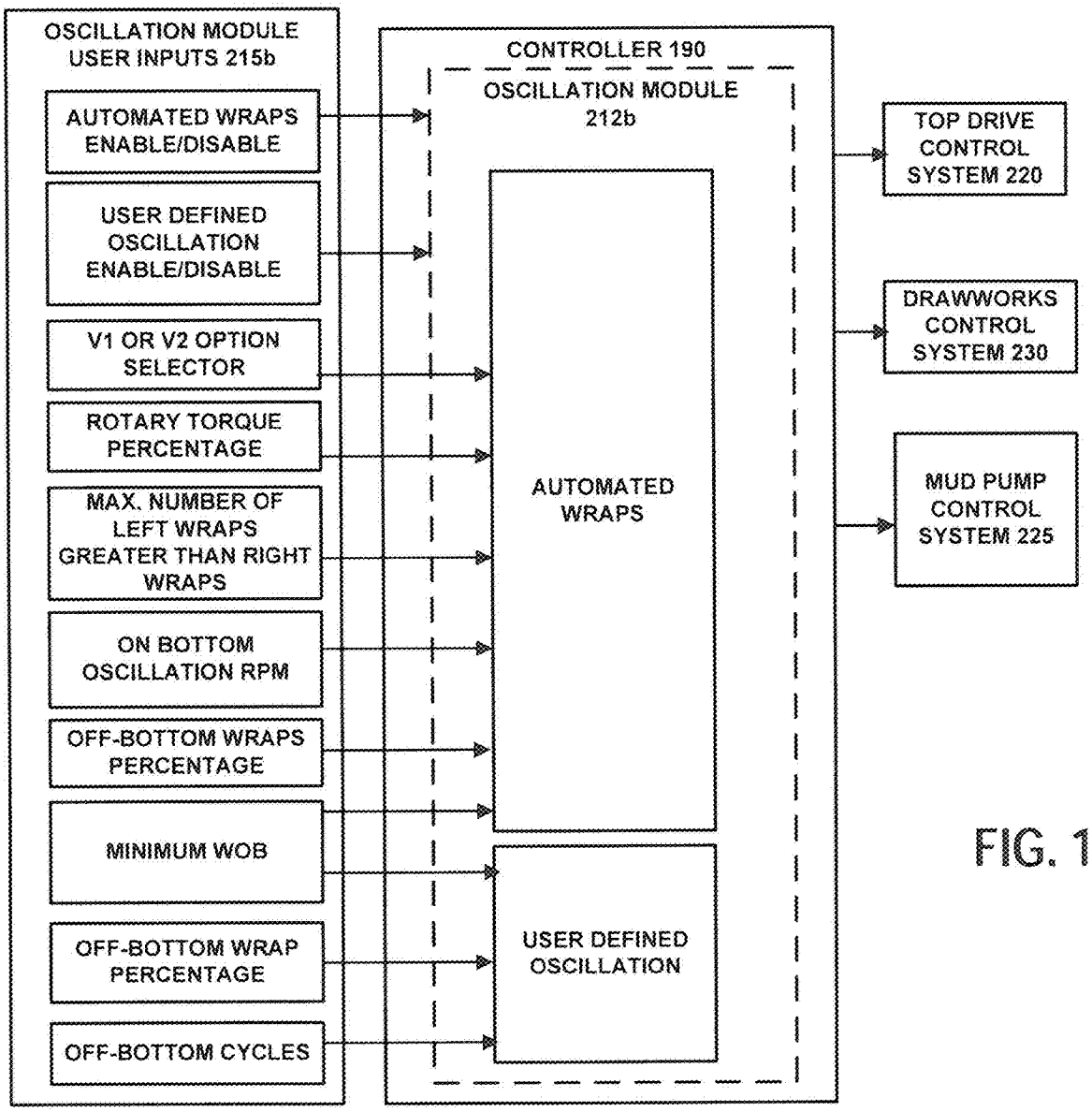
FIG. 12 is a data flow and diagrammatic illustration of the apparatus of FIG. 1 during the method of FIGS. 10A and 10B, according to one or more aspects of the present disclosure.

At the step 520 of the method 1000, the oscillation module 212*b* receives, using the input windows 1105-1140, one or more of the input parameters 215*b*. FIG. 12 illustrates data flow and a portion of the apparatus 100 during the method 1000. As illustrated, the oscillation module user inputs 215*b* may include the following input parameters: an automated wraps enable/disable command received via the button 1145; a user defined oscillation enable/disable command received via the button 1155; a V1 or V2 option selector via the window 1150; a rotary torque percentage received via the window 1105; a maximum number of left wraps greater than right wraps received via the window 1110; an on-bottom oscillation RPM received via the window 1115; an off-bottom wraps percentage received via the window 1120; an off-bottom cycles received via the window 1125; an off-bottom wrap percentage received via the window 1130; an off-bottom cycles received via the window 1135; and a minimum WOB received via the window 1140. When the automated wraps workflow is selected via the enable/disable button 1145, the method includes the steps 1005-1020 and sub-steps of 1025-1050, as described below.

At the step 1005, an estimated off-bottom rotary torque is calculated by the module 212*b*. In some instances, the off-bottom rotary torque is calculated by the controller 190 after the controller 190 receives data from the bit torque sensor 172*b* or other sensor. Generally, the estimated off-bottom rotary torque is used by the apparatus 100 to estimate the ideal number of wraps to rotate the drill string 155 during auto-oscillation of the drill string 155. Generally, the estimated off-bottom rotating torque is determined when the mud pump 180 is on and the drill string 155 is at full rotation, which generally corresponds to when the apparatus 100 zeros the WOB/DP before tagging bottom for a rotary period. Thus, when the WOB/DP has been zeroed and before the BHA 170 tags the bottom of the wellbore 160, the apparatus 100 calculates the estimated off-bottom rotary torque. After multiple estimated off-bottom rotary torques have been calculated, the apparatus 100 calculates an average off-bottom rotating torque. The estimated off-bottom rotary torque value or average estimated off-bottom rotary torque value is stored in the controller 190 to be used as an estimation of wraps required.

At the step 1010, the module 212*b* calculates an adjusted off-bottom rotary torque by multiplying the average estimated off-bottom rotating torque by the rotary torque percentage input parameter received via the window 1105. The average estimated off-bottom torque is generally the torque required to rotate the entire drill string 155 and BHA. However, the ideal amount of oscillating wraps is the number of wraps it takes to reach a percentage of this average off-bottom rotating torque. Thus, the ideal amount of oscillating wraps is the average estimated off-bottom torque multiplied by the rotary torque percentage input parameter.

At the step 1015, the module 212*b* receives data from the WOB sensor 170*b*.

At the step 1020, the module 212*b* determines an estimated WOB using the data from the WOB sensor 170*b*.

The step 525 of the method 1000 includes automatically tagging bottom upon the controller 190 determining that the estimated WOB exceeds the minimum WOB parameter at step 1025; automatically rotating the drill string 155 to the right until reaching and/or exceeding the adjusted off-bottom rotary torque to determine target number of right wraps at step 1030; automatically rotating the drill string 155 to the left until reaching and/or exceeding the adjusted off-bottom rotary torque or until reaching the maximum number of left wraps greater than right wraps number to determined target number of left wraps at step 1035; oscillating off-bottom while identifying the adjusted target number of wraps for oscillating off-bottom at step 1040; oscillating off-bottom using the adjusted target number of wraps and the oscillation RPM until reaching or exceeding the off-bottom cycles parameter at step 1045; and tagging bottom and continuing to oscillate the drill string 155 at the target number of right wraps and target number of left wraps at step 1050.

At the step 1025, the module 212*b* controls the apparatus 100 to automatically tag bottom of the wellbore 160 using the BHA 170 upon the controller 190 determining that the estimated WOB exceeds the minimum WOB parameter entered via the input window 1135. A certain amount of WOB is often required before oscillation the drill string 155 to avoid moving the BHA 170.

At the step 1030, the apparatus 100 automatically rotates the drill string 155 to the right until reaching and/or exceeding the adjusted off-bottom rotary torque to determine a target number of right wraps. In some instances, the drill string 155 is turned right at 20 rpms until the adjusted off-bottom rotary torque is detected and the apparatus 100 records that number of right turns required to reach the adjusted off-bottom rotary torque. The apparatus 100 then records that value as the right oscillation wraps to be used once the BHA 170 tags bottom to begin the sliding operation. After reaching and/or exceeding the adjusted off-bottom rotary torque, the system immediately begins rotating to the drill string 155 to left at 20 rpms.

At the step 1035, the apparatus 100 automatically rotates the drill string 155 to the left until reaching and/or exceeding the adjusted off-bottom rotary torque, or until reaching the maximum number of left wraps greater than the right wraps parameter received via the window 1110. The apparatus 100 records that number of left turns required to reach the adjusted off-bottom rotary torque.

At the step 1040, the apparatus 100 oscillates the drill string 155 off-bottom while the apparatus 100 identifies an adjusted target number of wraps for oscillating off-bottom by multiplying the target number of left wraps and the target number of right wraps by the off-bottom wraps percentage parameter received via the window 1120. At the step 1040, the apparatus 100 continues to oscillate the drill string 155 using the adjusted target number of wraps and the oscillation RPM received via the window 1115.

At the step 1045, the apparatus 100 continues oscillating the drill string 155 using the adjusted target number of wraps and the oscillation rpm received via the window 1115 until reaching or exceeding the off-bottom cycles parameter received via the window 1125.

At the step 1050, the apparatus 100 lowers the BHA 170 to tag the bottom of the wellbore 160 and continues to oscillate the drill string 155 at the target number of right wraps and the target number of left wraps.

When the user defined oscillation workflow is selected via the enable/disable button 1155 at the step 520, the step 525 includes the apparatus 100 starting oscillation of the drill string 155 using the off-bottom wrap percentage input received via the window 1130 for the number of cycles parameter received via the window 1135 before starting the tag bottom module 212*c*, during which the drill string 155 should be oscillated using a full user defined wrap parameter.

During the method 1000, input parameters relating to the oscillation regime, such as the oscillation module input parameters 215*b*, are input by the user thereby giving the apparatus 100 the ability to identify the optimal amount of wraps and begin oscillating before tagging bottom or execute the oscillation regime selected by the user.

After the step 525 of the method 1000, the apparatus 100 automatically begins to execute the oscillation module 212*c* or automatically presents the dialogue box 600 to the user.

Figure 13A:
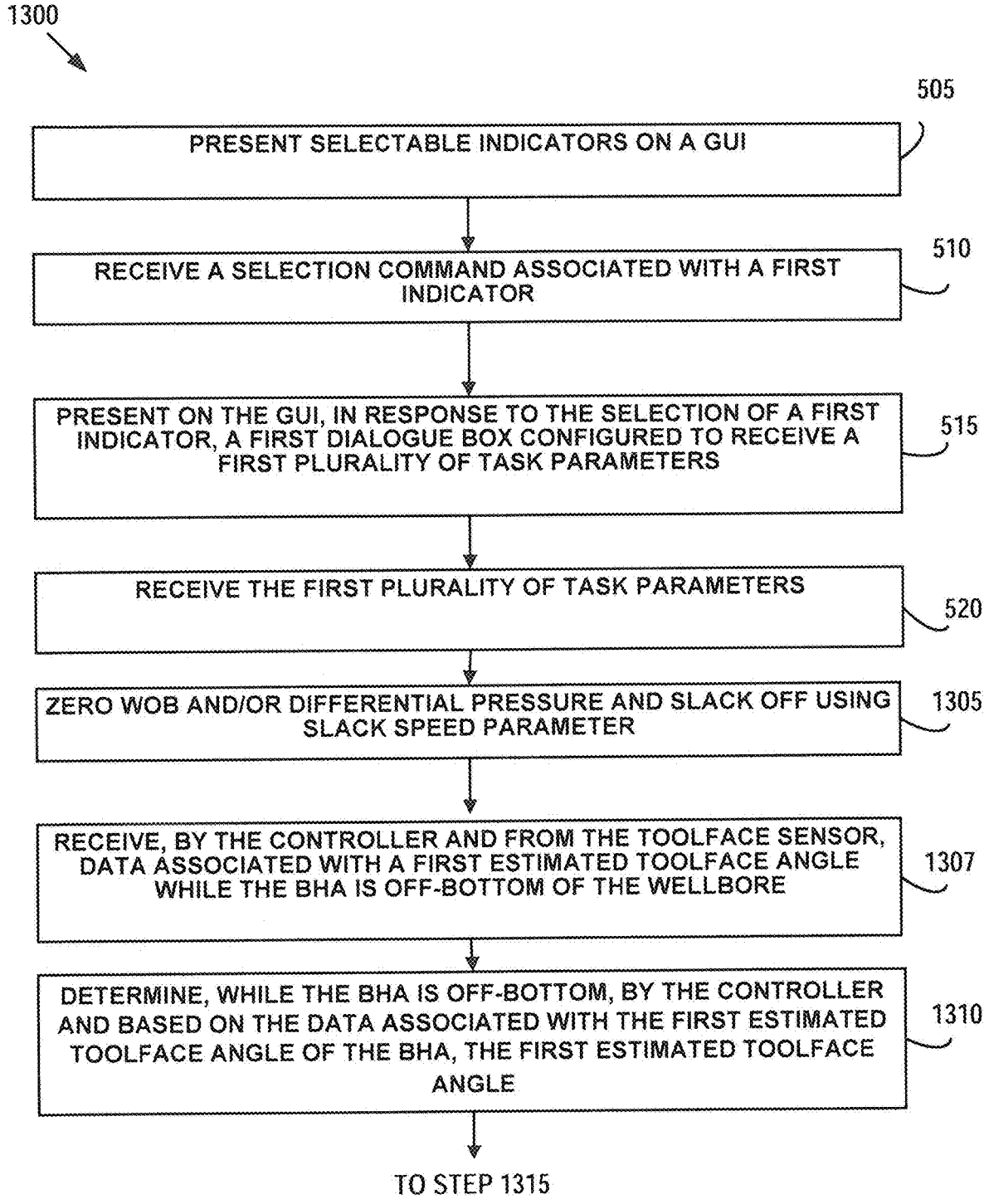
FIGS. 13A and 13B together form a flow-chart diagram of a method according to one or more aspects of the present disclosure.
Figure 13B:
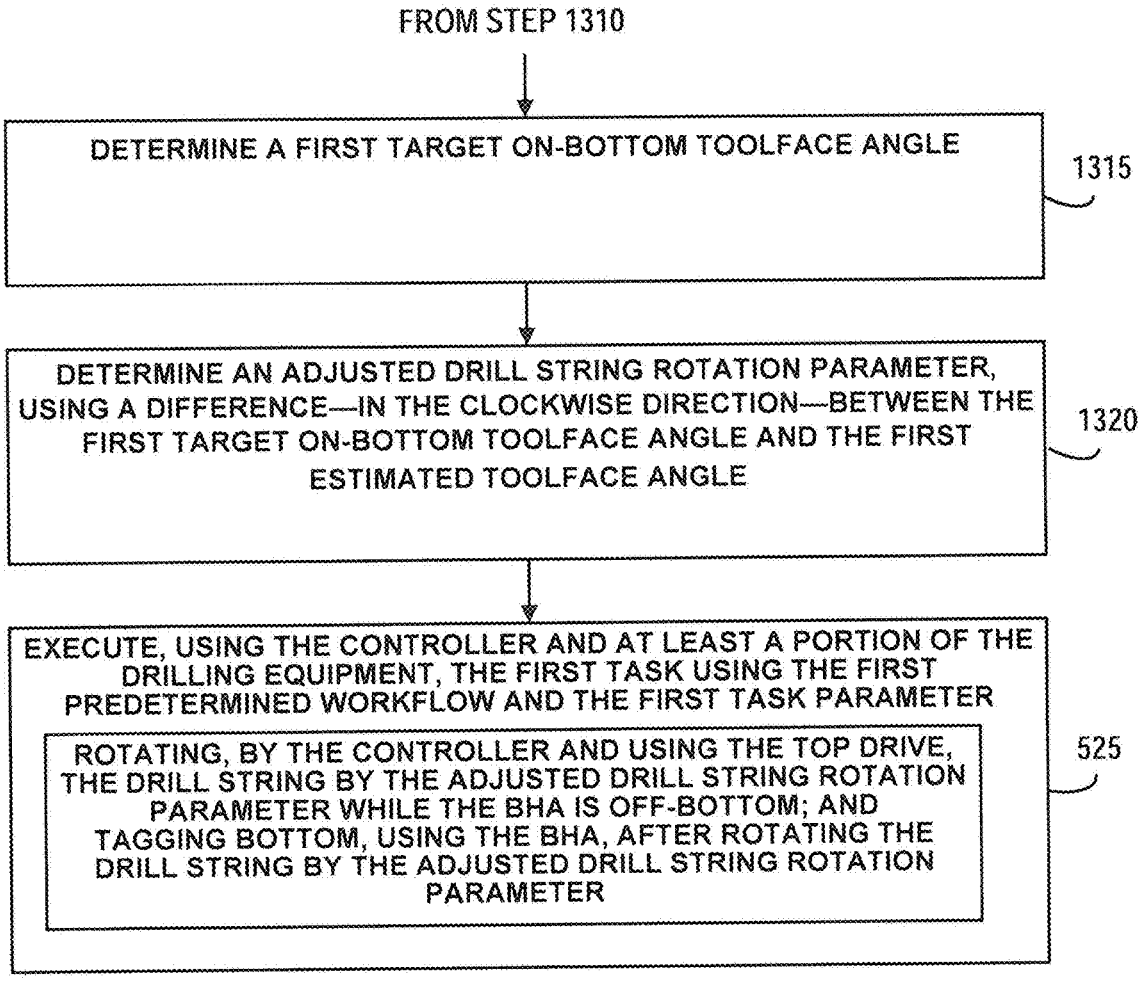

FIGS. 13A and 13B illustrate a method, generally referred to by the numeral 1300, of automatically executing instructions relating to the task of tagging bottom during a slide drilling operation. Compensating for reactive torque based on toolface position prior to tagging bottom generally reduces the time required for the apparatus 100 to get the toolface lined up. Thus, the apparatus 100 is configured, when lowering to tag bottom with the BHA 170, to put in an offset wrap at a given depth from bottom to aid the apparatus 100 in reaching target zone quicker. In some instances, the apparatus 100 delays tagging bottom until the toolface is generally aligned with a recommended toolface. Generally, the method 1300 is an embodiment of the method 500, and includes: the steps 505-520; slacking off using slack off speed parameter and zeroing WOB and/or DP at step 1305; receiving data associated with a first estimated toolface angle of the BHA 170 while the BHA is off-bottom at step 1307; determining, while the BHA 170 is off-bottom, the first estimated toolface angle at step 1310; determining a first target on-bottom toolface angle at step 1315; determining an adjusted drill string rotation parameter, using a different-in the clockwise direction-between the first target on-bottom toolface angle and the first estimated toolface angle at step 1320; and the step 525. Details relating to steps in the method 1300 that are identical to steps in the method 500, such as the step 505, will not be repeated here.

At the step 510, the first indicator is the tag bottom indicator 615.

Figure 14:
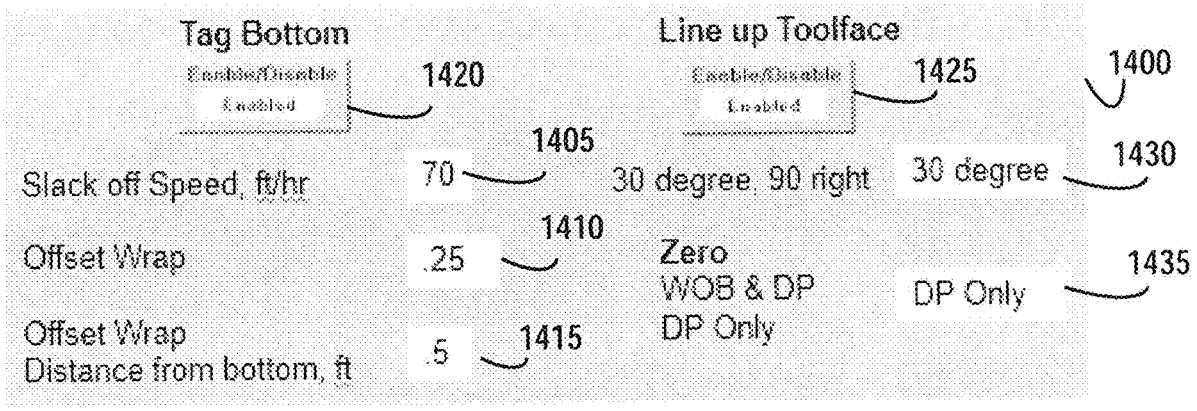
FIG. 14 is an illustration of a dialogue box displayed within the GUI of FIG. 2A during the method of FIGS. 13A and 13B, according to one or more aspects of the present disclosure.

At the step 515, a dialogue box generally referred to by the numeral 1400 in FIG. 14 is presented. As seen in FIG. 14, the dialogue box 1400 includes the following input windows: a slack off speed window 1405, an offset wrap window 1410, an offset wrap distance from bottom window 1415; a selectable button 1420 that enables and disables the tag bottom workflow; a selectable button 1425 that enables and disable the lineup toolface workflow; a 30 degree, 90 right input window 1430; and a zero WOB & DP or DP only input window 1435.

Figure 15:
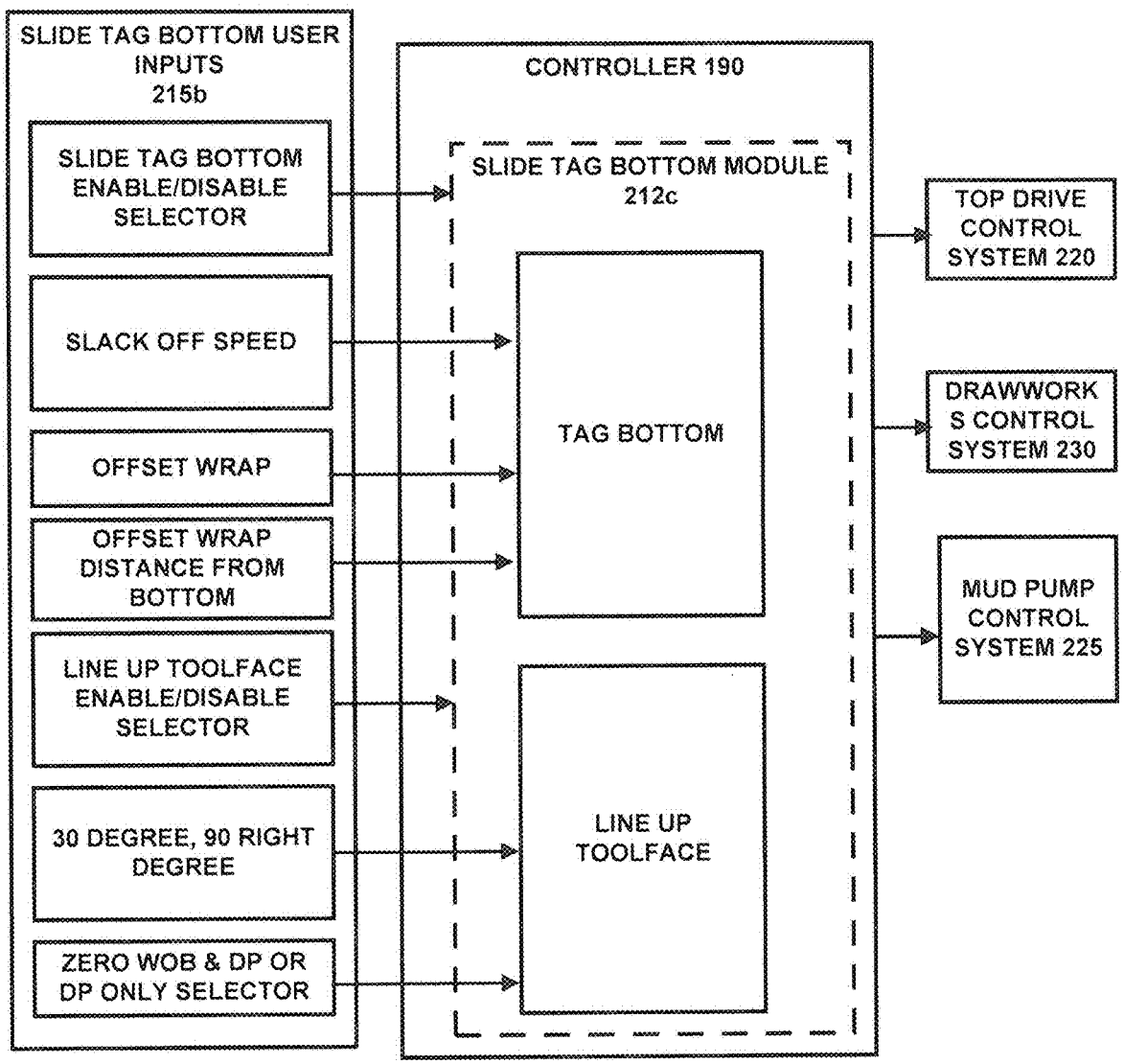
FIG. 15 is a data flow and diagrammatic illustration of the apparatus of FIG. 1 during the method of FIGS. 13A and 13B, according to one or more aspects of the present disclosure.

At the step 520 of the method 1300, the tag bottom module 212*c* receives the tag bottom workflow selection command via the button 1420 and one of more of the slide tag bottom module user inputs 215*c* via the windows 1405-1415. As illustrated in FIG. 14, the user estimated a ¼ wrap and entered 0.25 into the input window 1410. FIG. 15 illustrates data flow and a portion of the apparatus 100 during the method 1300. As illustrated, the slide tag bottom user inputs 215*c* may include the following input parameters: slide tag bottom enable/disable selection command via the button 1420; the slack off speed via the window 1405; an offset wrap via the window 1410; an offset wrap distance from bottom via the window 1415; a "line up toolface" workflow selection command via the button 1425; a 30 degree, 90 degree selection command via the window 1430; and a zero WOB & DP or DP only selection via the window 1435. Generally, the offset wrap is the users estimation of how much turn is required to maintain the current (off-bottom) toolface position once the bit engages with the formation. For example, when the off-bottom toolface reading is 90 degrees, the target toolface is 90 degrees, and given the motor and differential pressure the user intends to drill with, the user estimates that half a wrap would maintain his current toolface position. If the user manually added half a wrap before tagging bottom, his toolface should line up close to that 90 degree target.

At the step 1305, the apparatus 100 zeros the WOB and/or the differential pressure and slacks off at the slack of speed input parameter received via the window 1405 until 2 feet off-bottom.

Often, the off-bottom toolface is not already facing the direction the driller intends to slide so the offset wrap input parameter will need to be adjusted accordingly. Generally, the steps 1307-1320 adjust the offset wrap input parameter received via the window 1410 based on a current or estimated toolface position.

At the step 1307, the apparatus 100 receives, by the controller 190 and from the toolface sensor 170*b*, data associated with a first estimated toolface angle of the BHA while the BHA 170 is off-bottom of the wellbore.

Figure 16:
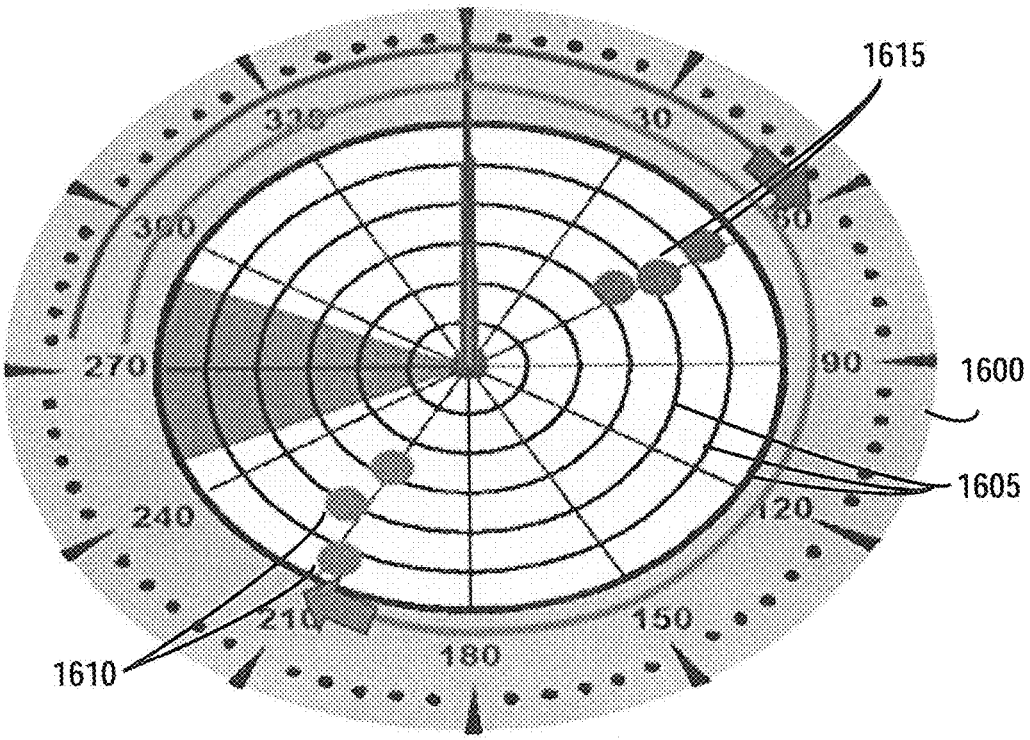
FIG. 16 is an illustration of the GUI of FIG. 2A during the method of FIGS. 13A and 13B, according to one or more aspects of the present disclosure.

At the step 1310, the system 10 determines while the BHA 170 is off-bottom, by the controller 190 and based on the data associated with the first estimated toolface angle of the BHA 170, the first estimated toolface angle. An illustration 1600 of the GUI 195 is illustrated in FIG. 16 and substantially resembles a dial or target shape having a plurality of concentric nested rings 1605. The current or estimated toolface angle is depicted by the circular symbols 1610 near 210 degrees. In the embodiment shown in FIG. 16, the GUI 195 shows the position of the toolface referenced to true North, hole high-side, or to some other predetermined orientation.

At the step 1315, the apparatus 100 determines, by the controller 190, a first recommended on-bottom toolface angle of the BHA 170. In the example illustrated in FIG. 16, the recommended or target toolface angle of the BHA 170 is 270 degrees. The first recommended toolface may be calculated by the apparatus 100 using historical data and the final target of the well plan, may be looked up in a database, or determined in any variety of ways.

At the step 1320, the apparatus 100 determines an adjusted drill string rotation parameter, using a difference measured in the clockwise direction between the first recommended toolface angle and the first estimated toolface angle. In the example illustrated in FIG. 16, the difference is 300 degrees. When the difference is greater than 180 degrees, calculating the adjusted drill string rotation parameter includes using a first rule. In some example embodiments, the first rule includes adding the drill string rotation parameter, or the offset wrap received via the window 1410, to the difference between 360 degrees and the difference. When the difference is equal to or less than 180 degrees, calculating the adjusted drill string rotation parameter includes using a second rule that is different from the first rule. In some embodiments, the second rule includes subtracting the difference from the drill string rotation parameter received via the window 1410. When the difference is 300 degrees and when the drill string rotation parameter is ¼ wrap, then using the first rule, the adjusted drill string rotation parameter is 150 degrees. In another example embodiment and if the first estimated toolface angle of the BHA is 60 as illustrated by the circular symbols 1615 near the 60 degrees mark in the illustration 1600 of FIG. 16, then the adjusted drill string rotation parameter is −60 degrees (difference is 150 degrees; adjusted user defined offset is 90 degrees (or ¼ wrap)−150=−60 degrees).

The step 525 of the method 1300 includes rotating, by the controller 190 and using the top drive control system 220, the drill string 155 by the adjusted drill string rotation parameter while the BHA 170 is off-bottom; and tagging bottom, using the BHA 170, after rotating the drill string 155 by the adjusted drill string rotation parameter.

Figure 17A:
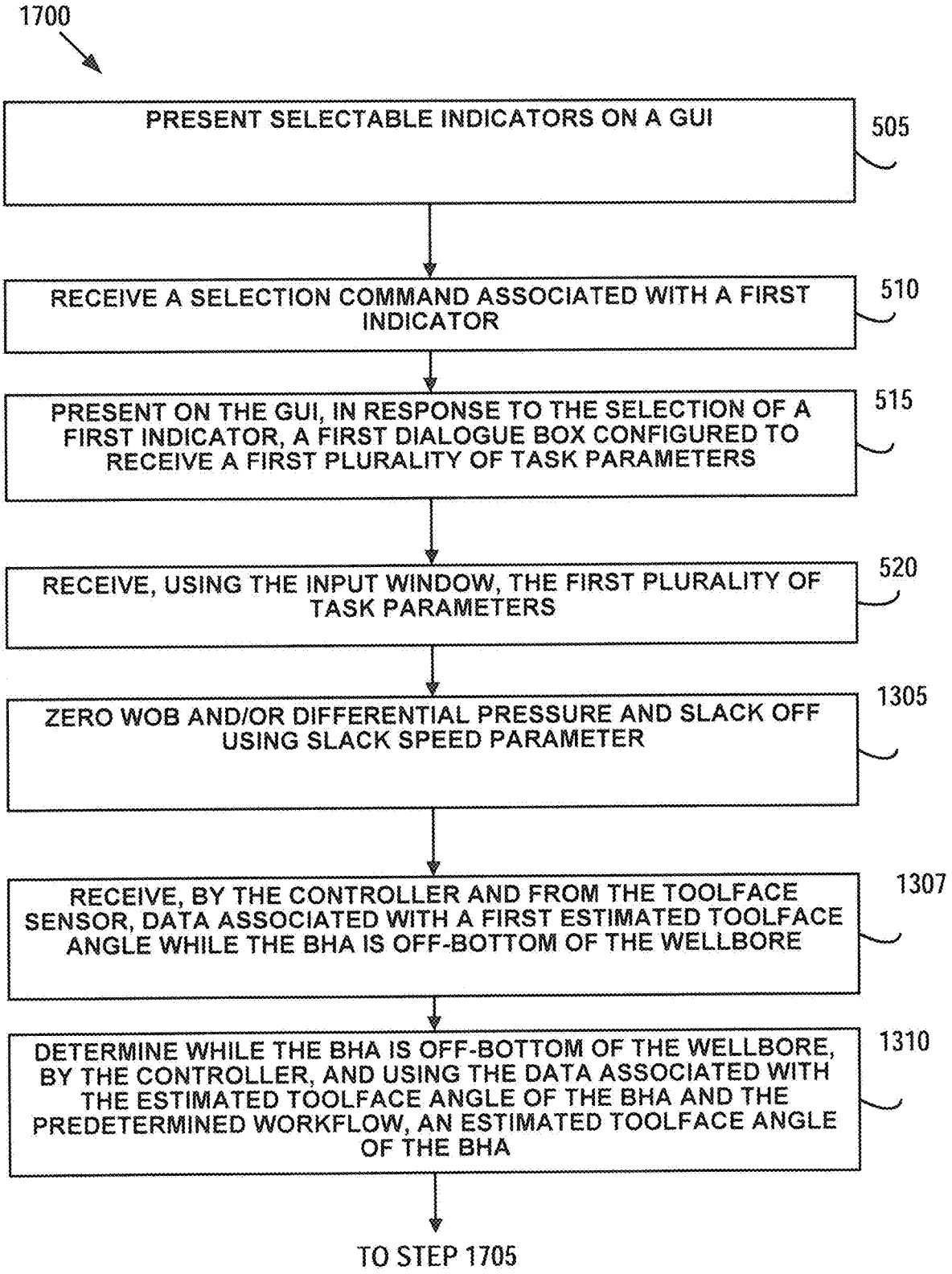
FIGS. 17A and 17B together form a flow-chart diagram of a method according to one or more aspects of the present disclosure.
Figure 17B:
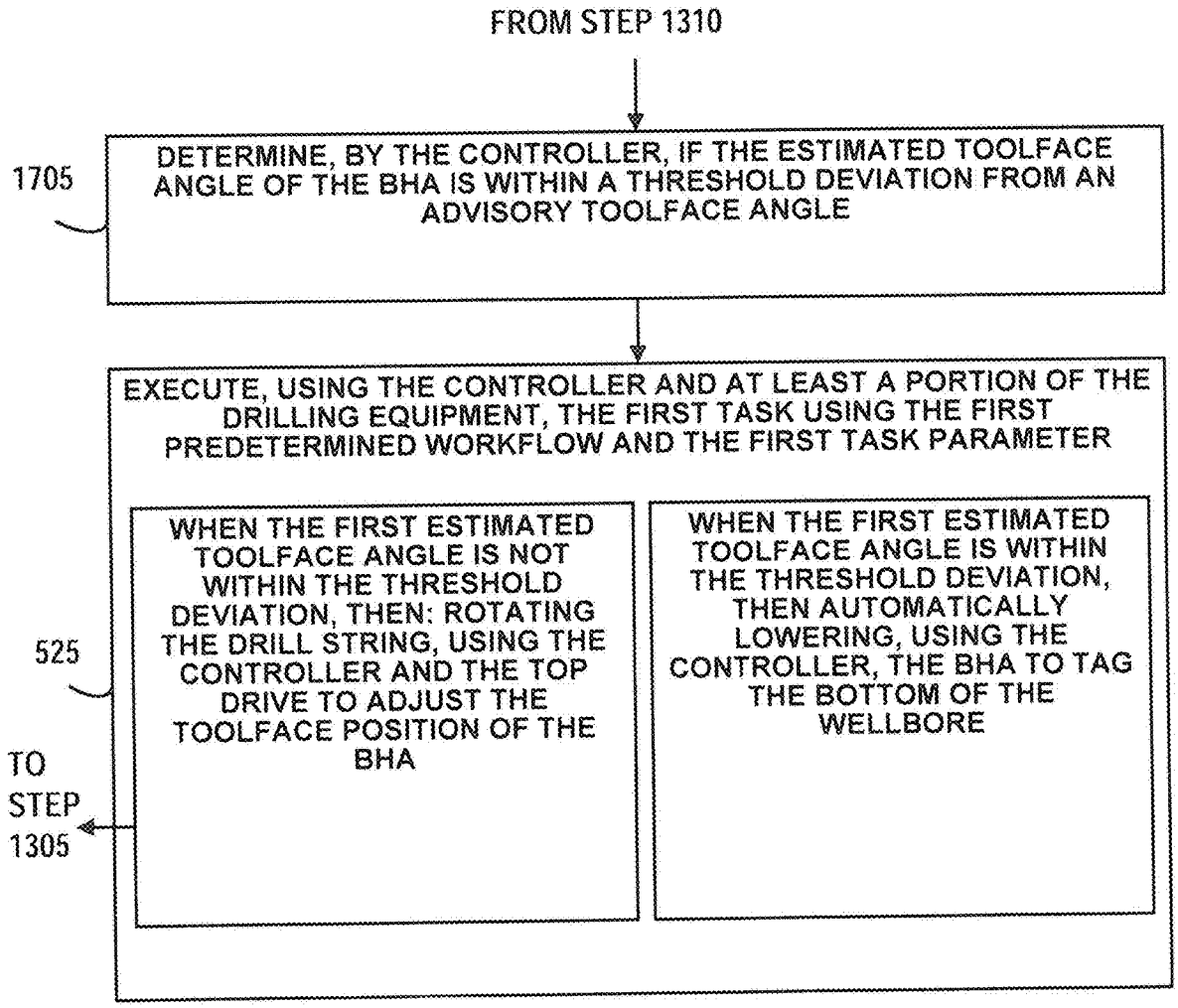

FIGS. 17A and 17B illustrates an alternative method, generally referred to by the numeral 1700, to the method 1300 of automatically executing instructions relating to the task of tagging bottom during a slide drilling operation. Generally, the method 1700 includes: the steps 505-520; the step 1305; the step 1307; the step 1310; determining if the estimated toolface angle is within a threshold deviation from an advisory or target toolface angle; and the step 525. Details relating to steps in the method 1700 that are identical or substantially similar to steps in the method 1300, such as the step 505, 510, 515, 1305, 1307, and 1310 will not be repeated here.

At the step 520, the "line up toolface" enable selector is received via the window 1425 of FIG. 14, one of the 30 degree or 90 degree input parameters are received via the window 1430, and one of the Zero WOB & DP or zero DP only input parameters are received via the window 1435.

At the step 1705, the controller 190 or the module 212*d* determines whether the estimated toolface angle of the BHA 170 is within a threshold deviation from an advisory or target toolface angle. The threshold deviation used in the step 1705 is dependent upon the input parameter received via the window 1430. When the input parameter received via the window 1430 is "30 degree", the threshold deviation includes 30 degrees from the advisory toolface angle in the clockwise direction and 30 degrees from the advisory toolface angle in the counterclockwise direction. When the input parameter received via the window 1430 is "90 right", the threshold deviation includes 75 degrees in the clockwise direction from the advisory toolface angle to 105 degrees in the clockwise direction from the advisory toolface angle.

The step 525 of the method 1700 includes, when the first estimated toolface angle is within the threshold deviation, automatically lowering, using the controller 190 and the drawworks control system 230, the BHA 170 to tag the bottom of the wellbore 160. When the first estimated toolface angle is not within the threshold deviation, then the step 525 of the method 1700 includes rotating the drill string 155, using the controller 190 and the top drive control system 220, to adjust the toolface position of the BHA 170 and then repeating the method 1700 beginning at the step 1305.

After the step 525 of the method 1300 or 1700, the apparatus 100 automatically begins to execute the obtain target direction module 212*d* or automatically presents the dialogue box 600 to the user.

Figure 18A:
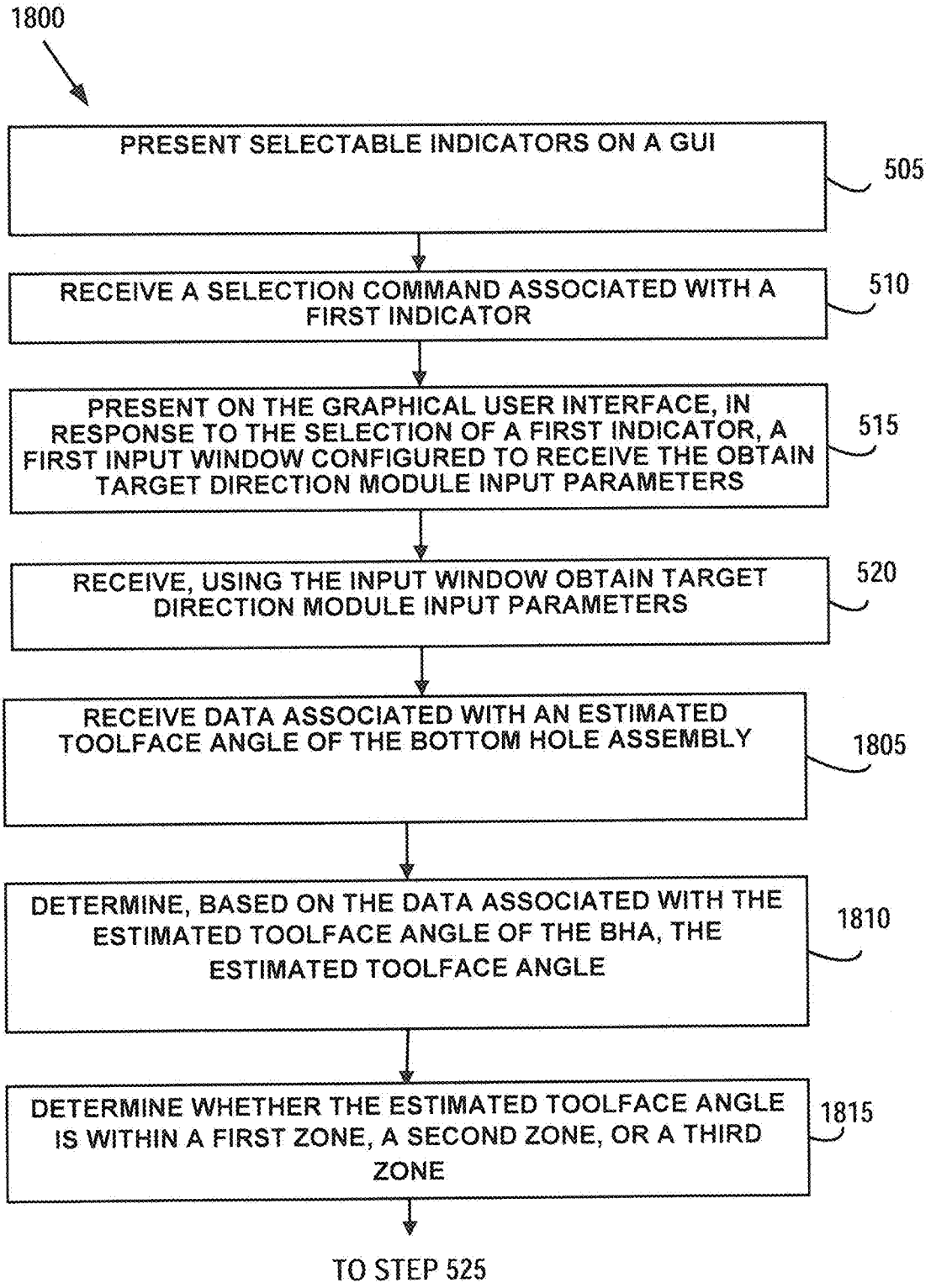
FIGS. 18A and 18B together form a flow-chart diagram of a method according to one or more aspects of the present disclosure.
Figure 18B:
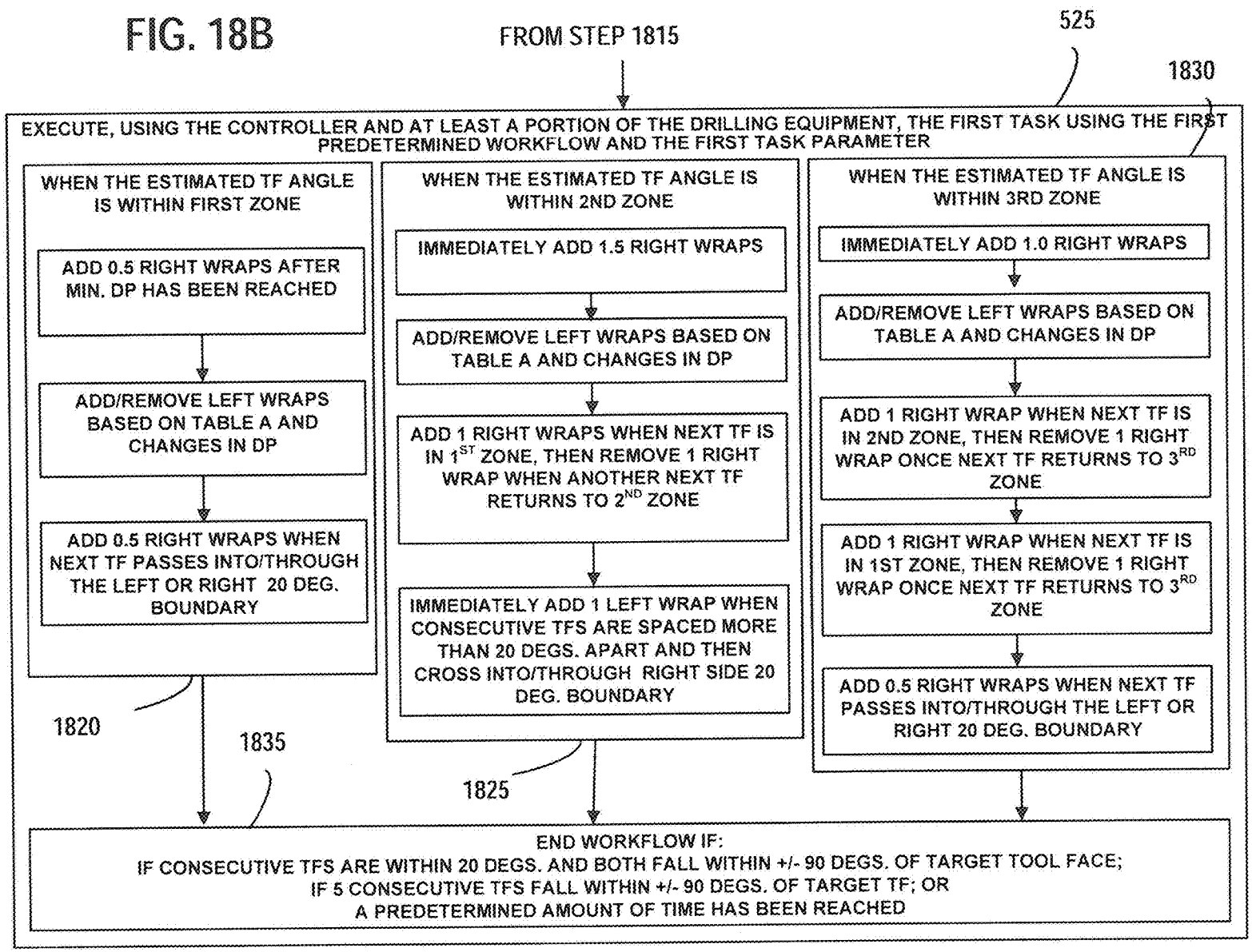

FIGS. 18A and 18B illustrate a method, generally referred to by the numeral 1800, of automatically executing instructions relating to the task of obtaining toolface position during a slide drilling operation. Generally, when first tagging bottom there is typically a lot of toolface movement while drilling parameters/reactive torque settle down. If the apparatus 100 attempts to make too many corrections during this phase it can lead to longer periods of instability. Thus, the apparatus 100 is configured to add a "wrap mode" as an option to obtain target direction within the module 212*d*. Moreover, the obtain target direction module 212*d* includes a homing mode module for obtaining target direction. The "homing mode" module allows for the steering logic directly after tagging bottom to have settings different from steering logic settings when trying to maintain control of the toolface after the toolface has been lined up. Generally, the method 1800 is an embodiment of the method 500, and includes: the steps 505-520; receiving data associated with an estimated toolface angle of the BHA 170 at step 1805; determining, based on the data associated with the estimated toolface angle, the estimated toolface angle at step 1810, determining whether the estimated toolface angle is within a first zone, a second zone, or a third zone at step 1815; and the step 525. Details relating to steps in the method 1800 that are identical to steps in the method 500, such as the step 505, will not be repeated here.

At the step 510, the first indicator is the obtain toolface position indicator 620.

At the step 515, a dialogue box 1900 illustrated in FIG. 19A is presented. The dialogue box 1900 includes the following input windows: a toolface mode only input window 1905, an all mode input window 1910, an XOR mode input window 1915, a homing mode selection input window 1917, a direction check window 1920, a wait number of toolfaces before correcting input window 1925, a correct on every input window 1930, a left gain input window 1935, a right gain input window 1940, input windows 1945 and 1950 for receiving the number of toolfaces within a specific number of degrees of target, a time to move to next sequence input window 1955, an enable/disable obtain target direction module button 1960; and a plurality of table entry windows 1965.

Figure 20:
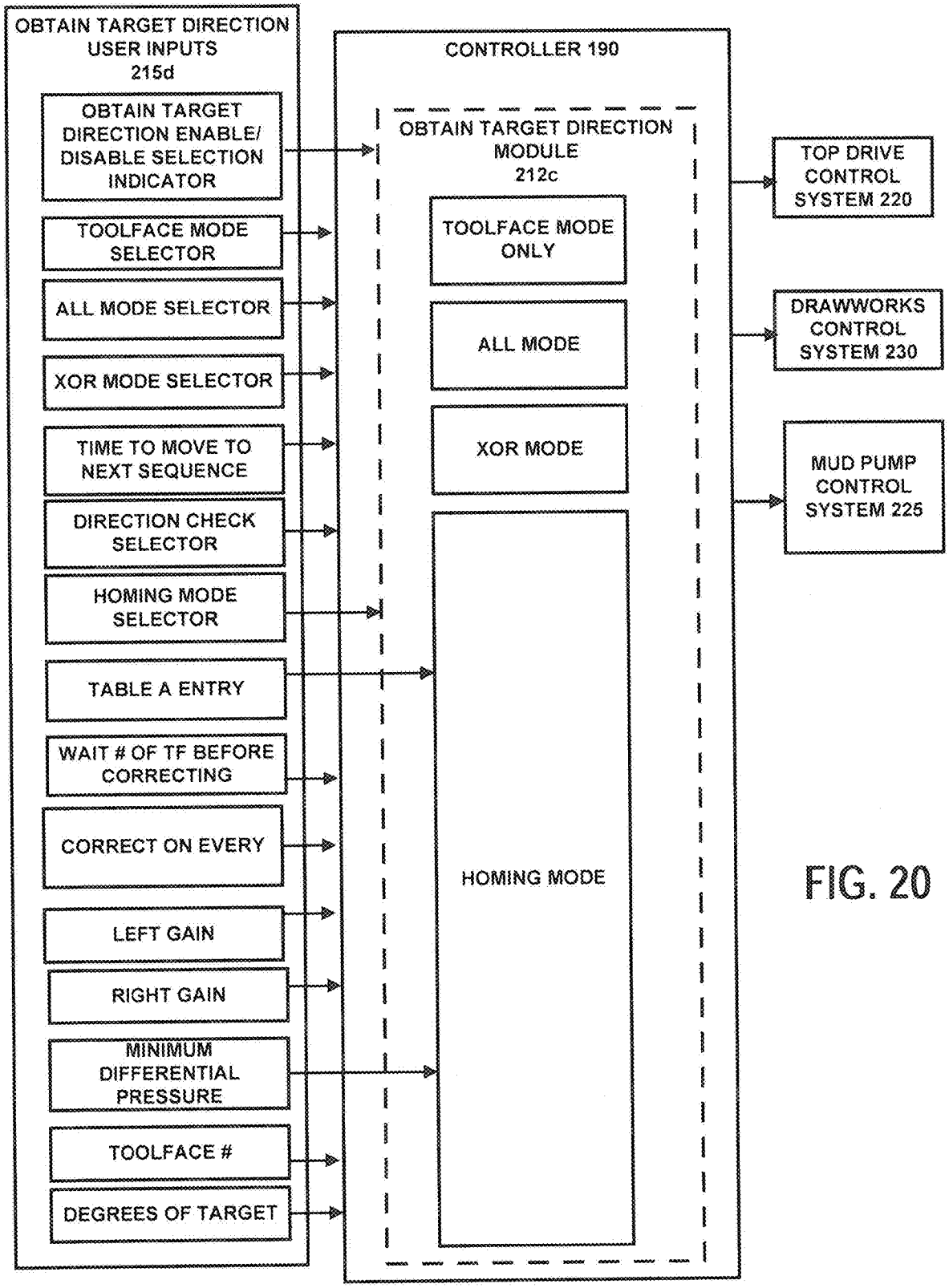
FIG. 20 is a data flow and diagrammatic illustration of the apparatus of FIG. 1 during the method of FIGS. 18A and 18B, according to one or more aspects of the present disclosure.

At the step 520 of the method 1800, the apparatus 100 receives, via one or more of the input windows 1905-1965, the homing mode selection command via the window 1917 and one of more of the obtain target direction module user inputs 215*d*. As illustrated in FIG. 20, the obtain target direction user inputs 215*d* includes any of the following inputs: obtain target direction enable/disable selection command received via the window 1960; toolface mode selector received via the window 1905; all mode selector received via the window 1910; XOR mode selector received via the window 1915; amount of time to move to next sequence received via the window 1955; direction check selector received via the window 1920; homing mode selector received via the window 1917; table A entry received via the window 1965; wait # of TF before correcting received via the window 1925; correct on every received via the window 1930; left gain received via the window 1935; right gain received via the window 1940; minimum differential pressure received via the window 1960; toolface # received via the window 1945; and degrees of target received via the window 1950. An example of inputs, or a Table A entry— received via the plurality of input windows 1965—is generally referred to by the numeral 1965' is illustrated in FIG. 19B.

At the step 1805, the controller 190 receives from the toolface sensor 170*b*, data associated with an estimated toolface angle of the BHA 170.

At the step 1810, the apparatus 100 determines, by the controller 190 and based on the data associated with the first estimated toolface angle of the BHA 170, the estimated toolface angle.

At the step of 1815, the system determines based on the first estimated toolface angle, is within a first zone, a second zone, or a third zone. An illustration 2100 displayed on the GUI 195 is illustrated in FIG. 21 and is substantially resembles a dial or target shape. As depicted in the illustration 2100, the target toolface is 180 degrees. When the advisory window width is set at 40 degrees, a right 20 degree boundary extends in the counterclockwise direction from the target toolface and a left 20 degree boundary extends in the clockwise direction from the target toolface. Generally, the dial will be divided into a first, second, and third zones, which will move relative to the target tool face. For example, if the target tool face is changed from 180 to 200, the zone for zone 1 will become 280-40, zone 2 will become 40 to 160, and zone three will become 160-280.

The step 525 of the method 1800 includes a sub-step of 1820 when the estimated toolface is in the first zone, a sub-step of 1825 when the estimated toolface is in the second zone, a sub-step of 1830 when the estimated toolface is in the third zone, and a sub-step of 1835 of ending the workflow.

At the step 1820 and when the estimated toolface is within the first zone, the step 525 of the method 1800 includes adding 0.5 right wraps after the minimum differential pressure has been reached; adding or removing left wraps based on the Table A entry 1965' and changes in the differential pressure; and adding 0.5 right wraps when the next estimated toolface passes into or through the left 20 degree boundary or into/through the right 20 degree boundary.

At the step 1825 and when the estimated toolface is within the second zone, the step 525 of the method 1800 includes immediately adding 1.5 rights wraps; adding or removing left wraps based on the Table A entry 1965' and changes in the differential pressure; adding 1 right wrap when the next estimated toolface is in the first zone then removing 1 right wrap when another next estimated toolface returns to the second zone; and immediately adding 1 left wrap when consecutive toolfaces are spaced more than 20 degrees apart and then cross into/through the right side 20 degree boundary.

At the step 1830 and when the estimated toolface is within the third zone, the step 525 of the method 1800 includes immediately adding 1 right wraps; adding or removing left wraps based on the Table A entry 1965' and changes in the differential pressure; adding 1 right wrap when the next estimated toolface is in the $2^{nd}$ zone then removing 1 right wrap once another next estimated toolface returns to the $3^{rd}$ zone, and adding 0.5 right wraps when the yet another next estimated toolface passes through/into the left 20 degree boundary or the right 20 degree boundary.

At the step 1835, the apparatus 100 ends the workflow if any of the following three conditions are met: if consecutive toolfaces are within 20 degrees and both fall within +/−90 degrees of the target toolface; if 5 consecutive toolfaces fall within +/−90 degrees of the target toolface; and if the amount of time to move to next sequence received via the window 1955 is reached.

After the step 525 of the method 1800, the apparatus 100 automatically begins to execute the maintain target direction module 212*e* or automatically presents the dialogue box 600 to the user.

Figure 22:
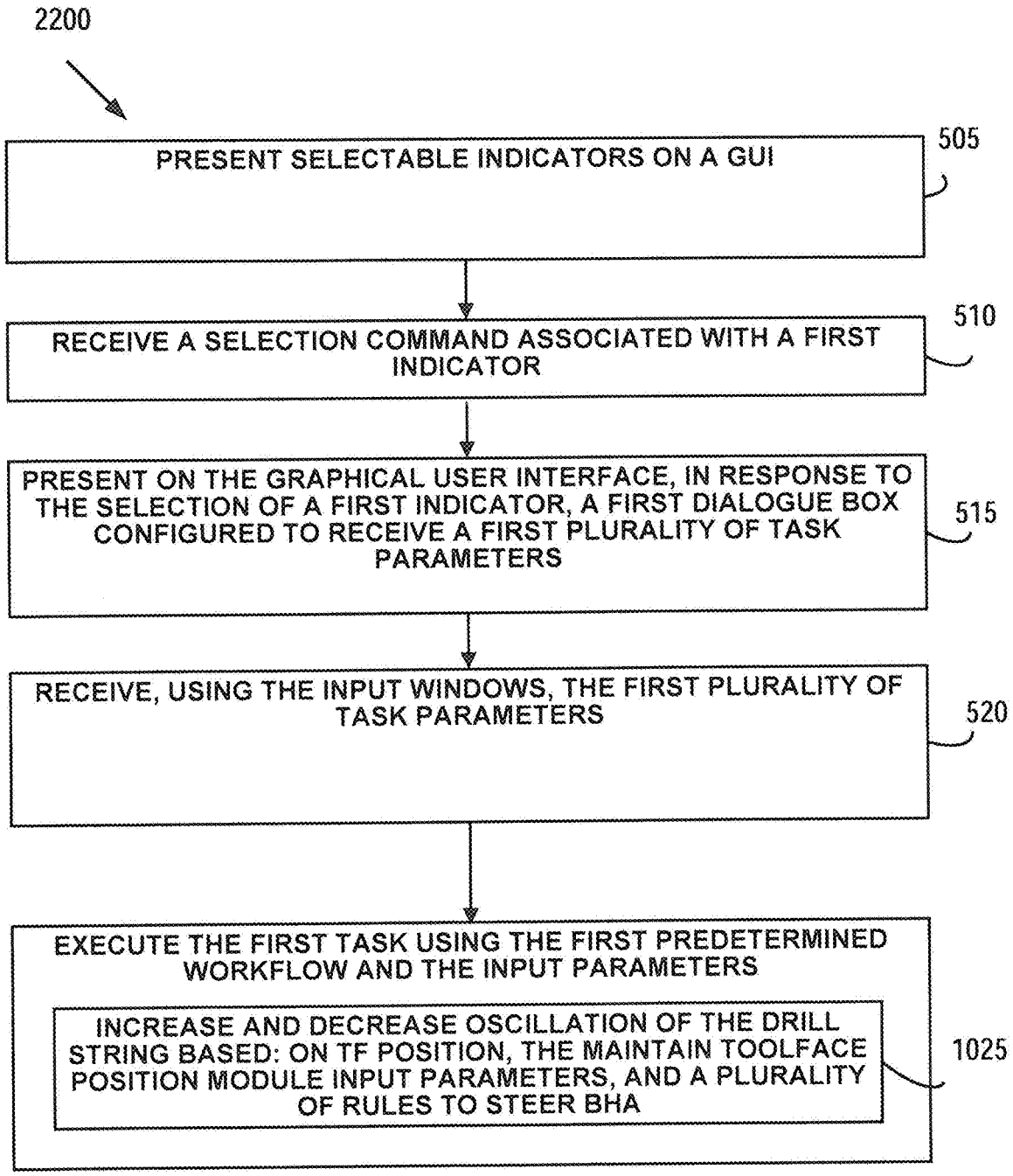
FIG. 22 is a flow-chart diagram of a method according to one or more aspects of the present disclosure.

FIG. 22 illustrates a method, generally referred to by the numeral 2200, of automatically executing instructions relating to the task of maintaining toolface position during a slide drilling operation. Generally, an effective way of getting toolface to move left or right is to increase the amount of oscillations in the direction that you would like toolface to move. For example oscillating with 5 wraps to the left and 5 wraps to the right is maintaining a steady toolface position. If the directional driller wanted his toolface to move to the right, increasing his right oscillation to 6 would start to pull his toolface to the right. Once the desired toolface movement is achieved the right oscillation is brought back down to 5 to avoid continual toolface walk. The starting point for steady toolface is not always even oscillation in each direction. For instance 3 wraps to left and 5 wraps to the right could be what keeps toolface steady. Increasing left wraps to 4 in this case could still cause toolface to walk to the left, because the steady point was 3 to the left and 5 to the right. Thus, the apparatus 100 includes a wraps steering module as a portion of the maintaining toolface position module 212*e* to automate the process of increasing and decreasing oscillation to cause toolface to walk. Generally, the method 2200 is an embodiment of the method 500, and includes the steps 505-525. Details relating to steps in the method 2200 that are identical to steps in the method 500, such as the step 505, will not be repeated here.

At the step 510, the first indicator is the maintain toolface position indicator 625.

Figure 23:
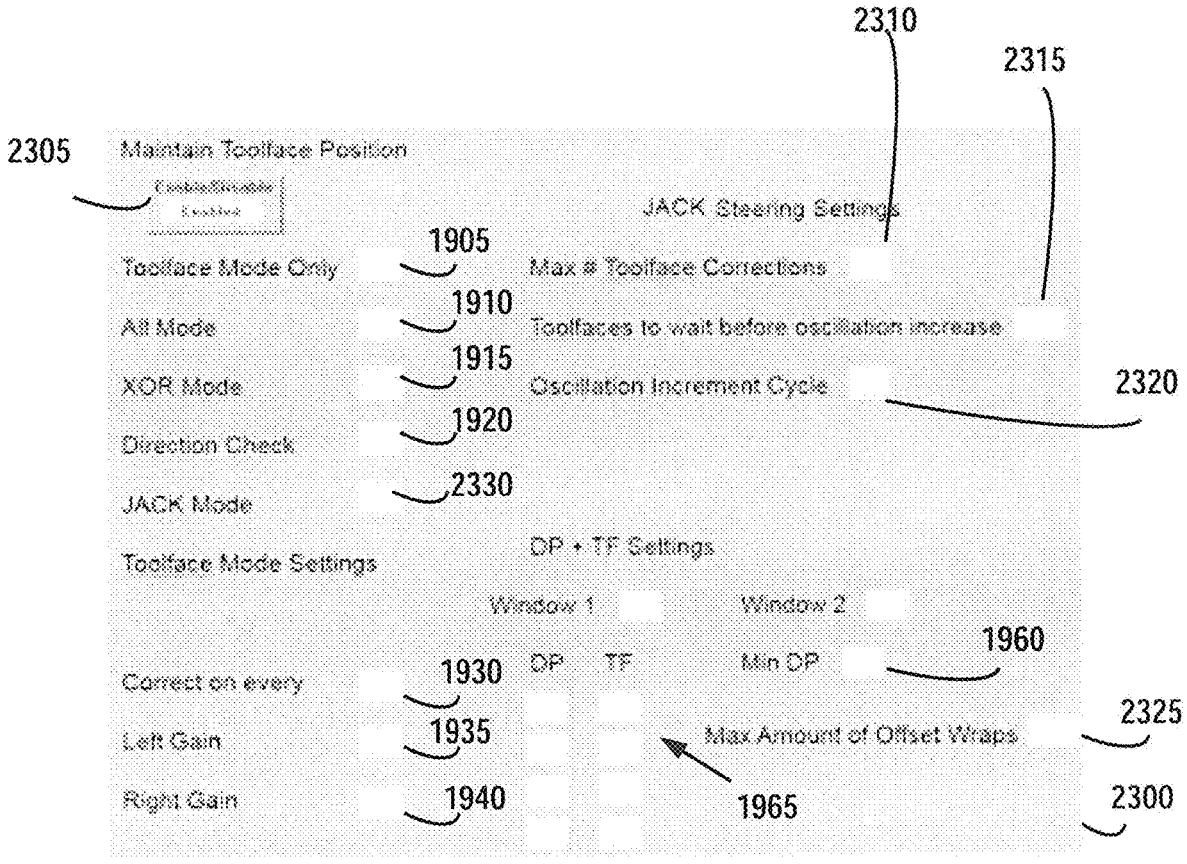
FIG. 23 is an illustration of a dialogue box of the GUI of FIG. 2A during the method of FIG. 22, according to one or more aspects of the present disclosure.

At the step 515, a window 2300 illustrated in FIG. 23 is presented. The dialogue box 2300 is similar to the dialogue box 1900 except that the dialogue box 2300 omits the wait number of toolfaces before correcting input window 1925, input windows 1945 and 1950 for receiving the number of toolfaces within a specific number of degrees of target, a time to move to next sequence input window 1955, and an enable/disable obtain target direction module input window 1960, and instead includes an enable/disable maintain toolface position module input button 2305, a maximum number of toolface corrections input window 2310, a toolfaces to wait before oscillation increase input window 2315, oscillation increment cycle input window 2320, a maximum amount of offset wrap input window 2325; and a JACK mode selector input window 2330.

Figure 24:
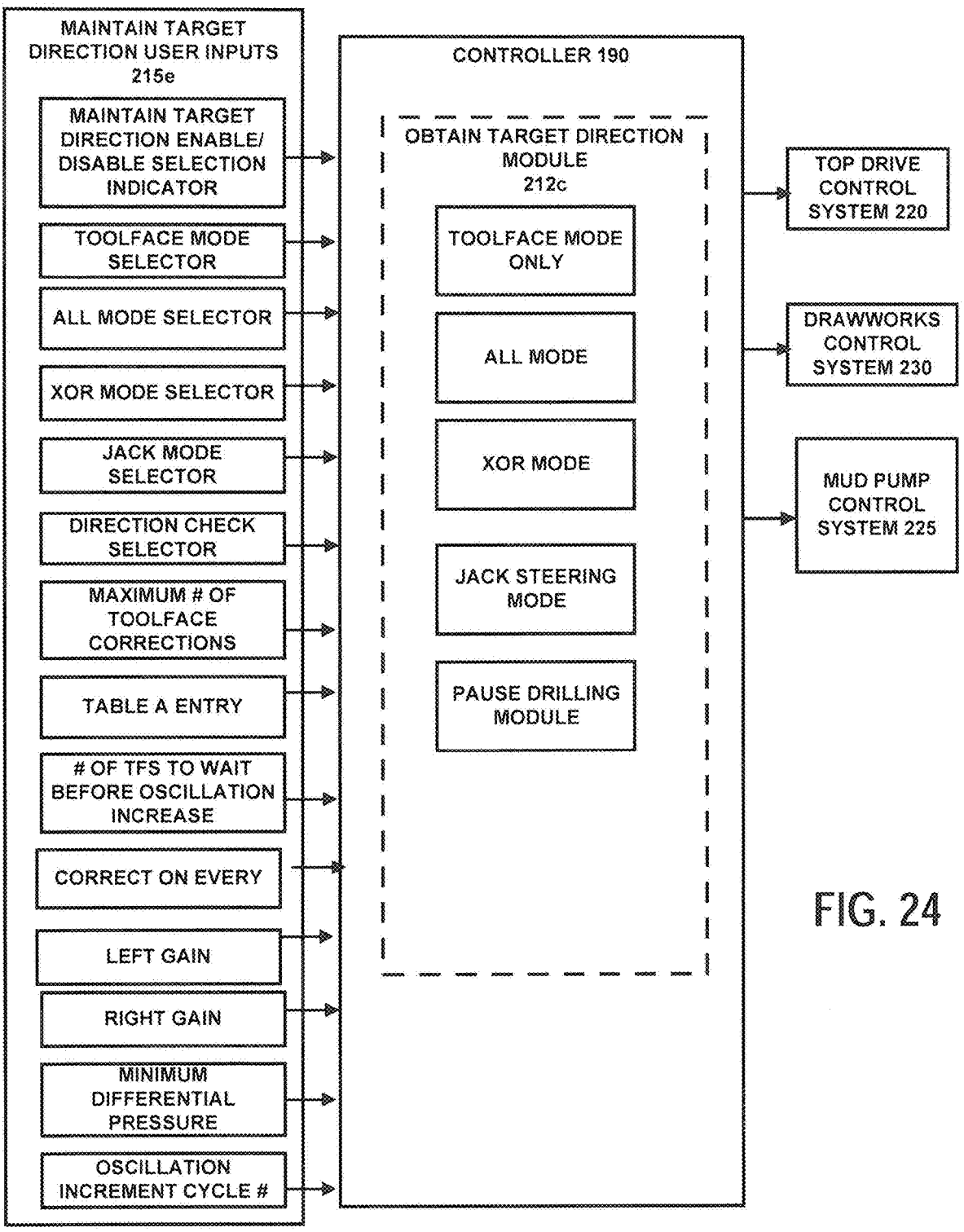
FIG. 24 is a data flow and diagrammatic illustration of the apparatus of FIG. 1 during the method of FIG. 22, according to one or more aspects of the present disclosure.

At the step 520, the apparatus 100 receives, via one or more of the input windows 1905-1920, 1930-1940, 1960, 1965, and 2305-2330 one of more of the maintain target direction module user inputs 215*e*. As illustrated in FIG. 24, the maintain target direction user inputs 215*e* includes any of the following inputs: a JACK mode selection command via the input window 2330; a maintain target direction enable/disable selection received via the window 2305; toolface mode selector received via the window 1905; all mode selector received via the window 1910; XOR mode selector received via the window 1915; direction check selector received via the window 1920; table A entry received via the window 1965; correct on every received via the window 1930; left gain received via the window 1935; right gain received via the window 1940; minimum differential pressure received via the window 1960; enable/disable maintain toolface position received via the window 2305; a maximum number of toolface corrections parameter via the window 2310; a number of toolface to wait before oscillation increase via the window 2315; oscillation increment cycle number via the window 2320, and a maximum amount of offset wraps via the window 2325.

At the step 525 of the method 2200, the system increases and decreases the oscillation of the drill string 155 based on: a TF position, the maintain toolface position module input parameters 215*e*, and a plurality of rules to steer the BHA.

Before, during, or after the step 525 of the method 2200, the apparatus 100 automatically begins to execute the evaluation module 212*f*.

Figure 25A:
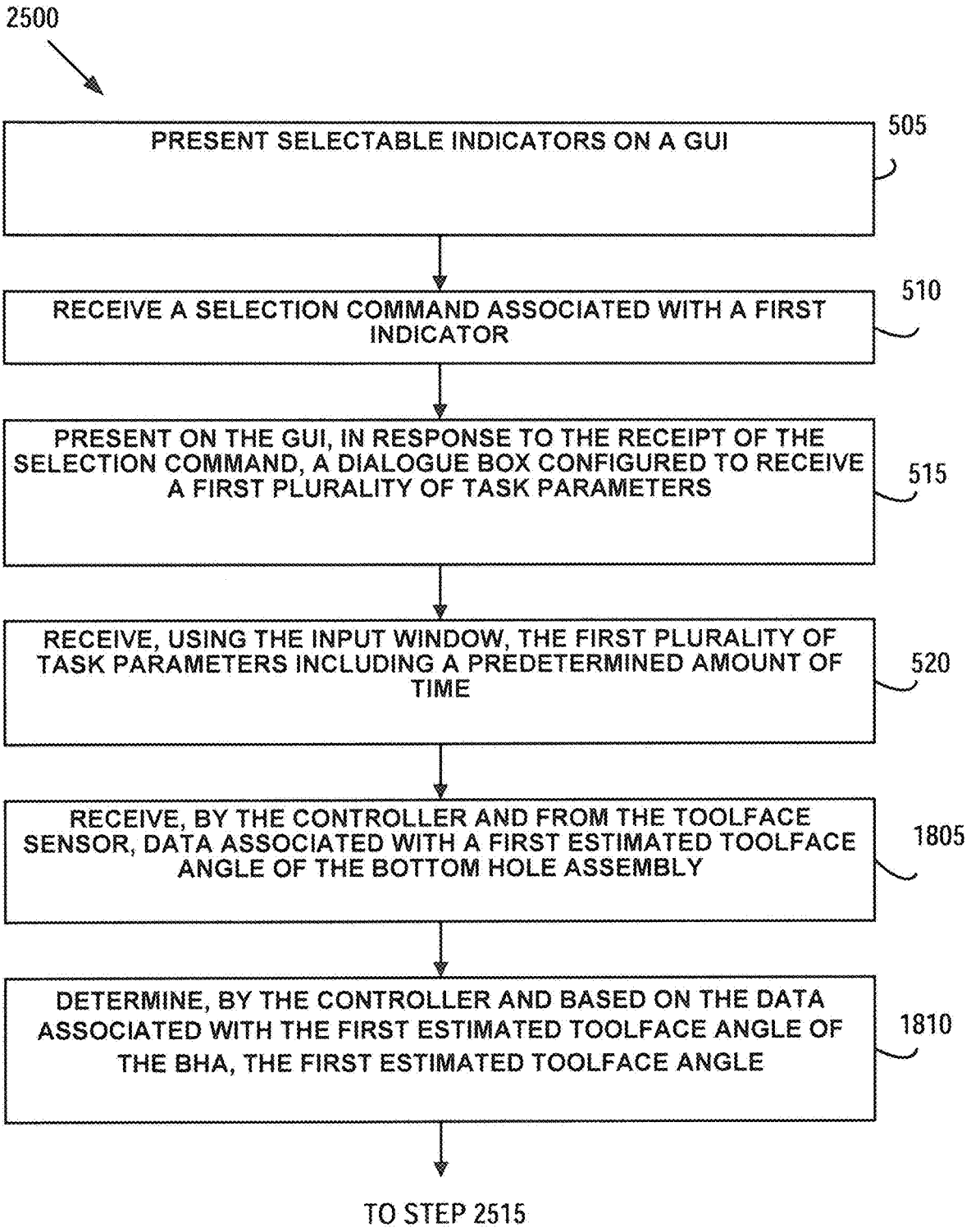
FIGS. 25A, 25B, and 25C together form a flow-chart diagram of a method according to one or more aspects of the present disclosure.
Figure 25B:
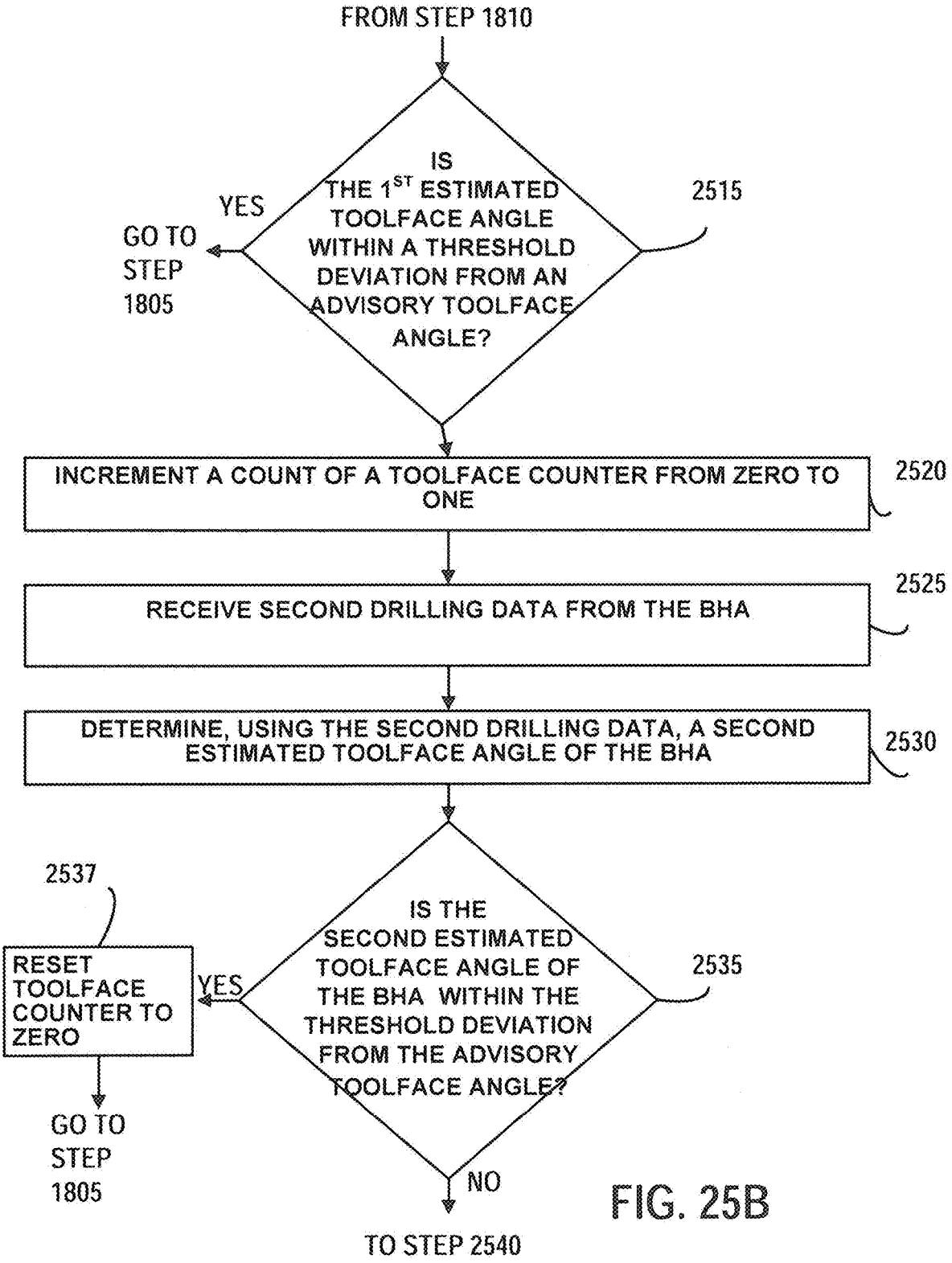
Figure 25C:
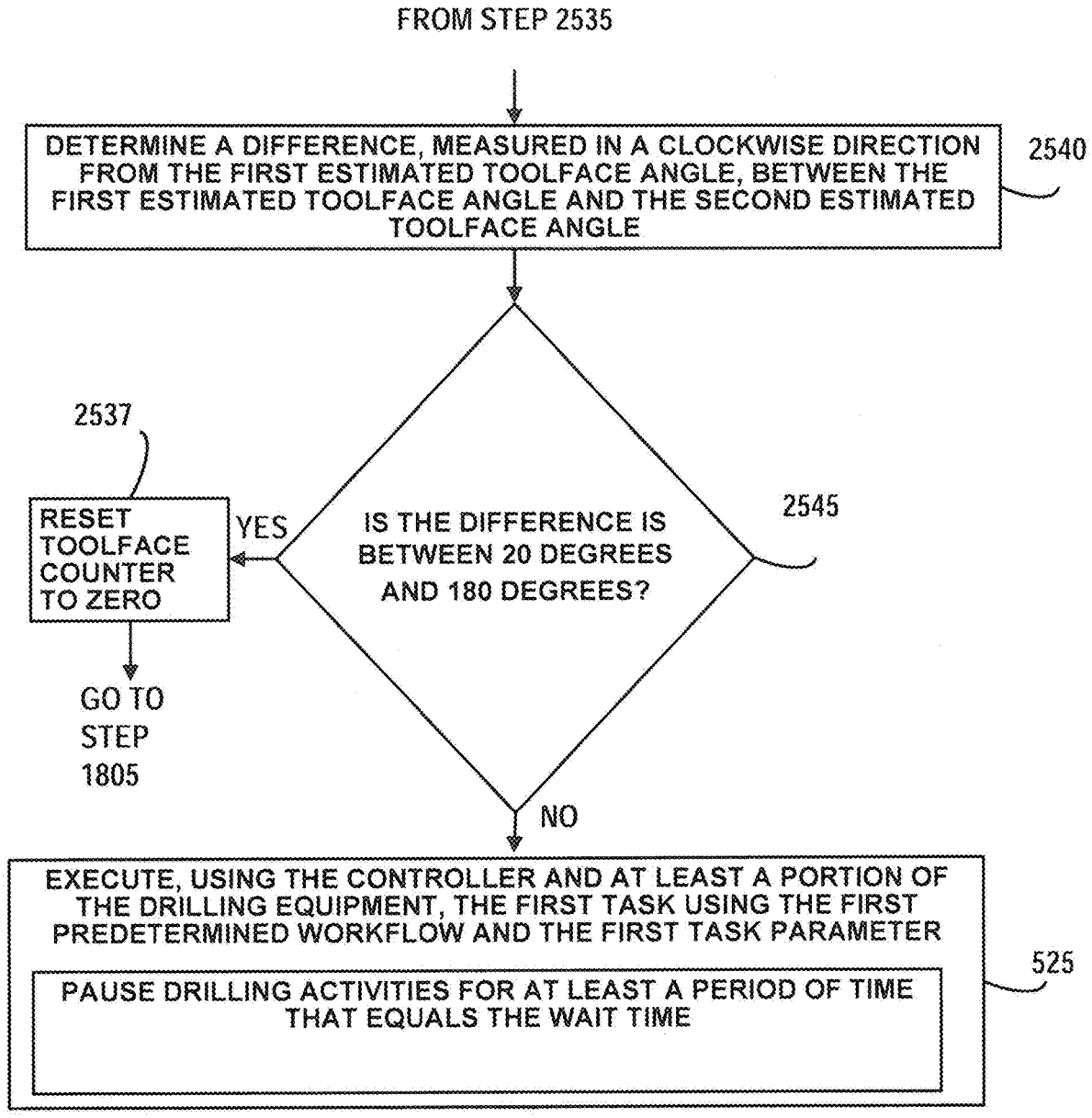

FIGS. 25A, 25B, and 25C illustrate a method, generally referred to by the numeral 2500, of automatically executing instructions relating to the task of evaluating at least a portion of the slide drilling operation. As noted above, an effective way of getting toolface to move left or right is to increase the amount of oscillations in the direction in which the toolface should move. As such, the apparatus 100 includes a wraps steering module as a portion of the maintaining toolface position module 212*e* to automate the process of increasing and decreasing oscillation to cause toolface to walk. Moreover, the apparatus 100 includes an evaluation mode module 212*f*, which pauses drilling to allow for the reduction of differential pressure thereby preventing further walk of the toolface in a wrong or undesired direction. Thus, the evaluation mode module 212*f* can be executed simultaneously with the maintaining toolface position module 212*e* and/or the obtaining target direction module 212*d*. Generally, the method 2500 is an embodiment of the method 500, and includes the steps 505-525, 1805, 1810; steps 2515-2545, and the step 525. Details relating to steps in the method 2500 that are identical to steps in the method 500, such as the step 505, will not be repeated here.

At the step 510, the first indicator is the evaluation toolface position indicator 630.

Figure 26:
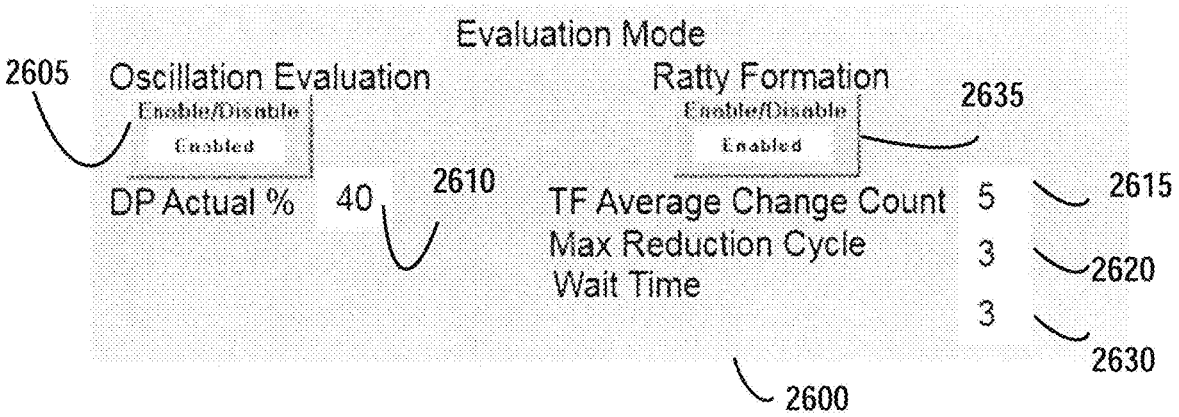
FIG. 26 is an illustration of a dialogue box of the GUI of FIG. 2A during the method of FIGS. 25A, 25B, and 25C, according to one or more aspects of the present disclosure.

At the step 515, a dialogue box 2600 illustrated in FIG. 26 is presented. The dialogue box 2600 includes the following input windows: an oscillation evaluation selection button 2605; a DP actual percentage window 2610; a TF average change count window 2615; a max reduction cycle window 2620; a wait time window 2630; and a ratty formation selection button 2635.

Figure 27:
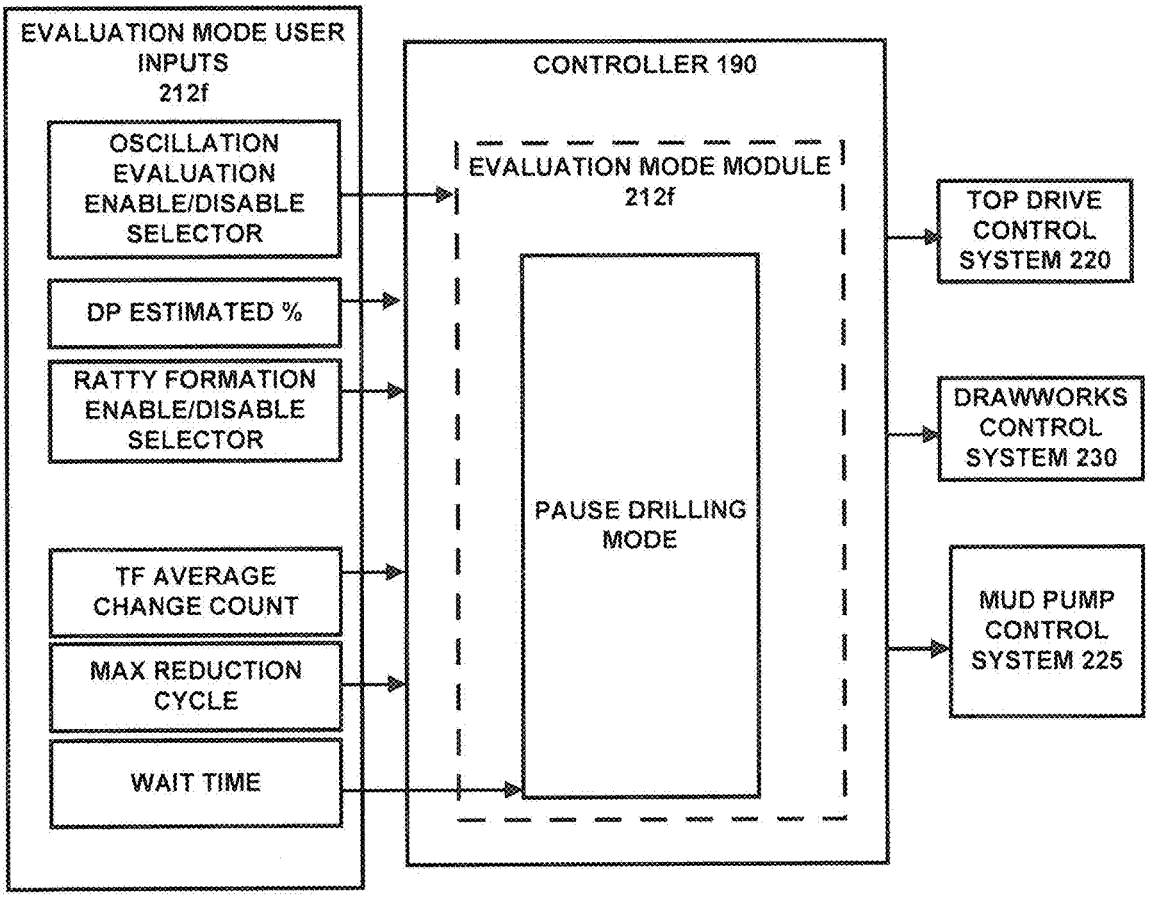
FIG. 27 is a data flow and diagrammatic illustration of the apparatus of FIG. 1 during the method of FIGS. 25A, 25B, and 25C, according to one or more aspects of the present disclosure.

At the step 520 of the method 2500, the apparatus 100 receives, via one or more of the input windows 2605-2635 one of more of the evaluation module user inputs 215*f*. As illustrated in FIG. 27, the evaluation module user inputs 215*f* includes any of the following inputs: an oscillation evaluation enable/disable received via the window 2605; a DP Actual % received via the window 2610; the ratty formation enable/disable selection received via the window 2635; the TF average change count received via the window 2615; the max reduction cycle received via the window 2620; and a wait time received via the window 2630.

The steps 1805 and 1810 of the method 2500 are identical or substantially identical to the steps 1805 and 1810 of the method 1800, and thus additional details will not be provided here.

The method 2500 also includes a step 1810 of determining, by the controller 190 and using the data associated with the actual toolface angle of the BHA, an actual toolface angle of the BHA.

At the step 2515, the controller 190 determines whether the first actual or estimated toolface angle is within a threshold deviation from an advisory toolface angle. In some embodiments, the threshold comprises: up to 60 degrees measured in a counterclockwise direction from the advisory toolface angle; and up to 120 degrees measured in a clockwise direction from the advisory toolface angle. If the first actual toolface angle is within the threshold deviation, then the next step is the step 1805. If the first actual toolface angle is not within the threshold deviation, then the next step is step 2520.

At the step 2520, the apparatus 100 increments a count of a toolface counter from zero to one.

At the step 2525, the controller 190 receives second drilling data from the BHA 170. The step 2525 is identical to the step 1805 except for that the data received at the step 2525 is subsequent to the data received at the step 1805.

At the step 2530, the controller 190 determines, using the second drilling data, a second actual toolface angle of the BHA 170.

At the step 2535, the controller 190 determines whether the $2^{nd}$ actual toolface angle is within the threshold deviation from the advisory toolface angle. If the second actual toolface angle is within the threshold deviation, then the next step is a step 2537 in which the toolface counter is reset to zero and then the following step is the step 1805. If the second actual toolface angle is not within the threshold deviation, then the next step is step 2540.

At the step 2540, the apparatus 100 determines a difference, measured in a clockwise direction from the first actual toolface angle, between the first actual toolface angle and the second actual toolface.

At the step 2545, the controller 190 determines whether the difference is between 20 degrees and 180 degrees. If yes, then the next step is the step 2537 followed by the step 1805. If no, then the next step is the step 525.

At the step 525 of the method 2500, the module 215*f* pauses the drilling activities for the predetermined period of time or the wait time received via the window 2630. Pausing the drilling activities for the predetermined amount of time allows for the differential pressure to reduce, and thus prevents pushing the toolface further in a direction that is not desirable. The controller 190 may automatically pause the system by deactivating the top drive control system 220, the drawworks control system 230, and the mud pump drive 225.

The method 2500 may be executed simultaneously with each of the methods 1600, 1800, or similar method involving slide drilling.

Generally, the term "drilling equipment" refers to any combination of the lifting gear, the drawworks 130, the hook 135, the quill 145, the top drive 140, the saver sub 150, a portion or the entirety of the drill string 155, the BHA 170, the drill bit 17, the mud pump(s) 180, the BOP 186, the controller 190, and the plurality of sensors 210.

Each of the steps of the methods 300, 400, 500, 700, 1000, 1300, 1700, 1800, 2200, and 2500 may be performed automatically. The controller 190 of FIG. 1 (and others described herein) may be configured to automatically perform the required calculations, determinations, comparison, etc. and may also be configured to automatically control the drilling equipment to implement the instructions in any of the workflows. Moreover and in some instances, each of the parameters 215*a*-215*f* is provided by the controller 190 or the module 212. The module 212 automatically identifies what the ideal parameter is for each of the parameters 215*a*-215*f* and each of the input windows are pre-populated when presented to the user. In some instances, instead of determining a number of wraps to rotate the drill string 155 and/or rotating the drill string 155 by a number of wraps in any of the steps of the methods 300, 400, 500, 700, 1000, 1300, 1700, 1800, 2200, and 2500, may be replaced with determining an amount of torque applied to the drill string 155 at the surface and/or rotating the drill string 155 until a predetermined amount of torque has been applied to the drill string 155 at the surface.

In some instances, the parameters 215*a*-215*f* are provided by a user and thus are user inputs. In other instances, the parameters 215*a*-215*f* are generated by the apparatus 100 using historical user inputs, formation information, and historical results. Other inputs used by the sliding module 212 may include a quill torque positive limit, a quill torque negative limit, a quill speed positive limit, a quill speed negative limit, a quill oscillation positive limit, a quill oscillation negative limit, a quill oscillation neutral point input, and a toolface orientation input. Additional parameters of the apparatus 100 may also include a WOB tare, a mud motor ΔP tare, an ROP input, a WOB input, a mud motor ΔP input, and a hook load limit.

Some embodiments include a survey data input from prior surveys, a planned drilling path, or preferably both. These inputs may be used to derive the target toolface orientation input intended to maintain the BHA 170 on the planned drilling path. However, in other embodiments, the target toolface orientation is directly entered. Other embodiments within the scope of the present disclosure may utilize additional or alternative parameters. In some instances, the sliding module 212 and/or the controller 190 may access trend data stored from prior surveys.

The controller 190 may be, or include, intelligent or model-free adaptive controllers, such as those commercially available from Cyber Soft, General Cybernation Group, Inc. The controller 190 may also be collectively or independently implemented on any conventional or future-developed computing device, such as one or more personal computers or servers, hand-held devices, PLC systems, and/or mainframes, among others.

Figure 28:
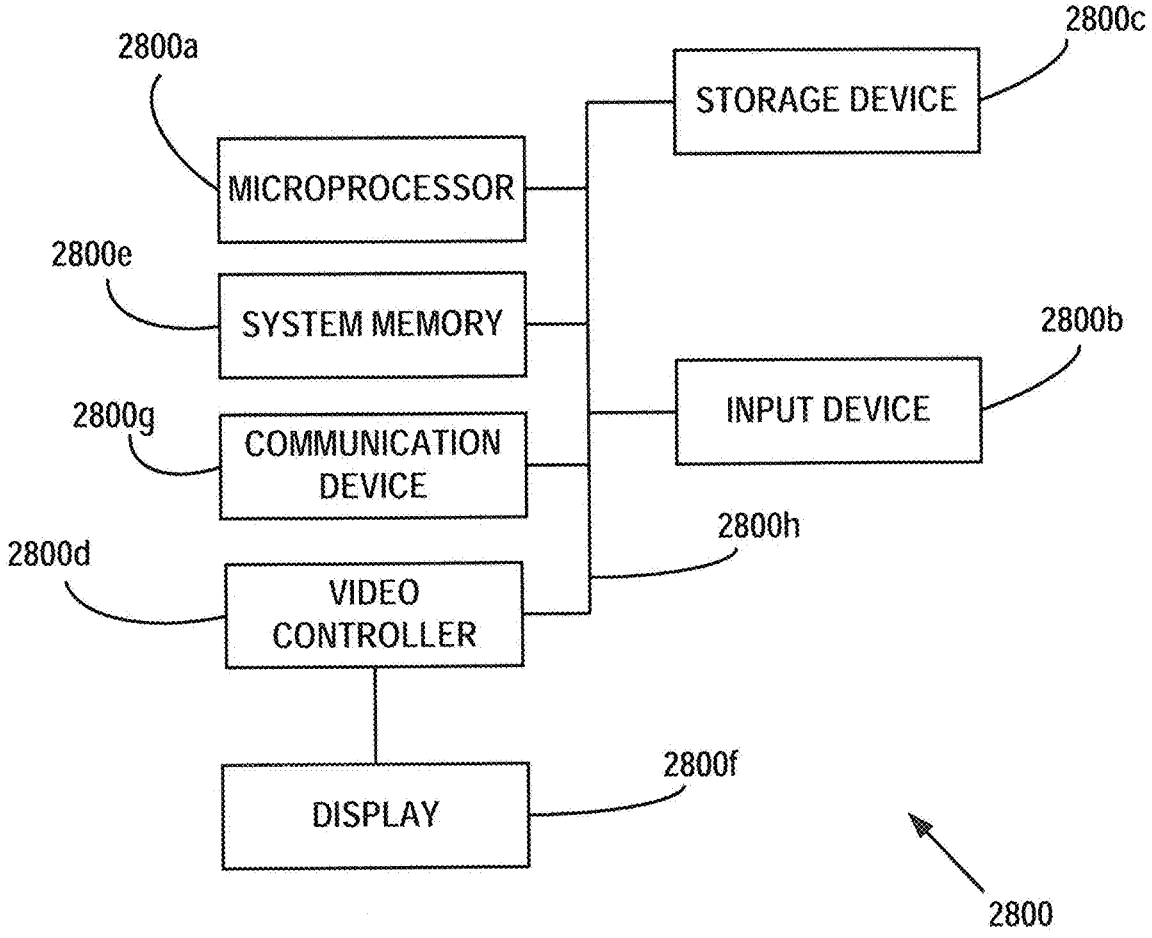
FIG. 28 is a diagrammatic illustration of a node for implementing one or more example embodiments of the present disclosure, according to an example embodiment.

Referring to FIG. 28, illustrated is an example system 2800 for implementing one or more embodiments of at least portions of the apparatus and/or methods described herein. The system 2800 includes a processor 2800*a*, an input device 2800*b*, a storage device 2800*c*, a video controller 2800*d*, a system memory 2800*e*, a display 2800*f*, and a communication device 2800*g*, all interconnected by one or more buses 2800*h*. The storage device 2800*c* may be a floppy drive, hard drive, CD, DVD, optical drive, or any other form of storage device. In addition, the storage device 1106 may be capable of receiving a floppy disk, CD, DVD, or any other form of computer-readable medium that may contain computer-executable instructions. Communication device 1116 may be a modem, network card, or any other device to enable the system 2800 to communicate with other systems.

Embodiments within the scope of the present disclosure may offer certain advantages over the prior art. For example, when automating a slide drilling operation using the methods 300, 400, 500, 700, 1000, 1300, 1700, 1800, 2200, and 2500, the slide drilling operation is more efficient. For example, determining whether a minimum WOB has been met prior to oscillating the drill string 155 prevents or reduces the amount of movement in the toolface.

A computer system typically includes at least hardware capable of executing machine readable instructions, as well as software for executing acts (typically machine-readable instructions) that produce a desired result. In addition, a computer system may include hybrids of hardware and software, as well as computer sub-systems.

Hardware generally includes at least processor-capable platforms, such as client-machines (also known as personal computers or servers), and hand-held processing devices (such as smart phones, PDAs, and personal computing devices (PCDs), for example). Furthermore, hardware typically includes any physical device that is capable of storing machine-readable instructions, such as memory or other data storage devices. Other forms of hardware include hardware sub-systems, including transfer devices such as modems, modem cards, ports, and port cards, for example. Hardware may also include, at least within the scope of the present disclosure, multi-modal technology, such as those devices and/or systems configured to allow users to utilize multiple forms of input and output—including voice, keypads, and stylus—interchangeably in the same interaction, application, or interface.

Software may include any machine code stored in any memory medium, such as RAM or ROM, machine code stored on other devices (such as floppy disks, CDs or DVDs, for example), and may include executable code, an operating system, as well as source or object code, for example. In addition, software may encompass any set of instructions capable of being executed in a client machine or server—and, in this form, is often called a program or executable code.

Hybrids (combinations of software and hardware) are becoming more common as devices for providing enhanced functionality and performance to computer systems. A hybrid may be created when what are traditionally software functions are directly manufactured into a silicon chip—this is possible since software may be assembled and compiled into ones and zeros, and, similarly, ones and zeros can be represented directly in silicon. Typically, the hybrid (manufactured hardware) functions are designed to operate seamlessly with software. Accordingly, it should be understood that hybrids and other combinations of hardware and software are also included within the definition of a computer system herein, and are thus envisioned by the present disclosure as possible equivalent structures and equivalent methods.

Computer-readable mediums may include passive data storage such as a random access memory (RAM), as well as semi-permanent data storage such as a compact disk or DVD. In addition, an embodiment of the present disclosure may be embodied in the RAM of a computer and effectively transform a standard computer into a new specific computing machine.

Data structures are defined organizations of data that may enable an embodiment of the present disclosure. For example, a data structure may provide an organization of data or an organization of executable code (executable software). Furthermore, data signals are carried across transmission mediums and store and transport various data structures, and, thus, may be used to transport an embodiment of the invention. It should be noted in the discussion herein that acts with like names may be performed in like manners, unless otherwise stated.

The controllers and/or systems of the present disclosure may be designed to work on any specific architecture. For example, the controllers and/or systems may be executed on one or more computers, Ethernet networks, local area networks, wide area networks, internets, intranets, hand-held and other portable and wireless devices and networks.

Moreover, methods within the scope of the present disclosure may be local or remote in nature. These methods, and any controllers discussed herein, may be achieved by one or more intelligent adaptive controllers, programmable logic controllers, artificial neural networks, and/or other adaptive and/or "learning" controllers or processing apparatus. For example, such methods may be deployed or performed via PLC, PAC, PC, one or more servers, desktops, handhelds, and/or any other form or type of computing device with appropriate capability.

As used herein, the term "substantially" means that a numerical amount is within about 20 percent, preferably within about 10 percent, and more preferably within about 5 percent of a stated value. In a preferred embodiment, these terms refer to amounts within about 1 percent, within about 0.5 percent, or even within about 0.1 percent, of a stated value.

The term "about," as used herein, should generally be understood to refer to both numbers in a range of numerals. For example, "about 1 to 2" should be understood as "about 1 to about 2." Moreover, all numerical ranges herein should be understood to include each whole integer, or 1/10 of an integer, within the range.

The present disclosure also incorporates herein in its entirety by express reference thereto each of the following references: U.S. Pat. No. 9,784,089 to Boone et al; and U.S. patent application Ser. No. 15/603,784 filed May 24, 2016.

The foregoing outlines features of several embodiments so that those of ordinary-skill in the art may better understand the aspects of the present disclosure. Those of ordinary-skill in the art should appreciate that they may readily use the present disclosure as a basis for designing or modifying other processes and structures for carrying out the same purposes and/or achieving the same advantages of the embodiments introduced herein. Those of ordinary-skill in the art should also realize that such equivalent constructions do not depart from the spirit and scope of the present disclosure, and that they may make various changes, substitutions and alterations herein without departing from the spirit and scope of the present disclosure.

What is claimed is:

1. A method of automating a slide drilling operation that comprises a plurality of tasks, the method comprising:

presenting selectable indicators, on a graphical user interface, wherein each selectable indicator is associated with one task from the plurality of tasks related to a slide drilling operation;

wherein the graphical user interface is operably coupled to a controller that is in communication with drilling equipment, wherein the controller is configured to:

receive data from the drilling equipment; and control the operation of at least a portion of the drilling equipment using a predetermined workflow and task parameters; and wherein each task is associated with at least one predetermined workflow;

receiving by the controller a first selection command associated with a first selectable indicator presented on the graphical user interface, a first task comprising removing trapped torque from a drill string that is coupled to a bottom hole assembly used in the slide drilling operation, and a first predetermined workflow wherein the first task of removing trapped torque from the drill string is associated with a workflow to move the drill string vertically in first and second opposing directions, and with a workflow to rotate the drill string;

presenting on the graphical user interface, in response to the receipt of the first selection command, a first dialogue box for receiving a first plurality of task parameters associated with the first predetermined workflow;

receiving, using the first dialogue box, the first plurality of task parameters;

executing, using the controller and at least a portion of the drilling equipment, the first task using the first predetermined workflow and the first plurality of task parameters;

presenting, on the graphical user interface, a second dialogue box for receiving a second selection command selecting the workflow to move the drill string vertically as the first predetermined workflow or the workflow to rotate the drill string as the first predetermined workflow; and receiving, by the controller, the second selection command;

wherein, when the workflow to move the drill string vertically in the first and second opposing directions is the first predetermined workflow, the first plurality of task parameters comprises: a speed at which the drill string is to be moved vertically in the first and second opposing directions; a number of repetitions of moving the drill string vertically in the first and second opposing directions; or a vertical distance over which the drill string is to be moved vertically in the first and second opposing directions with each repetition; and wherein, when the workflow to rotate the drill string is the first predetermined workflow, the first plurality of task parameters comprises a number of rotations of the drill string.

2. The method of claim 1, wherein the plurality of tasks further comprises one or more of:

auto-oscillating the drill string;

tagging bottom using the drill string;

obtaining a target toolface angle;

maintaining the target toolface angle; and evaluating a portion of the slide drilling operation.

3. The method of claim 1, which further comprises:

automatically presenting the selectable indicators on the graphical user interface during or after the execution of the first task;

receiving by the controller a second selection command associated with: a second selectable indicator of the selectable indicators; a second task; and a second predetermined workflow;

presenting on the graphical user interface, in response to the receipt of the second selection command, a second dialogue box configured to receive a second plurality of task parameters;

receiving, using the second dialogue box, the second plurality of task parameters; and automatically executing, using the controller and at least a portion of the drilling equipment, the second task using the second predetermined workflow and the second plurality of task parameters.

4. The method of claim 1, wherein the second selection command selects the workflow to rotate the drill string as the first predetermined workflow;

wherein the drilling equipment comprises a top drive; and wherein executing the first task using the first predetermined workflow and the first plurality of task parameters comprises automatically rotating, in response to the receipt of the second selection command and first plurality of task parameters, the drill string the number of rotations using the top drive.

5. The method of claim 1, wherein the second selection command selects the workflow to move the drill string vertically as the first predetermined workflow;

wherein the drilling equipment comprises a drawworks; and wherein executing the first task using the first predetermined workflow and the first plurality of task parameters comprises automatically lifting the drill string, in response to the receipt of the second selection command and the first plurality of task parameters, the vertical distance at the speed for the number of repetitions using the drawworks.

6. The method of claim 5, wherein the drilling equipment further comprises a top drive brake, wherein the workflow to move the drill string vertically as the first predetermined workflow also includes releasing the top drive brake; and wherein executing the first task using the first predetermined workflow and the first plurality of task parameters further comprises automatically releasing the top drive brake.

7. The method of claim 1, wherein the drilling equipment further comprises:

a bottom hole assembly ("BHA") coupled to a drill string that extends within a wellbore;

a toolface sensor coupled to the BHA; and a top drive configured to rotate the drill string at the surface of the wellbore;

wherein the second task is either obtaining a target toolface angle or maintaining a toolface at the target toolface angle during the slide drilling operation;

wherein the first plurality of task parameters comprises a selected period of time;

wherein, executing, using the controller and the drilling equipment, the second task using the first predetermined workflow and the first plurality of task parameters comprises:

receiving, by the controller and from the toolface sensor, first drilling data from the BHA;

determining, by the controller and using the first drilling data, a first estimated toolface angle of the BHA;

determining, by the controller, if the first estimated toolface angle of the BHA is within a threshold deviation from the target toolface angle;

when the first estimated toolface angle is not within the threshold deviation, then incrementing a count of a toolface counter from zero to one;

receiving, by the controller and from the toolface sensor, second drilling data from the BHA;

determining, by the controller and using the second drilling data, a second estimated toolface angle of the BHA;

determining, by the controller, if the second estimated toolface angle of the BHA is within the threshold deviation from the target toolface angle; and when the second estimated toolface angle is not within the threshold deviation and the toolface counter is at one, then determining whether a difference between the first estimated toolface angle and the second estimated toolface angle, measured in a clockwise direction from the first estimated toolface angle is between 20 degrees and 180 degrees;

when the difference is not between 20 degrees and 180 degrees, then pausing, using the controller and the top drive, rotation of the drill string for the selected period of time; and when the difference is between 20 degrees and 180 degrees, then resetting the count of the toolface counter to zero.

8. The method of claim 7, wherein the threshold deviation comprises: up to 60 degrees measured in the counterclockwise direction from the target toolface angle; and up to 120 degrees measured in a clockwise direction from the target toolface angle.

9. The method of claim 7, wherein the selected period of time is about 10 seconds.

10. The method of claim 7, wherein the drilling equipment further comprises a mud pump; and wherein pausing drilling activities further comprises ceasing operation of the mud pump.

11. The method of claim 7, wherein pausing drilling activities reduces a downhole pressure differential.

12. The method of claim 1, wherein the plurality of tasks further comprises:

a second task of auto-oscillating the drill string;

a third task of tagging bottom using the drill string;

a fourth task of obtaining a target toolface angle;

a fifth task of maintaining a toolface angle during the slide drilling operation; and a sixth task of evaluating a portion of the slide drilling operation; and wherein the method further comprises automatically executing, using the controller and at least a portion of the drilling equipment: the fifth task after completion of the fourth task; the fourth task after completion of the third task; the third task after completion of the second task; or the second task after completion of the first task.

13. A method of automating a slide drilling operation that comprises a plurality of tasks, the method comprising:

presenting selectable indicators, on a graphical user interface, wherein each selectable indicator is associated with one task from the plurality of tasks related to a slide drilling operation;

wherein the graphical user interface is operably coupled to a controller that is in communication with drilling equipment, wherein the controller is configured to:

receive data from the drilling equipment which comprises:

a bottom hole assembly ("BHA") coupled to a drill string that extends within a wellbore;

a toolface sensor coupled to the BHA; and a top drive configured to rotate the drill string at the surface of the wellbore; and control the operation of at least a portion of the drilling equipment using a predetermined workflow and task parameters; and wherein each task is associated with at least one predetermined workflow;

receiving by the controller a first selection command associated with a first selectable indicator presented on the graphical user interface, a first task, and a first predetermined workflow;

presenting on the graphical user interface, in response to the receipt of the first selection command, a first dialogue box for receiving a first plurality of task parameters associated with the first predetermined workflow;

receiving, using the first dialogue box, the first plurality of task parameters; and executing, using the controller and at least a portion of the drilling equipment, the first task using the first predetermined workflow and the first plurality of task parameters;

wherein the first task is tagging bottom using the BHA;

wherein the first plurality of task parameters comprises a drill string rotation parameter;

wherein executing the first task using the first predetermined workflow and the first plurality of task parameters comprises:

receiving, by the controller and from the toolface sensor, data associated with a first estimated toolface angle of the BHA while the BHA is off-bottom of the wellbore;

determining, by the controller and based on the data associated with the first estimated toolface angle of the BHA, the first estimated toolface angle while the BHA is off-bottom;

determining while the BHA is off-bottom, by the controller, a target toolface angle of the BHA;

calculating, by the controller, a first difference measured in a clockwise direction between the target toolface angle and the first estimated toolface angle;

when the first difference is greater than 180 degrees, calculating, by the controller, an adjusted drill string rotation parameter using a first rule and the drill string rotation parameter;

when the first difference is equal to or less than 180 degrees, calculating, by the controller, the adjusted drill string rotation parameter using a second rule and the drill string rotation parameter;

rotating, by the controller and using the top drive, the drill string by the adjusted drill string rotation parameter while the BHA is off-bottom; and tagging bottom, using the BHA, after rotating the drill string by the adjusted drill string rotation parameter.

14. The method of claim 13, wherein the first rule comprises adding the drill string rotation parameter to a second difference between 360 degrees and the first difference; and wherein the second rule comprises subtracting the first difference from the drill string rotation parameter.

15. The method of claim 13, wherein the drill string rotation parameter is defined by a number of rotations of the drill string in a first direction.

16. The method of claim 13, wherein the plurality of tasks further comprises one or more of:

removing trapped torque from a drill string;

auto-oscillating the drill string;

obtaining a target toolface angle;

maintaining the target toolface angle; and evaluating a portion of the slide drilling operation.

17. The method of claim 13, which further comprises:

automatically presenting the selectable indicators on the graphical user interface during or after the execution of the first task;

receiving by the controller a second selection command associated with: a second selectable indicator of the selectable indicators; a second task; and a second predetermined workflow;

presenting on the graphical user interface, in response to the receipt of the second selection command, a second dialogue box configured to receive a second plurality of task parameters;

receiving, using the second dialogue box, the second plurality of task parameters; and automatically executing, using the controller and at least a portion of the drilling equipment, the second task using the second predetermined workflow and the second plurality of task parameters.

18. A method of automating a slide drilling operation that comprises a plurality of tasks, the method comprising:

presenting selectable indicators, on a graphical user interface, wherein each selectable indicator is associated with one task from the plurality of tasks related to a slide drilling operation;

wherein the graphical user interface is operably coupled to a controller that is in communication with drilling equipment, wherein the controller is configured to:

receive data from the drilling equipment which comprises:

a top drive, and a weight on bit sensor; and control the operation of at least a portion of the drilling equipment using a predetermined workflow and task parameters; and wherein each task is associated with at least one predetermined workflow;

receiving by the controller a first selection command associated with a first selectable indicator presented on the graphical user interface, a first task wherein the first task is auto-oscillating the drill string, and a first predetermined workflow;

presenting on the graphical user interface, in response to the receipt of the first selection command, a first dialogue box for receiving a first plurality of task parameters associated with the first predetermined workflow;

receiving, using the first dialogue box, the first plurality of task parameters; and executing, using the controller and at least a portion of the drilling equipment, the first task using the first predetermined workflow and the first plurality of task parameters;

wherein the first plurality of task parameters comprises measuring a minimum weight on bit threshold measurement;

wherein the method further comprises:

receiving, by the controller, data from the weight on bit sensor;

determining, using the data from the weight on bit sensor and the controller, an estimated weight on bit; and wherein executing the first task using the first predetermined workflow and the first plurality of task parameters comprises automatically oscillating the drill string, using the top drive, upon the controller determining that the estimated weight on bit exceeds the minimum weight on bit threshold measurement.

19. The method of claim 18, wherein the plurality of tasks further comprises one or more of:

removing trapped torque from a drill string;

tagging bottom using the drill string;

obtaining a target toolface angle;

maintaining the target toolface angle; and evaluating a portion of the slide drilling operation.

20. The method of claim 18, which further comprises:

automatically presenting the selectable indicators on the graphical user interface during or after the execution of the first task;

receiving by the controller a second selection command associated with: a second selectable indicator of the selectable indicators; a second task; and a second predetermined workflow;

presenting on the graphical user interface, in response to the receipt of the second selection command, a second dialogue box configured to receive a second plurality of task parameters;

receiving, using the second dialogue box, the second plurality of task parameters; and automatically executing, using the controller and at least a portion of the drilling equipment, the second task using the second predetermined workflow and the second plurality of task parameters.

* * * * *